US009224325B1

(12) United States Patent
Fan

(10) Patent No.: US 9,224,325 B1
(45) **Date of Patent: *Dec. 29, 2015**

(54) METHOD OF DRIVING ACTIVE MATRIX DISPLAYS

(71) Applicant: Nongqiang Fan, Hauppague, NY (US)

(72) Inventor: Nongqiang Fan, Hauppague, NY (US)

( * ) Notice: Subject to any disclaimer, the term of this patent is extended or adjusted under 35 U.S.C. 154(b) by 164 days.

This patent is subject to a terminal disclaimer.

(21) Appl. No.: 13/747,356

(22) Filed: Jan. 22, 2013

Related U.S. Application Data

(63) Continuation-in-part of application No. 13/225,543, filed on Sep. 5, 2011, now Pat. No. 8,674,918.

(60) Provisional application No. 61/625,042, filed on Apr. 16, 2012.

(51) Int. Cl.

| | |
|---|---|
| ***H05B 37/02*** | (2006.01) |
| ***H05B 39/04*** | (2006.01) |
| ***G09G 3/32*** | (2006.01) |
| ***H05B 33/08*** | (2006.01) |

(52) U.S. Cl.
CPC ..... *G09G 3/32* (2013.01); *H05B 33/0842* (2013.01)

(58) Field of Classification Search
CPC ..... G09G 3/32; G09G 3/36; H05B 33/0842; H05B 37/02; H05B 39/04; H05B 41/36
USPC ..... 315/210, 211, 225; 345/91, 92, 94
See application file for complete search history.

(56) References Cited

U.S. PATENT DOCUMENTS 8,044,882 B1 * 10/2011 Fan ..... 345/38
8,674,918 B1 * 3/2014 Fan ..... 345/91

* cited by examiner

*Primary Examiner* — Hai L Nguyen

(57) ABSTRACT

Method of writing a pixel data into a pixel element having at least one switching transistor, at least one nonlinear element, and at least one capacitive element. The method includes (1) setting both the semiconductor channel of the at least one switching transistor and the at least one nonlinear element into conducting states, and causing a voltage applied across the at least one capacitive element while the semiconductor channel of the at least one switching transistor maintains at conducting state and the at least one nonlinear element maintains at conducting state; and (2) after said causing, driving the at least one nonlinear element into non-conducting state from conducting state, and driving the semiconductor channel of the at least one switching transistor into non-conducting state from conducting state for settling the semiconductor channel into non-conducting state after the at least one nonlinear element is settled into non-conducting state.

26 Claims, 72 Drawing Sheets

Improvement

Improvement

METHOD OF DRIVING ACTIVE MATRIX DISPLAYS

RELATED APPLICATIONS

The present application is a Continuation-In-Part Application of U.S. patent application Ser. No. 13/225,543, filed on Sep. 5, 2011, titled "Method of Driving Active Matrix Displays," now U.S. Pat. No. 8,674,918 issued on Mar. 18, 2014, which is hereby incorporated by reference in its entirety. This application claims the benefit of U.S. Provisional Application No. 61/625,042, filed on Apr. 16, 2012, titled "Method of Driving Active Matrix Displays," which is hereby incorporated by reference in its entirety.

The present application is related to the following U.S. patent applications: Ser. No. 11/426,147 titled "METHOD OF DRIVING ACTIVE MATRIX DISPLAYS"; Ser. No. 11/426,162 titled "ACTIVE MATRIX DISPLAYS HAVING ENABLING LINES"; Ser. No. 11/426,171 titled "METHOD OF DRIVING ACTIVE MATRIX DISPLAYS HAVING NONLINEAR ELEMENTS IN PIXEL ELEMENTS"; and Ser. No. 11/426,177, titled "ACTIVE MATRIX DISPLAYS HAVING NONLINEAR ELEMENTS IN PIXEL ELEMENTS." The present application is also related to U.S. patent application Ser. No. 13/745,849, filed Jan. 20, 2013, titled "Method of Driving Pixel Element in Active Matrix Display," All of the these applications cited above as originally filed are hereby incorporated by reference in their entirety.

U.S. patent application Ser. No. 11/426,147, Ser. No. 11/426,162, Ser. No. 11/426,171, and Ser. No. 11/426,177 are issued as U.S. Pat. Nos. 8,044,882, 8,237,880, 8,013,826, and 8,022,911 respectively. All of these issued U.S. patents are hereby incorporated by reference in their entirety.

BACKGROUND

The present invention relates generally to active matrix displays, and more particularly to active matrix displays having nonlinear elements in pixel elements.

FIG. 1 shows a section of a conventional active matrix display. The conventional active matrix display in FIG. 1 includes a matrix of pixel elements (e.g., 50AA-50LA, 50AB-50LB, and 50AC-50LC), an array of column conducting lines (e.g., 30A, 30B, and 30C), and an array of row conducting lines (e.g., 40A-40L) crossing the array of column conducting lines. A row conducting line (e.g., 40A) is electrically coupled to one row of pixel element (e.g., 50AA-50AC). A pixel element (e.g., 50AB) includes a switching transistor 52 having a gate electrically connected to a row conducting line (e.g., 40A) and a capacitive element 54 having a terminal electrically connected to a column conducting line (e.g., 30B) through a semiconductor channel of the switching transistor 52.

In operation, during a predetermined time period, a row of pixel elements (e.g., 50AA-50AC) is selected for charging by applying a selection signal on a row conducting line (e.g., 40A). During the next predetermined time period, next row of pixel elements (e.g., 50BA-50BC) is selected for charging by applying a selection signal on the next row conducting line (e.g., 40B).

When charging a row of pixel elements (e.g., 50AA-50AC), each pixel element is charged with a data signal on a column conducting line. For example, the pixel elements 50AA, 50AB, and 50AC are charged respectively with the column conducting lines 30A, 30B, and 30C. When charging the next row of pixel elements (e.g., 50BA-50BC), each pixel element in this next row is also charged with a data signal on a column conducting line. For example, the pixel elements 50BA, 50BB, and 50BC are charged respectively with the column conducting lines 30A, 30B, and 30C.

During the predetermined time period for charging a row of pixel elements, the switching transistors in the pixel elements needs to be fast enough to change their conducting states. A switching transistor may need to change from the non-conducting state to the conducting state or change from the conducting state to the non-conducting state. When an active matrix display has a total of N rows, if the time period for charging all N rows of pixel elements progressively is a frame time period $T_0$, the allocated predetermined time period for charging one row of pixel elements can be less than $T_0/N$. For high resolution displays in which N is quite large (e.g, N is larger or equal to 512), the allocated predetermined time period can become quite short such that it put on stringent demand on the switching speed of the switching transistors. For lowering the manufacturing cost, it is desirable to reduce the switching speed requirement for the switching transistors by finding new forms of active matrix displays and by finding new method for driving these active matrix displays. Also, it is desirable to improve the display quality of those active matrix displays that use nonlinear elements, such as thin film diodes (TFD) or metal-insulator-metal diodes, as the switching elements for pixel elements.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
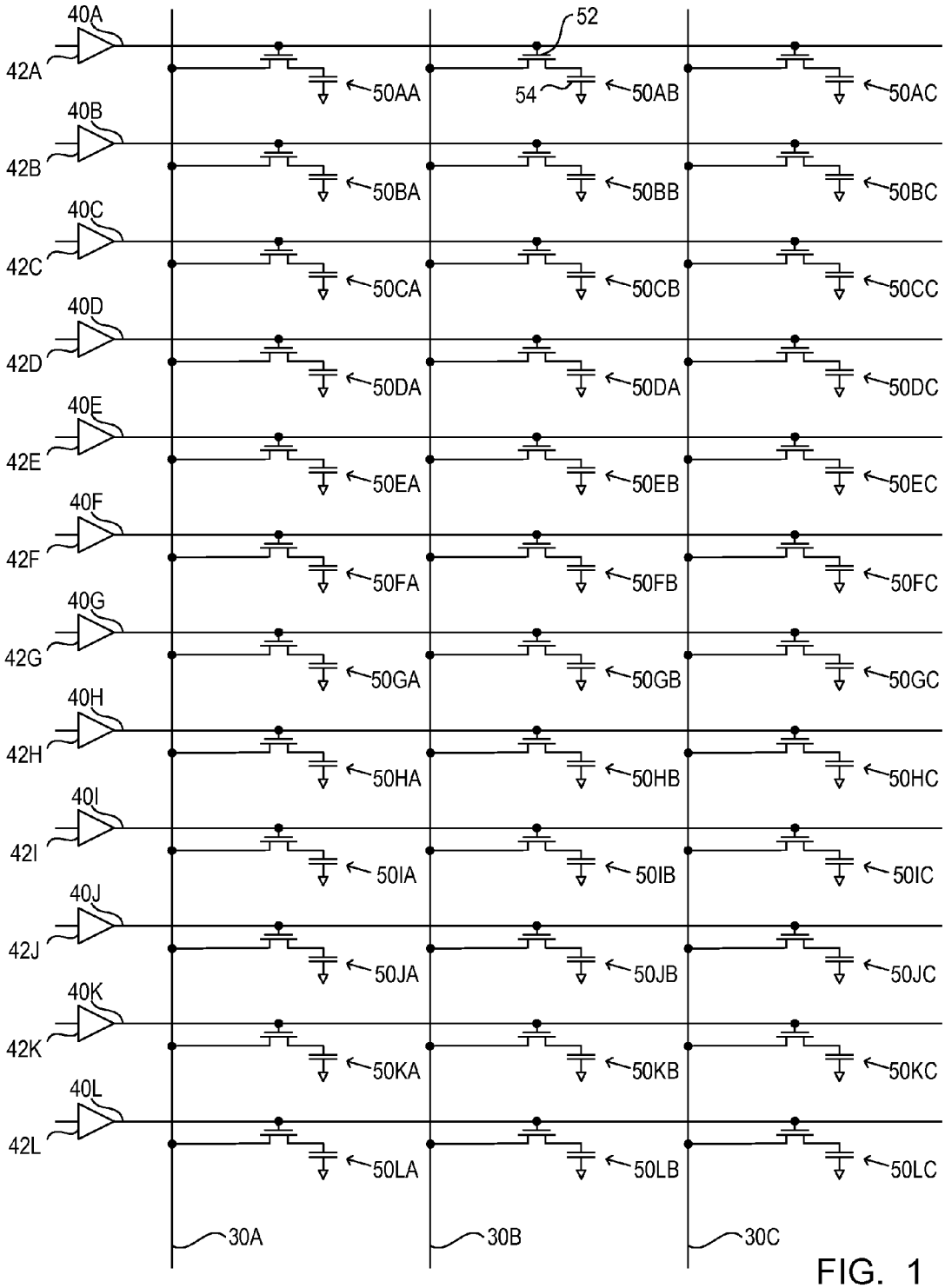
FIG. 1 Prior Art
FIG. 1 shows a section of a conventional active matrix display.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

FIGS. 2A-2D are implementations of active matrix displays that have enabling lines and nonlinear elements in pixel elements. In FIG. 2A-FIG. 2D, a section of the active matrix display includes a matrix of pixel elements (e.g., 50AA-AC, 50BA-BC, . . . , and 50LA-50LC), an array of column conducting lines (e.g., 30A, 30B, and 30C), and an array of row conducting lines (e.g., 40A-40L) crossing the array of column conducting lines, and an array of enabling lines (e.g., 60A, . . . , 60E, . . . , 601, . . . ) crossing the array of column conducting lines. A pixel element (e.g., 50AB) includes a resistive element 55, a nonlinear element 51, a switching transistor 52, and a capacitive element 54. The resistive element 55 has a first terminal electrically connected to a row conducting line (e.g., 40A). The nonlinear element 51 has a first terminal electrically connected to a column conducting line (e.g., 30B) and a second terminal electrically connected to a second terminal of the resistive element 55. The switching transistor 52 has a gate electrically connected to an enabling line (e.g., 60A). The capacitive element 54 has a first terminal electrically connected to the second terminal of the resistive element 55 through a semiconductor channel of the switching transistor 52.

The section of the active matrix display in FIGS. 2A-2D includes an array of enabling drivers (e.g., 62ATD, 62ETH, and 62ITL). An enabling driver can apply an enabling signal to multiple pixel elements positioned in a plurality of rows. For example, the enabling driver 62ATD for rows A to D can apply an enabling signal to the pixel elements 50AA-AC, 50BA-BC, 50CA-CC, and SODA-DC. The enabling driver 62ETH for rows E to H can apply an enabling signal to the pixel elements 50EA-EC, 50FA-FC, 50GA-GC, and 50HA-HC. The enabling driver 62ITL for rows I to L can apply an enabling signal to the pixel elements 50IA-IC, 50JA-JC, 50KA-KC, and 50LA-LC.

The section of the active matrix display in FIGS. 2A-2D includes an array of selection drivers (e.g., 42A-42L). A selection driver (e.g., 42A) can apply a selection voltage to a row conducting line (e.g., 40A).

The section of the active matrix display in FIG. 2A-FIG. 2D includes an array of data drivers (e.g., 70A-70C). A data driver (e.g., 70B) can apply a predetermined current to a column conducting line (e.g., 30B).

Figure 2A:
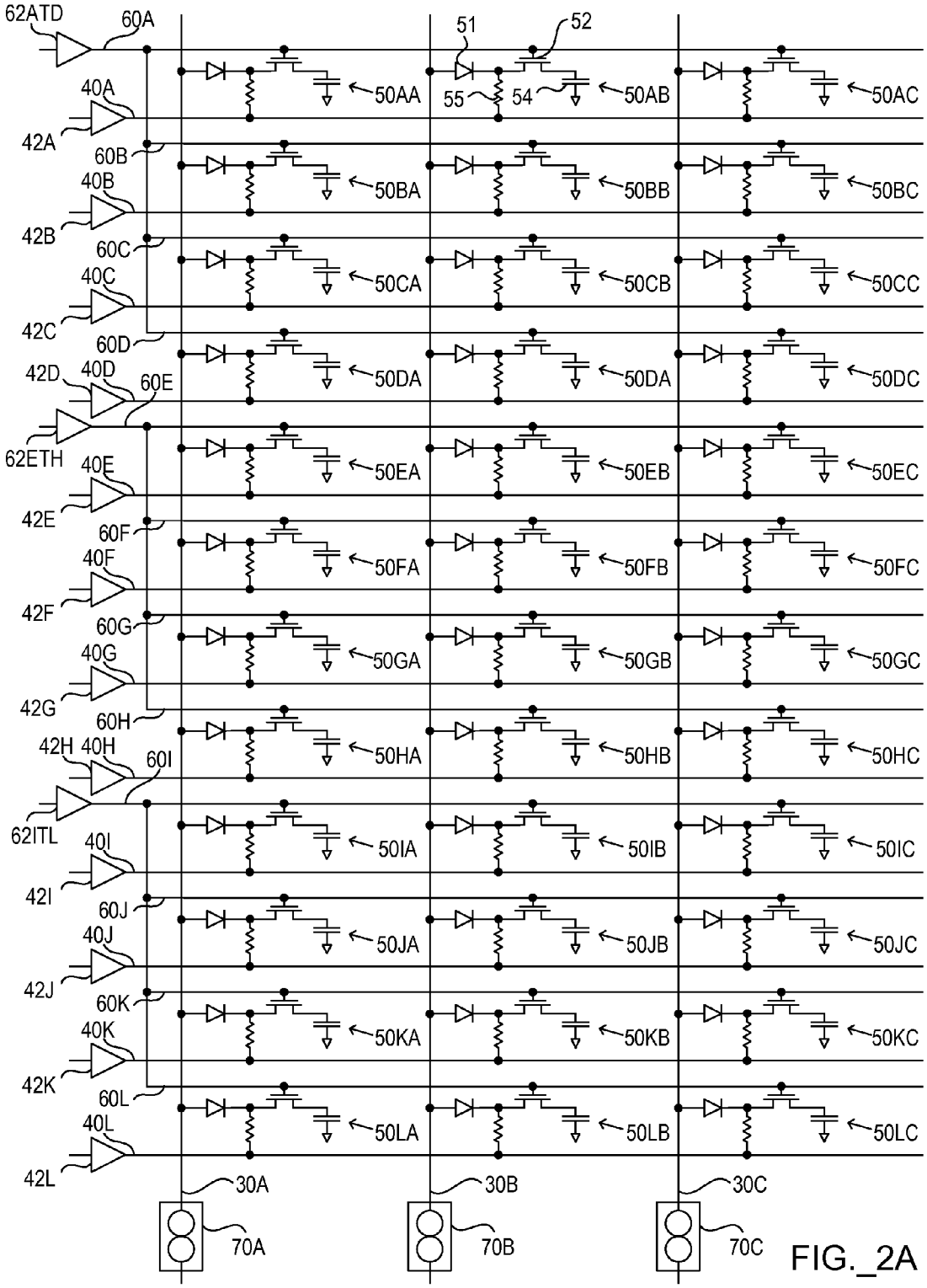
FIGS. 2A-2D are implementations of active matrix displays that have enabling lines and nonlinear elements in pixel elements.
Figure 2B:
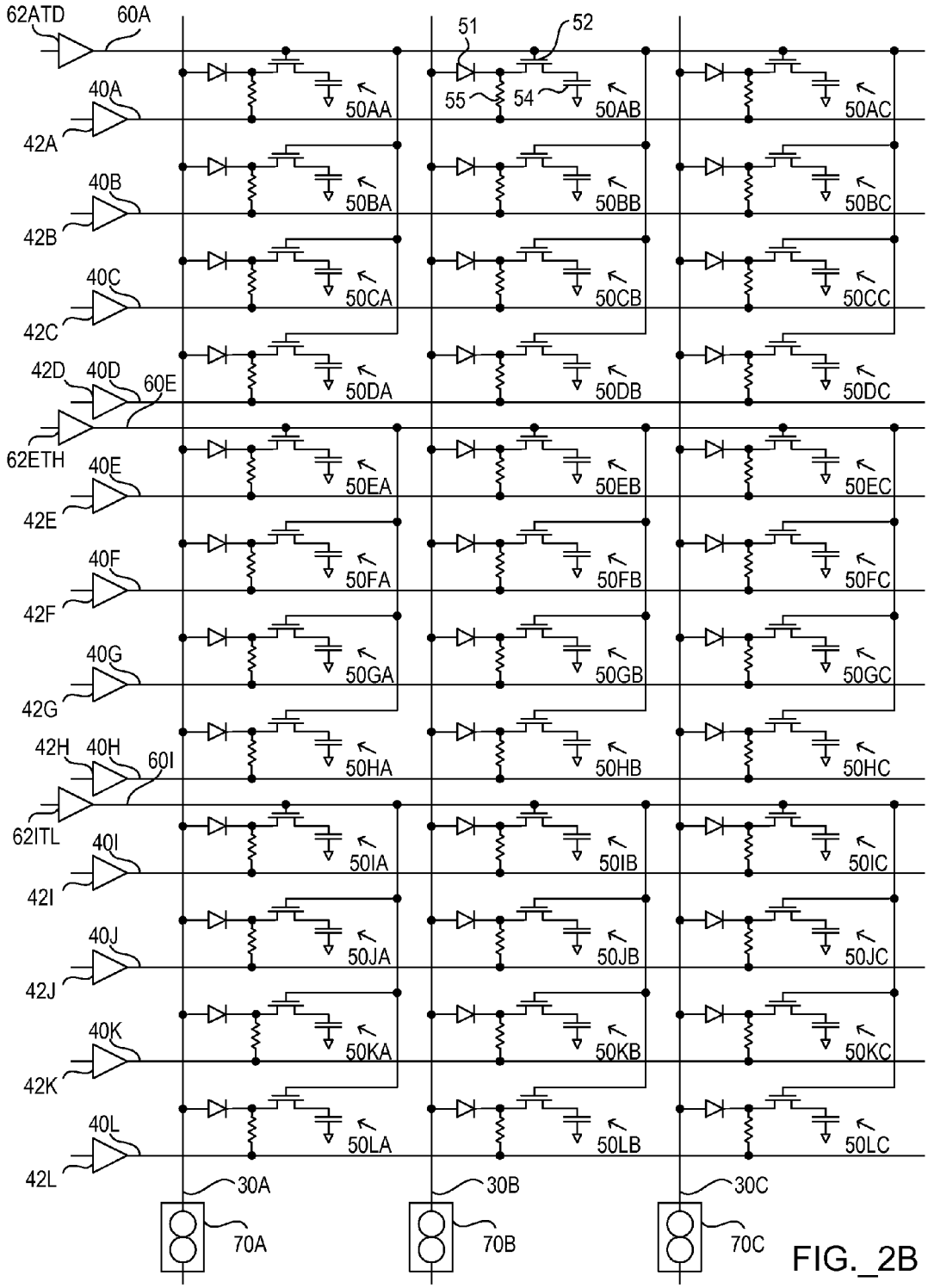
Figure 2C:
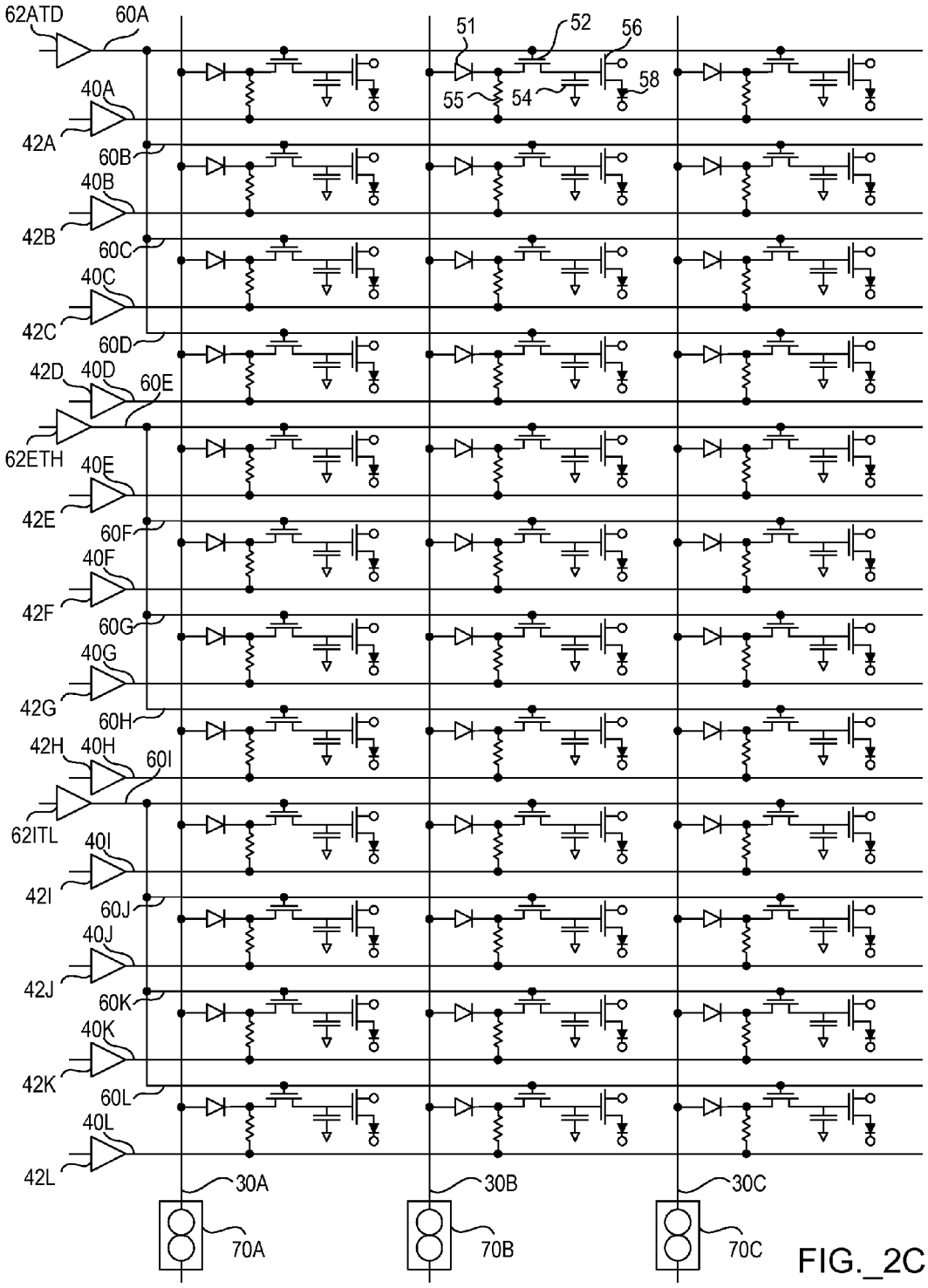

In FIG. 2A and FIG. 2C, the array of enabling lines includes enabling lines 60A, 60B, 60C, 60D, 60E, 60F, 60G, 60H, 601, 60J, 60K, and 60L. A row of pixel elements (e.g., 50AA-50AC) is electrically connected to a corresponding enabling line (e.g., 60A).

Figure 2D:
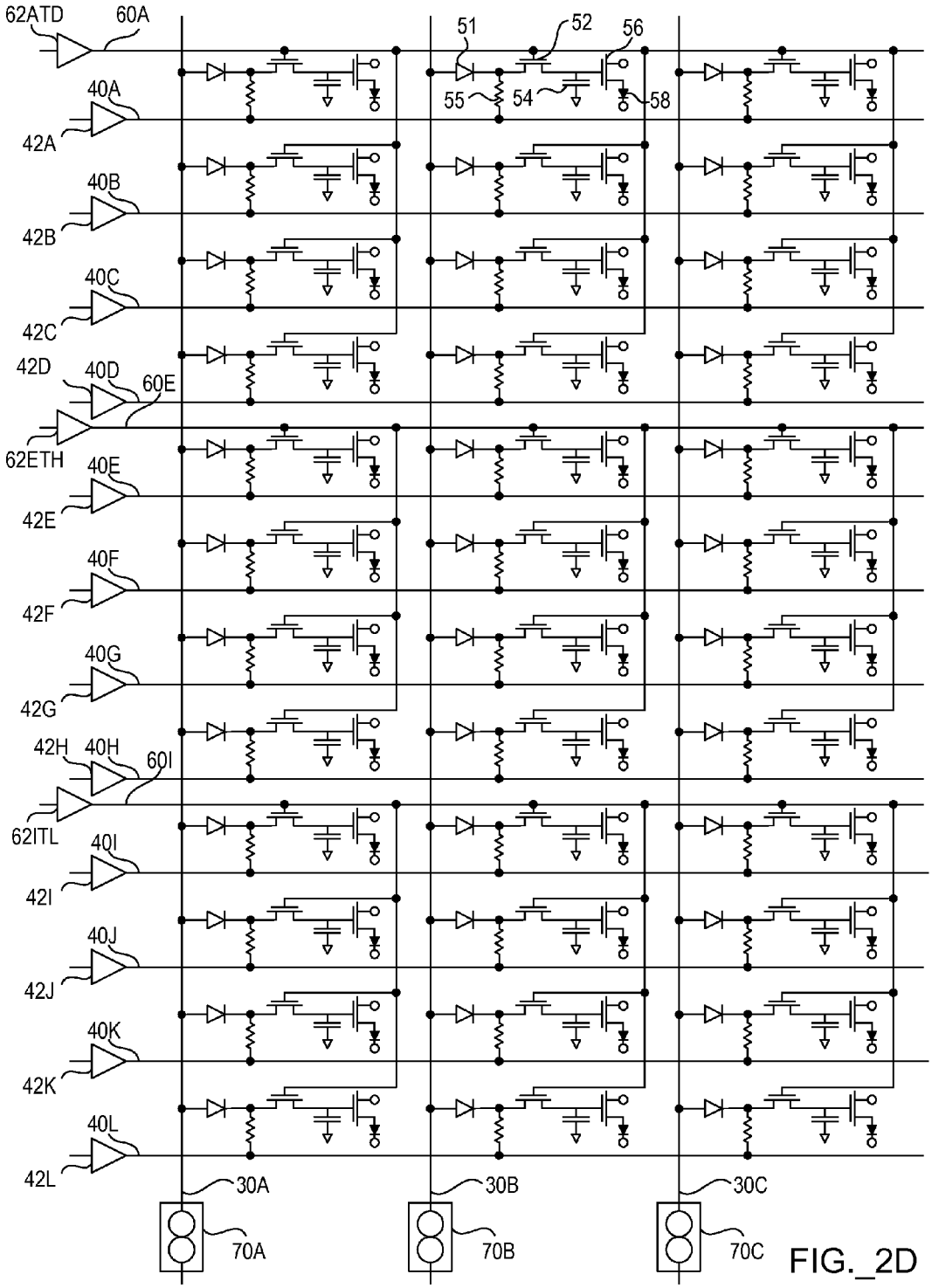
Figure 3A:
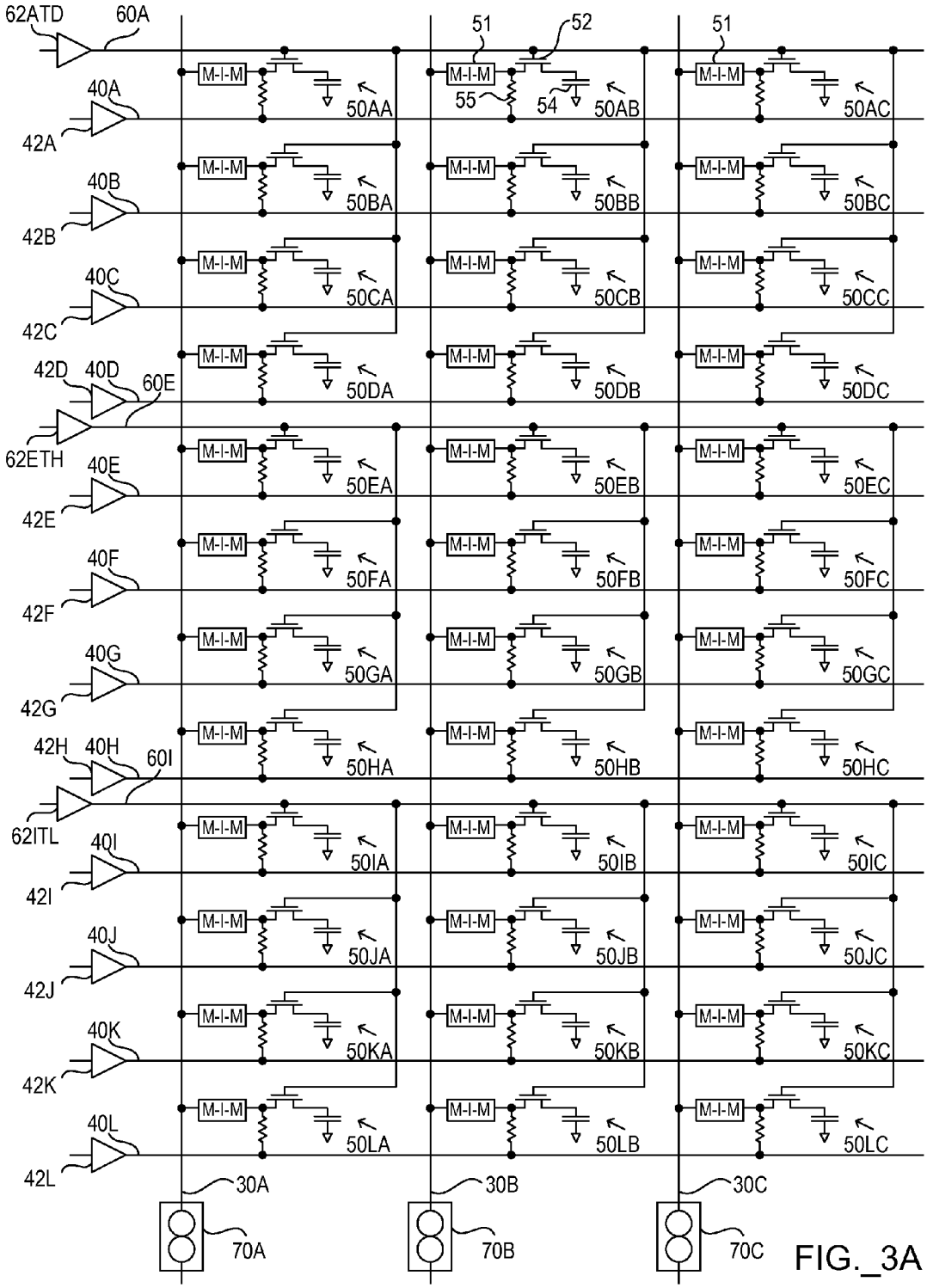
FIGS. 3A-3D are implementations of active matrix displays in which the nonlinear elements in the pixel elements are metal-insulator-metal diodes.
Figure 3B:
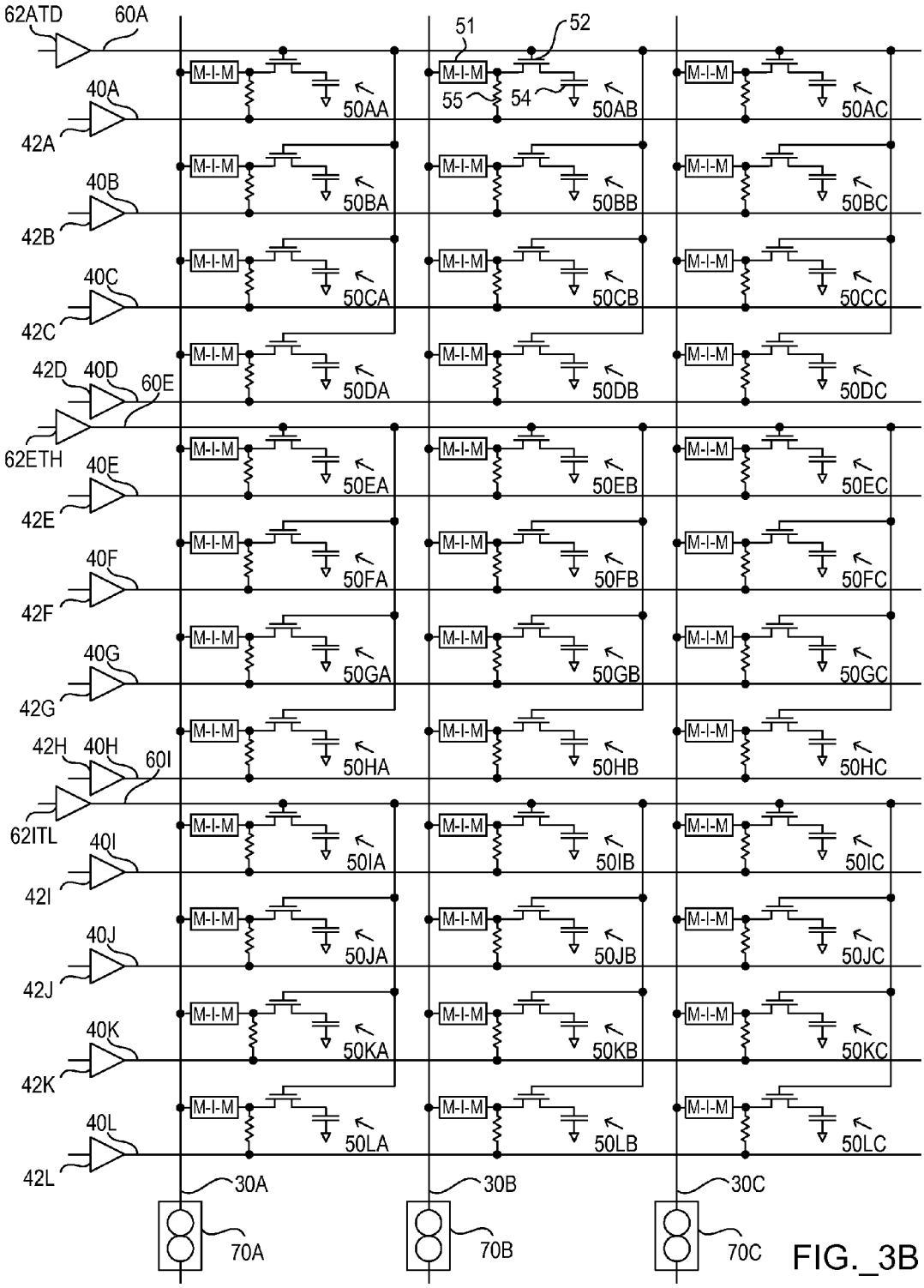
Figure 3C:
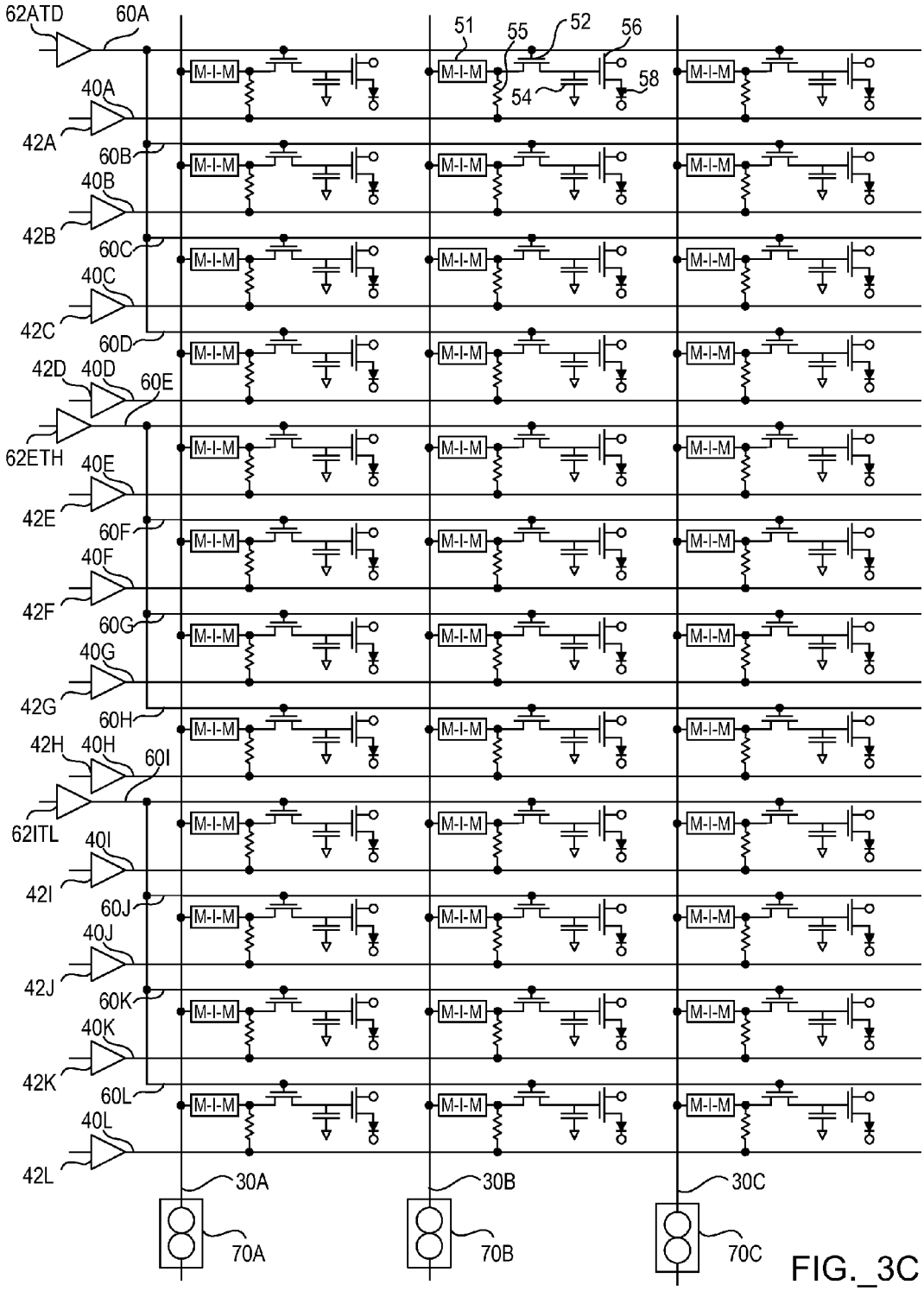
Figure 3D:
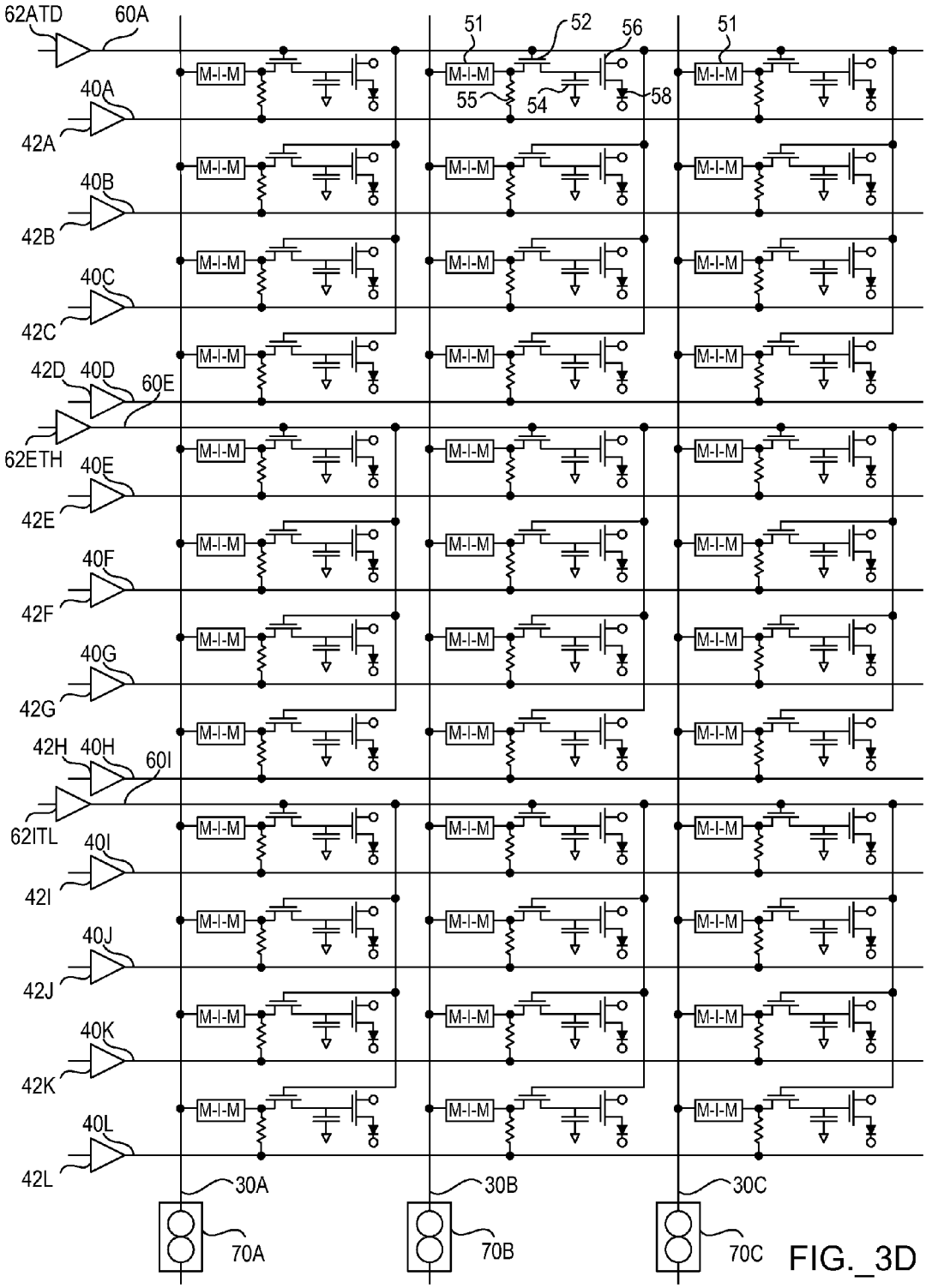

In FIG. 2B and FIG. 2D, the array of enabling lines includes enabling lines 60A, 60E, and 601. Multiple rows of pixel elements (e.g., 50AA-AC, 50BA-BC, 50CA-CC, and SODA-DC) are electrically connected to a corresponding enabling line (e.g., 60A).

In FIG. 2A and FIG. 2B, a pixel element (e.g., 50AB) includes a resistive element 55, a nonlinear element 51, a switching transistor 52, and a capacitive element 54. The switching transistor 52 has a gate electrically connected to an enabling line (e.g., 60A). The capacitive element 54 is electrically connected to a column conducting line (e.g., 30B) through both a semiconductor channel of the switching transistor 52 and the nonlinear element 51. In liquid crystal displays, the capacitive element 54 can be associated with a liquid crystal cell.

In FIG. 2C and FIG. 2D, a pixel element (e.g., 50AB) includes a resistive element 55, a nonlinear element 51, a switching transistor 52, a capacitive element 54, a driving transistor 56, and a light emitting diode 58. The switching transistor 52 has a gate electrically connected to an enabling line (e.g., 60A). The capacitive element 54 is electrically connected to a column conducting line (e.g., 30B) through both a semiconductor channel of the switching transistor 52 and the nonlinear element 51. The capacitive element 54 is electrically connected to the gate of the driving transistor 56. The light emitting 58 diode is electrically connected to a semiconductor channel of the driving transistor 56.

Figure 21:
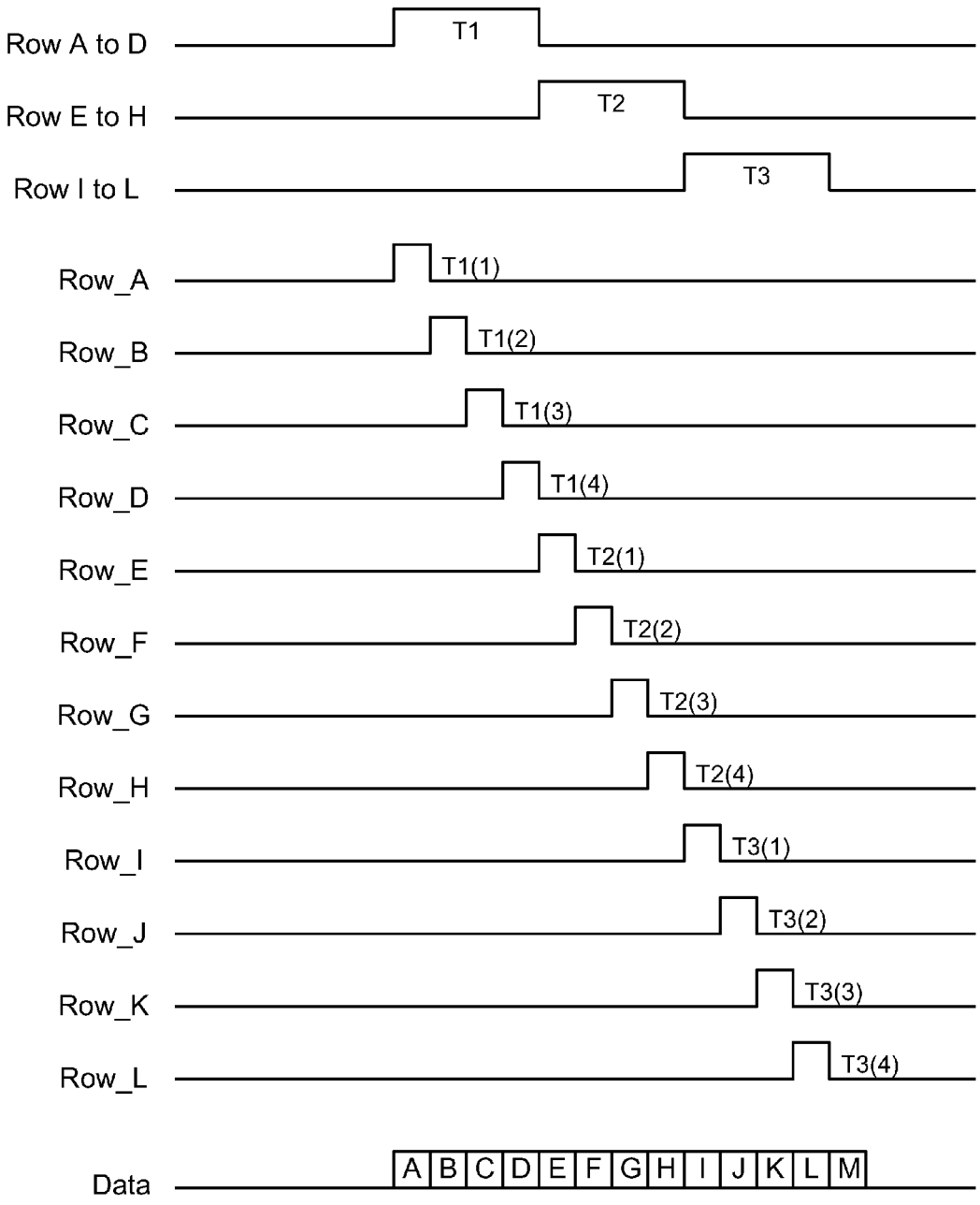
FIG. 21 shows a timing diagram in accordance with one implementation when operating the active matrix display in FIGS. 2A-2D.

FIG. 21 shows a timing diagram in accordance with one implementation when operating the active matrix display in FIGS. 2A-2D. In operation, during a first predetermined time period T1, a first group of multiple rows of pixel elements (including pixel elements 50AA-50AC, 50BA-50BC, 50CA-50CC, and SODA-50DC) are enabled as the enabled pixel elements when an enabling signal is applied to these pixel elements from an enabling driver 62ATD. During a second predetermined time period T2, a second group of multiple rows of pixel elements (including pixel elements 50EA-50EC, 50FA-50FC, 50GA-50GC, and 50HA-50HC) are enabled as the enabled pixel elements when an enabling signal is applied to these pixel elements from an enabling driver 62ETH. During a third predetermined time period T3, a third group of multiple rows of pixel elements (including pixel elements 501A-50IC, *SOJA*-50JC, 50KA-50KC, and 50LA-50LC) are enabled as the enabled pixel elements when an enabling signal is applied to these pixel elements from an enabling driver 62ITL.

During the first predetermined time period T1, the switching transistors 52 in the enabled pixel elements 50AA-50AC, 50BA-50BC, 50CA-50CC, and SODA-50DC are in the conducting state. The first predetermined time period T1 is further divided into four sub-time-periods T1(1), T1(2), T1(3), and T1(4). In one implementation, each of the four sub-time-periods has a duration that is one fourth of the duration of T1. During sub-time-periods T1(1), a first row of pixel elements 50AA-50AC is selected as the selected pixel elements for charging. During sub-time-periods T1(2), a second row of pixel elements 50BA-50BC is selected for charging. During sub-time-periods T1(3), a third row of pixel elements 50CA-50CC is selected for charging. During sub-time-periods T1(4), a fourth row of pixel elements SODA-50DC is selected for charging.

During sub-time-periods T1(1), a selection voltage $V_{on}$ is applied to the row conducting line 40A to provide a forward biasing voltage for the nonlinear elements in the selected pixel elements 50AA-50AC and these nonlinear elements are driven into the conducting state. Deselect voltages are applied to the row conducting lines 40B-40L to provide reverse biasing voltages for the nonlinear elements in the non-selected pixel elements (i.e., 50BA-50BC, 50CA-50CC, . . . and 50LA-50LC) and these non-selected pixel elements are maintained at the non-conducting state. During sub-time-periods T1(1), the capacitive elements 54 in the selected pixel elements 50AA, 50AB, and 50AC are charged respectively with data drivers 70A, 70B, and 70C.

When the data driver 70A applies a predetermined current $I_d$(AA) to the column conducting line 30A, most of this current passes through the nonlinear element 51 in the pixel element 50AA, because only the nonlinear element 51 in the pixel element 50AA is forward biased and the nonlinear elements in other pixel elements that connected to the column conducting line 30A are reverse biased. In the case that the sum of the leakage currents in these reverse biased nonlinear elements is significantly small, the predetermined current $I_d$(AA) from the data driver 70A essentially all passes through the nonlinear element 51 in the pixel element 50AA. If voltage drops on the row conducting line 40A can be neglected, the voltage applied to the first terminal of the capacitive element 54 in the pixel element 50AA is now of the value $V_{on}+R_0I_d$(AA), and the capacitive element 54 can now be charged to a targeted voltage. Here, $R_0$ is the resistance of the resistive element 55. Similarly, when the data driver 70B applies a predetermined current $I_d$(AB) to the column conducting line 30B, a voltage of the value $V_{on}+R_0I_d$(AB) can be applied to the first terminal of the capacitive element 54 in the pixel element 50AB. When the data driver 70C applies a predetermined current $I_d$(AC) to the column conducting line 30C, a voltage of the value $V_{on}+R_0I_d$(AC) can be applied to the first terminal of the capacitive element 54 in the pixel element 50AC. In the above, it is assumed that the leakage currents in the reverse biased nonlinear elements can be neglected and the voltage drops on the row conducting lines can be neglected.

During sub-time-periods T1(2), a selection voltage $V_{on}$ is applied to the row conducting line 40B to provide a forward biasing voltage for the nonlinear elements in the selected pixel elements 50BA-50BC. Deselect voltages are applied to the row conducting lines 40A and 40C-40L to provide reverse biasing voltages for the nonlinear elements in the non-selected pixel elements (i.e., 50AA-50AC, 50CA-50CC, . . . , and 50LA-50LC). During sub-time-periods T1(2), the capacitive elements 54 in the selected pixel elements 50BA, 50BB, and 50BC are charged respectively with data drivers 70A, 70B, and 70C.

During sub-time-periods T1(3), a selection voltage $V_{on}$ is applied to the row conducting line 40C to provide a forward biasing voltage for the nonlinear elements in the selected pixel elements 50CA-50CC. Deselect voltages are applied to the row conducting lines 40A-40B and 40D-40L to provide reverse biasing voltages for the nonlinear elements in the non-selected pixel elements (i.e., 50AA-50AC, 50BA-50BC, SODA-50DC, . . . , and 50LA-50LC). During sub-time-periods T1(3), the capacitive elements 54 in the selected pixel elements 50CA, 50CB, and 50CC are charged respectively with data drivers 70A, 70B, and 70C.

During sub-time-periods T1(4), a selection voltage $V_{on}$ is applied to the row conducting line 40D to provide a forward biasing voltage for the nonlinear elements in the selected pixel elements 50DA-50DC. Deselect voltages are applied to the row conducting lines 40A-40C and 40E-40L to provide reverse biasing voltages for the nonlinear elements in the non-selected pixel elements (i.e., 50AA-50AC, 50BA-50BC, 50CA-50CC, 50EA-50EC, . . . , and 50LA-50LC). During sub-time-periods T1(4), the capacitive elements 54 in the selected pixel elements 50DA, 50DB, and 50DC are charged respectively with data drivers 70A, 70B, and 70C.

At the end of sub-time-period T1(4) (i.e., the end of T1), a disabling signal is applied to the first group of multiple rows of pixel elements (including pixel elements 50AA-50AC, 50BA-50BC, 50CA-50CC, and 50DA-50DC) and the switching transistors 52 in these pixel elements are changed to the non-conducting state; consequently, the voltages on the capacitive elements 54 in these pixel elements can then be maintained.

With similar operation principle, during the second predetermined time period T2, the second group of multiple rows of pixel elements (including pixel elements 50EA-50EC, 50FA-50FC, 50GA-50GC, and 50HA-50HC) are charged. During the third predetermined time period T3, the third group of multiple rows of pixel elements (including pixel elements 501A-50IC, 50JA-50JC, 50KA-50KC, and 50LA-50LC) are charged.

FIGS. 3A-3D are implementations of active matrix displays in which the nonlinear elements 51 in the pixel elements (e.g., 50AA-AC, 50BA-BC, . . . , and 50LA-50LC) are metal-insulator-metal diodes. In general, the nonlinear elements 51 can be metal-insulator-metal diodes, PN diodes, PIN diodes, Schottky diodes, one or more serially connected diodes and resistors, or other kinds of two terminal non-linear devices. Certain kinds of three terminal devices can also be used as the nonlinear elements 51.

Figure 4A:
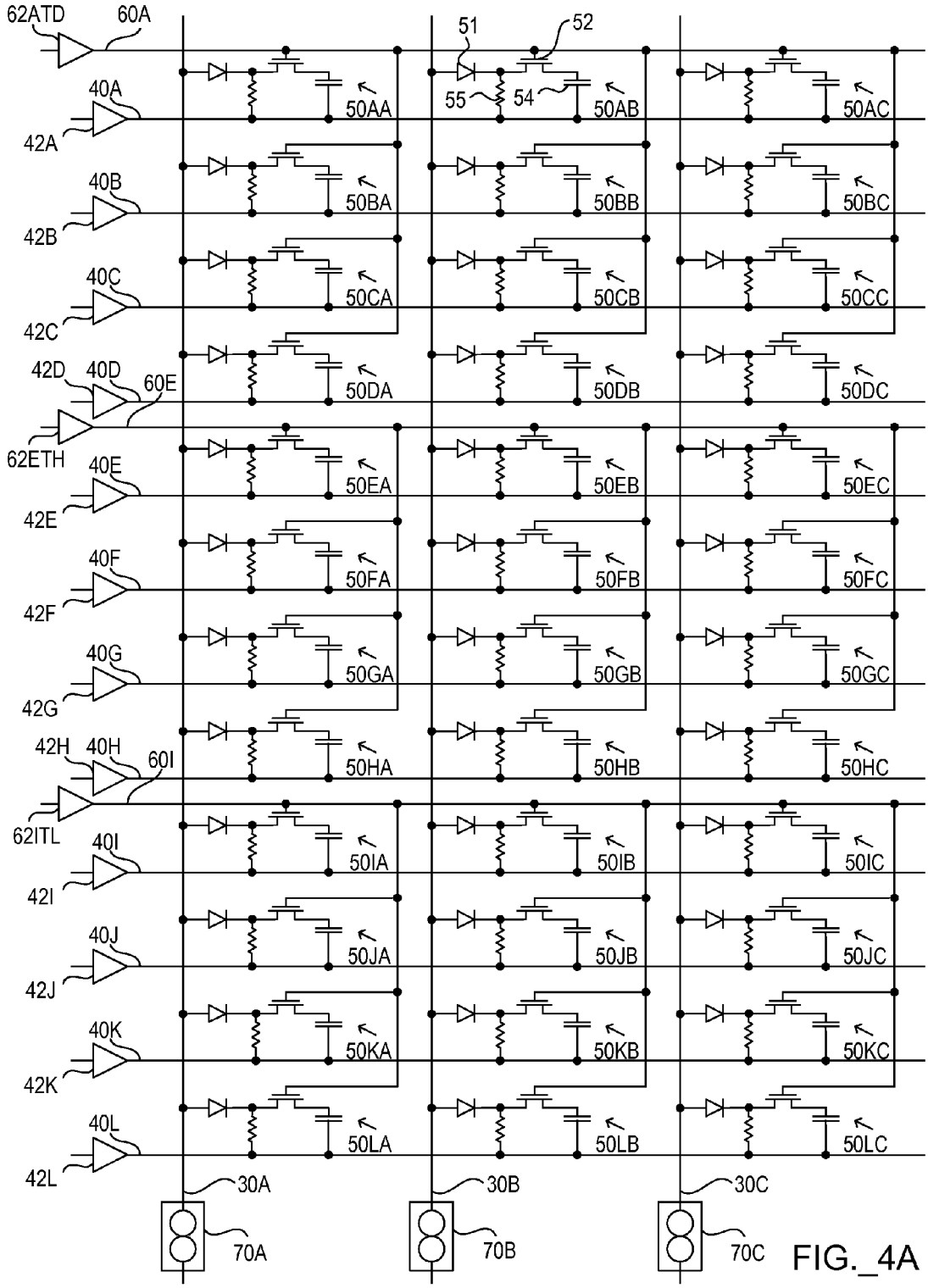
FIGS. 4A-4B are implementations of active matrix displays in which the capacitive element in a pixel element has a terminal connected to a row conducting line that is also connected to the resistive element.
Figure 4B:
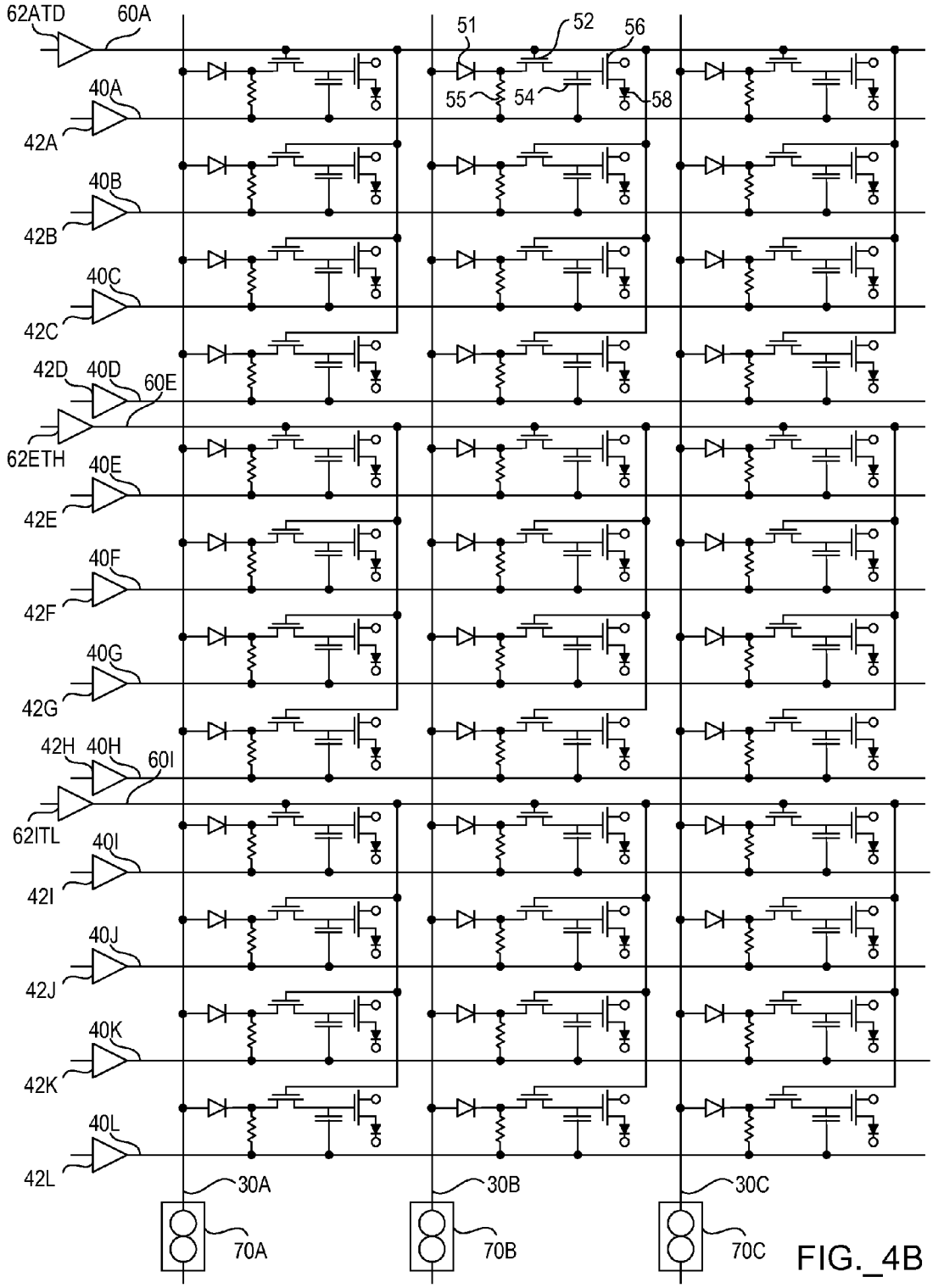

FIGS. 4A-4B are implementations of active matrix displays in which the capacitive element in a pixel element has a terminal connected to a row conducting line that is also connected to the resistive element. For example, in the pixel element 50AB, the capacitive element 54 has a first terminal electrically connected to the column conducting line 30B through both a semiconductor channel of the switching transistor 52 and the nonlinear element 51. The capacitive element 54 has a second terminal electrically connected to the row conducting line 40A that is also connected to the first terminal of the resistive element 55.

In operation, during sub-time-periods T1, the switching transistor 52 in the pixel element 50AB is in the conducting state because the first group of multiple rows of pixel elements (including pixel elements 50AA-50AC, 50BA-50BC, 50CA-50CC, and SODA-50DC) are the enabled pixel elements. During sub-time-periods T1(1), the nonlinear elements 51 in pixel elements 50AA-50AC are also in the conducting state because pixel elements 50AA-50AC are the selected pixel elements and the nonlinear element 51 in the selected pixel elements is forward biased.

During sub-time-periods T1(1), when the data driver 70B applies a predetermined current $I_d$(AB) to the column conducting line 30B, the voltage across the capacitive element 54 in the pixel element 50AB will be of the value $R_0I_d$(AB), if it is assumed that the total leakage current by other nonlinear elements that are connected to the column conducting line 30B can be reasonably neglected. The voltage across the capacitive element 54 in the pixel element 50AB can be charged to the value $R_0I_d$(AB) even there are voltage drops on the row conducting line 40A. This voltage across the capacitive element 54 in the pixel element 50AB can be determined by the predetermined current $I_d$(AB) that is applied to the column conducting line 30B from the data driver 70B.

Similarly, during sub-time-periods T1(1), when the data driver 70A applies a predetermined current $I_d$(AA) to the column conducting line 30A, the voltage across the capacitive element 54 in the pixel element 50AA can be charged to a predetermined value $R_0I_d$(AA). When the data driver 70C applies a predetermined current $I_d$(AC) to the column conducting line 30C, the voltage across the capacitive element 54 in the pixel element 50AC can be charged to a predetermined value $R_0I_d$(AC).

Figure 5A:
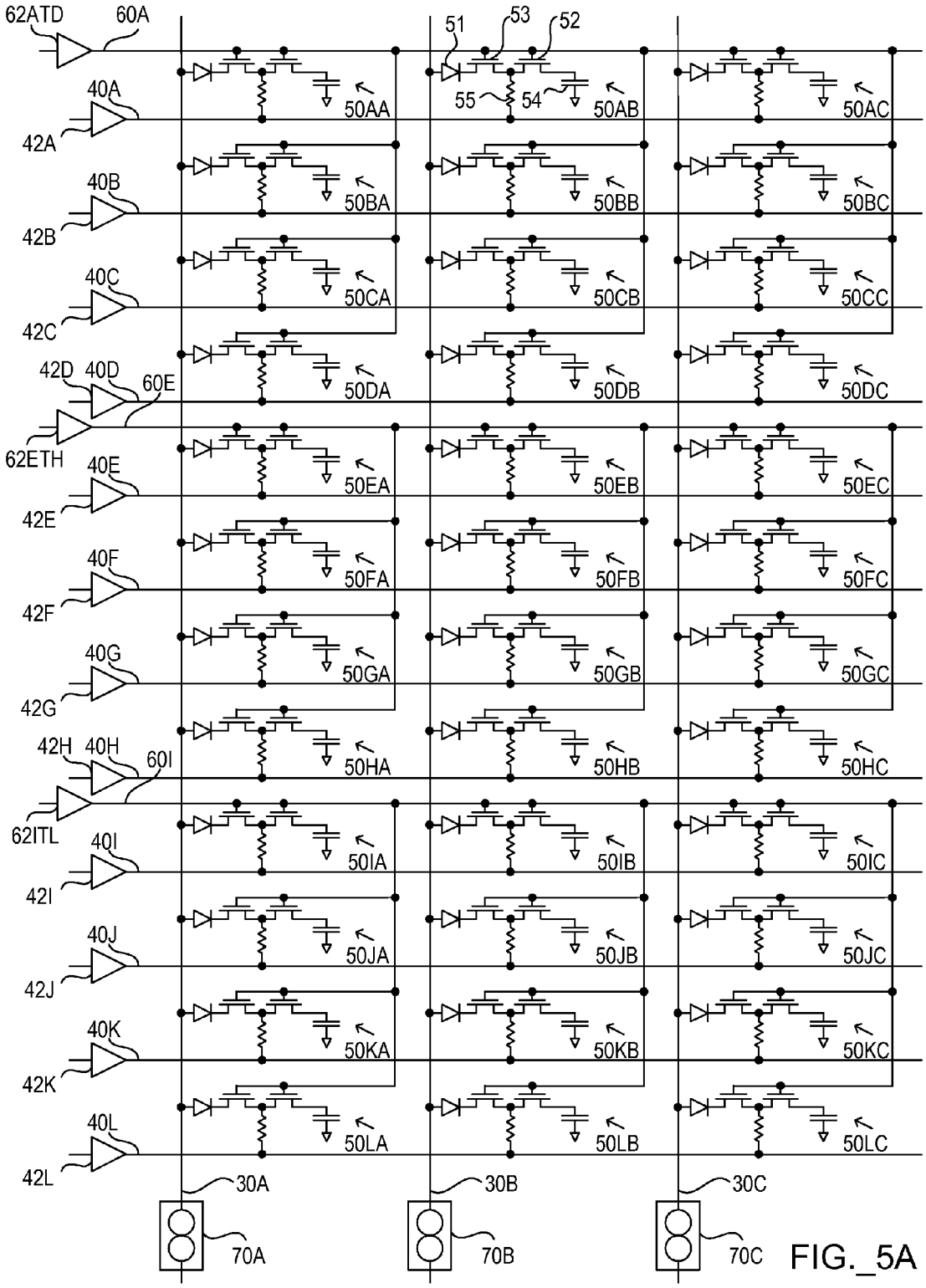
FIGS. 5A-5B and FIGS. 6A-6B are implementations of active matrix displays in which the capacitive element is electrically connected to a column conducting line through the semiconductor channel of a switching transistor, the semiconductor channel of a secondary switching transistor, and a nonlinear element.
Figure 5B:
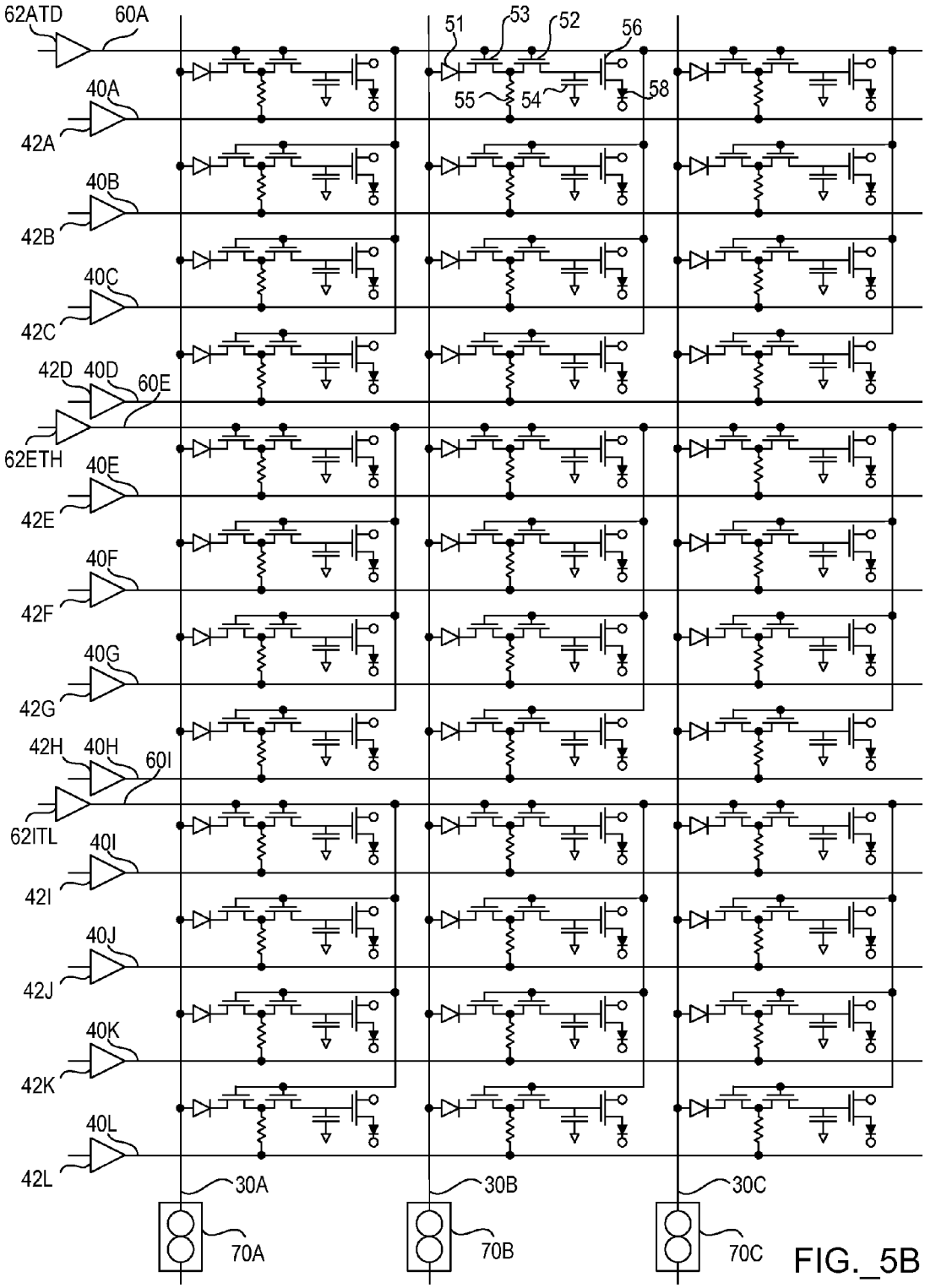
Figure 6A:
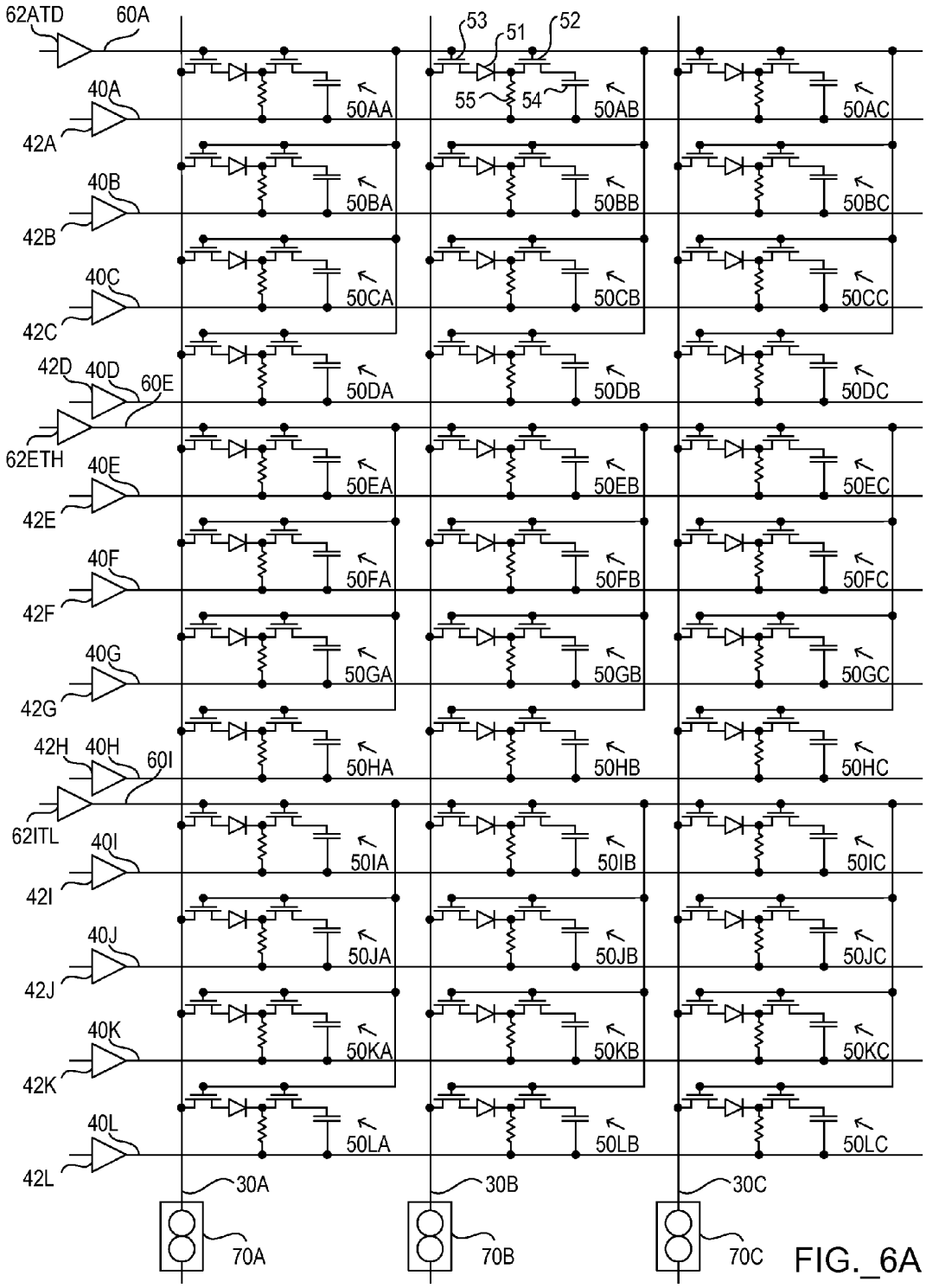
Figure 6B:
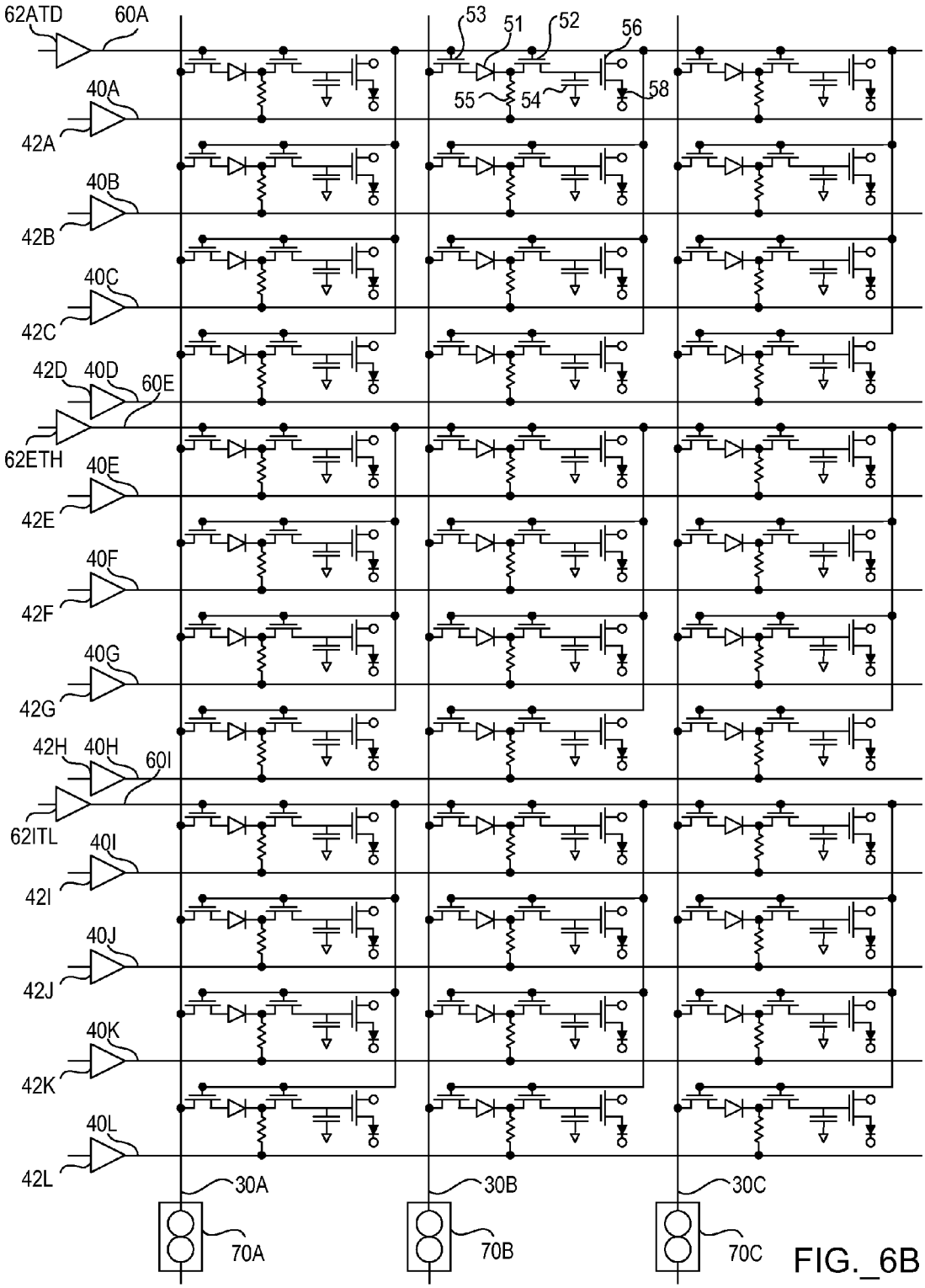

FIGS. 5A-5B and FIGS. 6A-6B are implementations of active matrix displays in which the capacitive element is electrically connected to a column conducting line through the semiconductor channel of a switching transistor, the semiconductor channel of a secondary switching transistor, and a nonlinear element. For example, in addition to the switching transistor 52, the pixel element 50AB also includes a secondary switching transistor 53. The secondary switching transistor 53 has a gate electrically connected to the enabling line 60A. The capacitive element 54 has a first terminal electrically connected to the second terminal of the resistive element 55 through a semiconductor channel of the switching transistor 52. The second terminal of the resistive element 55 is electrically connected to the column conducting line 30B through both a semiconductor channel of the secondary switching transistor 53 and the nonlinear element 51. The first terminal of the resistive element 55 is electrically connected to the row conducting line 40A. In FIG. 6A-FIG. 6B, the second terminal of the capacitive element 54 is also electrically connected to the row conducting line 40A. In FIGS. 5A-5B, in contrast, the second terminal of the capacitive element 54 is electrically connected to a common voltage. In still other implementations, the second terminal of the capacitive element 54 can be electrically connected to a row conducting line that is different from the row conducting line 40A.

In the implementations as shown in FIGS. 5A-5B and FIGS. 6A-6B, the gate of the secondary switching transistor 53 and the gate of the switching transistor 52 are connected to a same enabling line 60A. In other implementations, the gate of the secondary switching transistor 53 and the gate of the switching transistor 52 can be connected to different enabling lines.

In operation, during the first predetermined time period T1, when an enabling signal is applied to the enabling line 60A, the first group of multiple rows of pixel elements (including pixel elements 50AA-50AC, 50BA-50BC, 50CA-50CC, and 50DA-50DC) are enabled as the enabled pixel elements, and the switching transistors 52 and the secondary switching transistors 53 in these enabled pixel elements are in the conducting state. During sub-time-periods T1(1), a selection voltage $V_{on}$ is applied to the row conducting line 40A to drive the nonlinear element 51 in pixel elements 50AA-50AC into the conducting state.

During sub-time-periods T1(1), when the data driver 70B applies a predetermined current $I_d$(AB) to the column conducting line 30B, only the leakage currents by the nonlinear elements in the enabled pixel elements 50BB, 50CB, and 50DB can influence the current passing through the nonlinear element 51 in the selected pixel element 50AB, because the non-enabled pixel elements are essentially isolated from the column conducting line 30B by the secondary switching transistors 53 in the non-enabled pixel elements. If the total leakage current by the nonlinear elements in the enabled pixel elements 50BB, 50CB, and 50DB can be reasonably neglected, the predetermined current $I_d$(AB) as supplied by the data driver 70B will essentially all pass through the nonlinear element 51 in the pixel element 50AB.

In FIGS. 5A-5B, during sub-time-periods T1(1), when the data driver 70B applies a predetermined current $I_d$(AB) to the column conducting line 30B, a voltage of the value $V_{on}+R_0I_d$(AB) can be applied to the first terminal of the capacitive element 54 in the pixel element 50AB. Similarly, when the data driver 70B applies a predetermined current $I_d$(AA) to the column conducting line 30A, a voltage of the value $V_{on}+R_0I_d$(AA) can be applied to the first terminal of the capacitive element 54 in the pixel element 50AA. When the data driver 70C applies a predetermined current $I_d$(AC) to the column conducting line 30C, a voltage of the value $V_{on}+R_0I_d$(AC) can be applied to the first terminal of the capacitive element 54 in the pixel element 50AC. In the above, it is assumed that the voltage drops on the row conducting lines can be neglected and the leakage currents by the nonlinear elements in the enabled pixel elements can be neglected.

In FIGS. 6A-6B, during sub-time-periods T1(1), when the data driver 70B applies a predetermined current $I_d$(AB) to the column conducting line 30B, a voltage of the value $R_0I_d$(AB) can be applied across the capacitive element 54 in the pixel element 50AB. Similarly, when the data driver 70A applies a predetermined current $I_d$(AA) to the column conducting line 30A, a voltage of the value $R_0I_d$(AA) can be applied across the capacitive element 54 in the pixel element 50AA. When the data driver 70C applies a predetermined current $I_d$(AC) to the column conducting line 30C, a voltage of the value $R_0I_d$(AC) can be applied across the capacitive element 54 in the pixel element 50AC. In the above, it is assumed that the leakage currents by the nonlinear elements in the enabled pixel elements can be neglected.

Figure 7A:
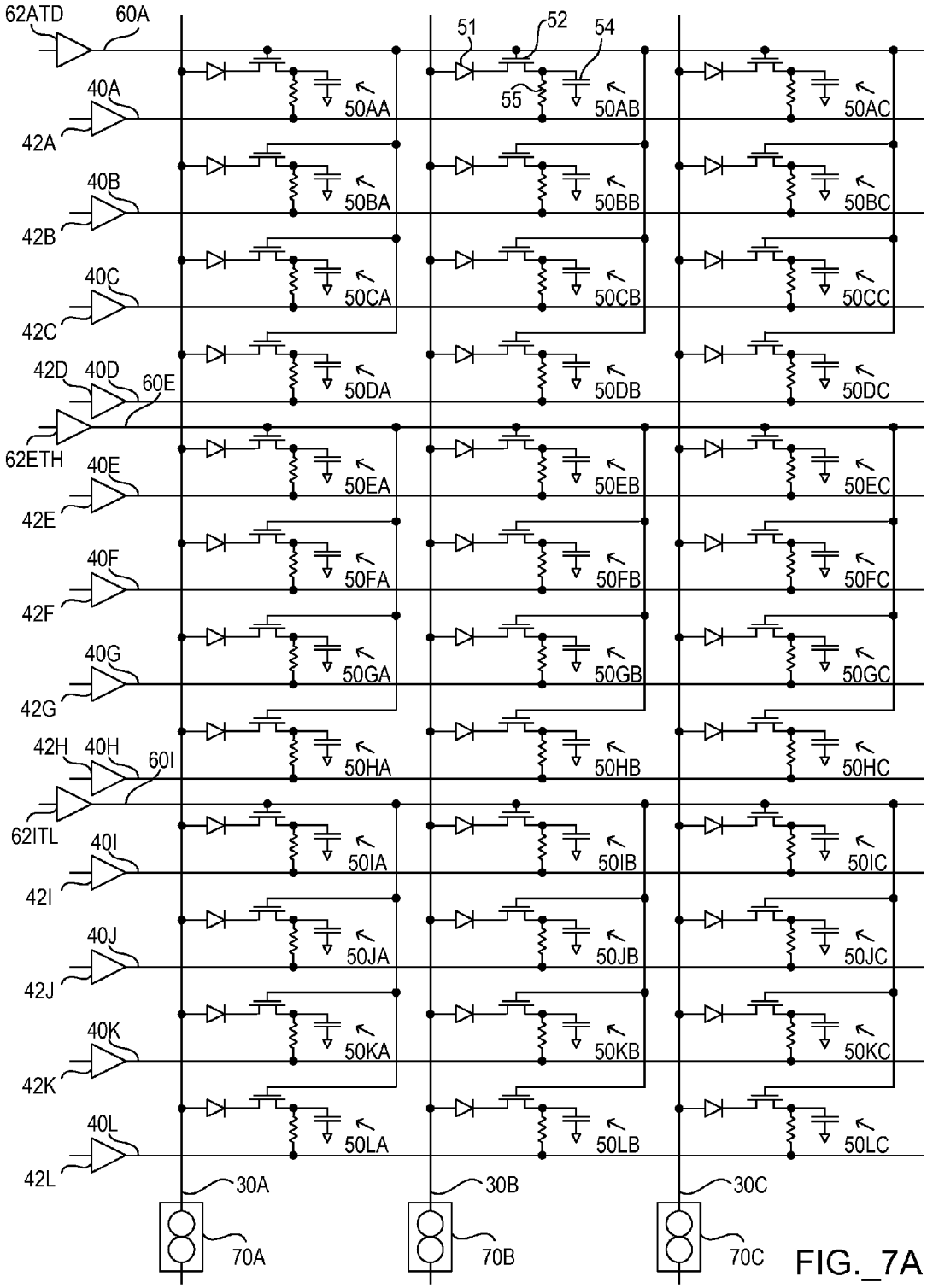
FIGS. 7A-7B are implementations of active matrix displays in which the first terminal of the capacitive element is electrically connected to the second terminal of resistive element.
Figure 7B:
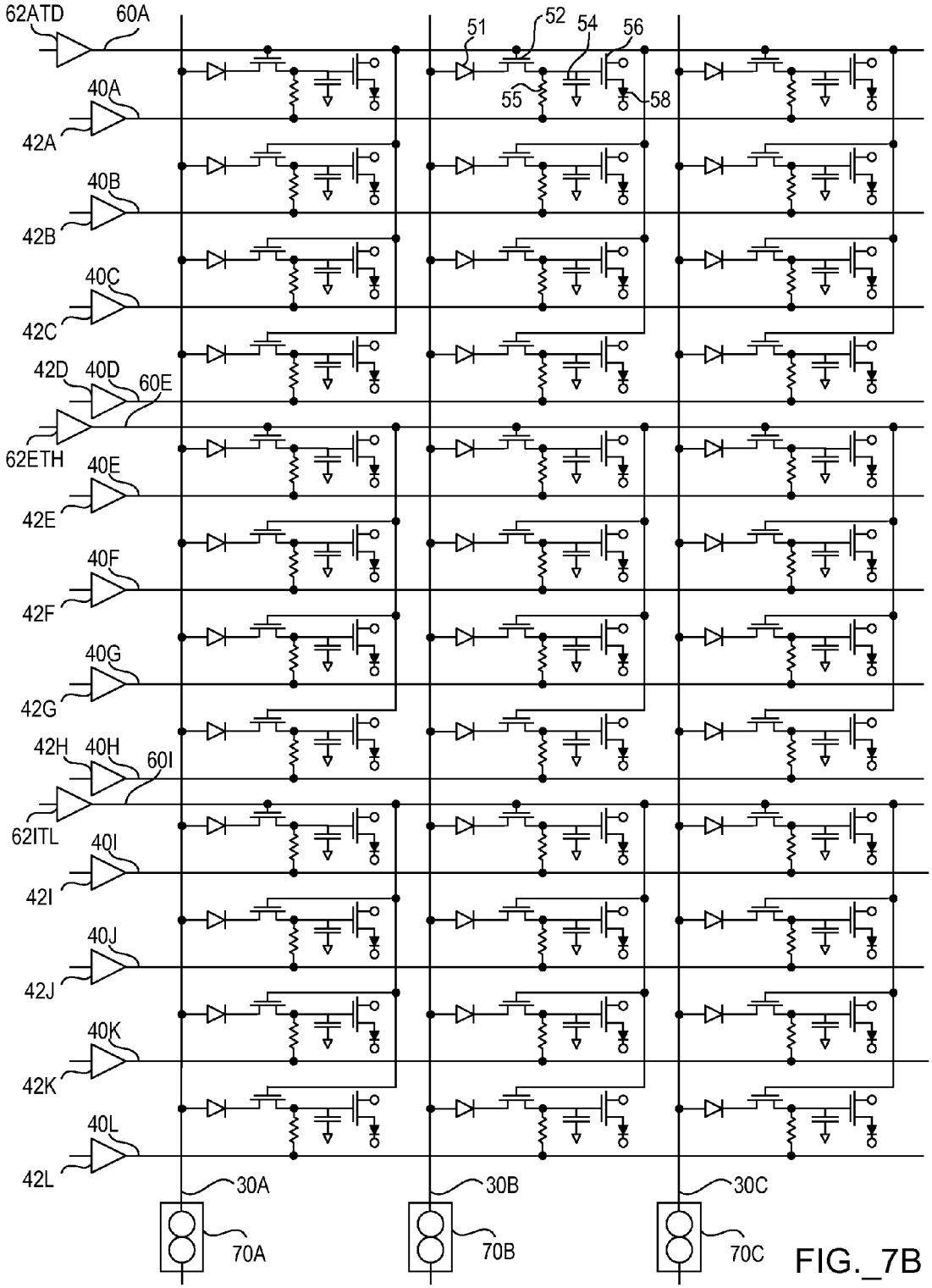

FIGS. 7A-7B are implementations of active matrix displays in which the first terminal of the capacitive element is electrically connected to the second terminal of resistive element. In FIGS. 7A-7B, the second terminal of the capacitive element 54 is electrically connected to a common voltage. In other implementations, the second terminal of the capacitive element 54 can be electrically connected to a row conducting line. This row conducting line can be the same row conducting line that is connected to the first terminal of the resistive element 55. This row conducting line can be a different row conducting line.

Figure 8A:
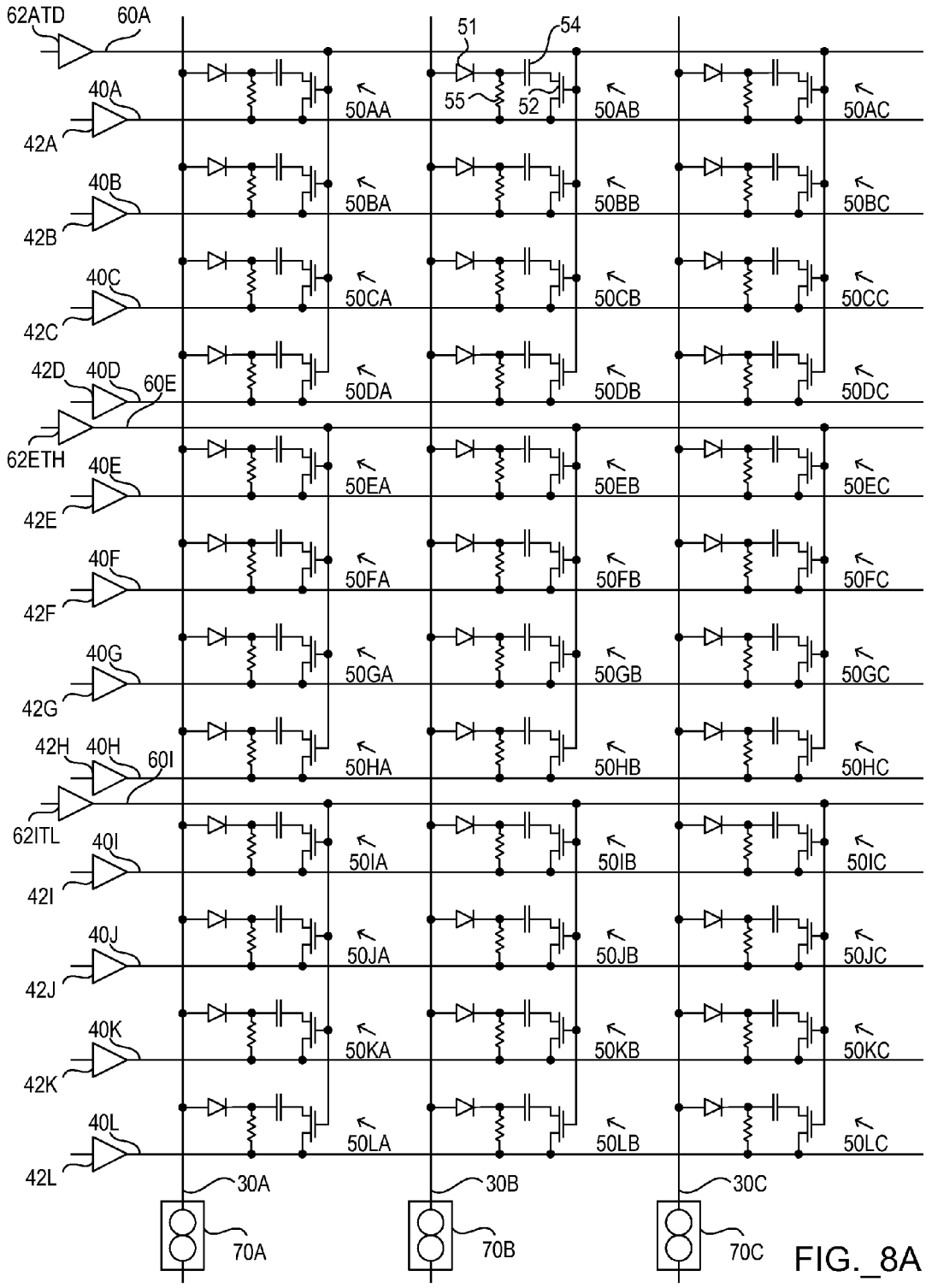
FIGS. 8A-8B are implementations of active matrix displays in which the second terminal of the capacitive element is electrically connected to the semiconductor channel of the switching transistor.
Figure 8B:
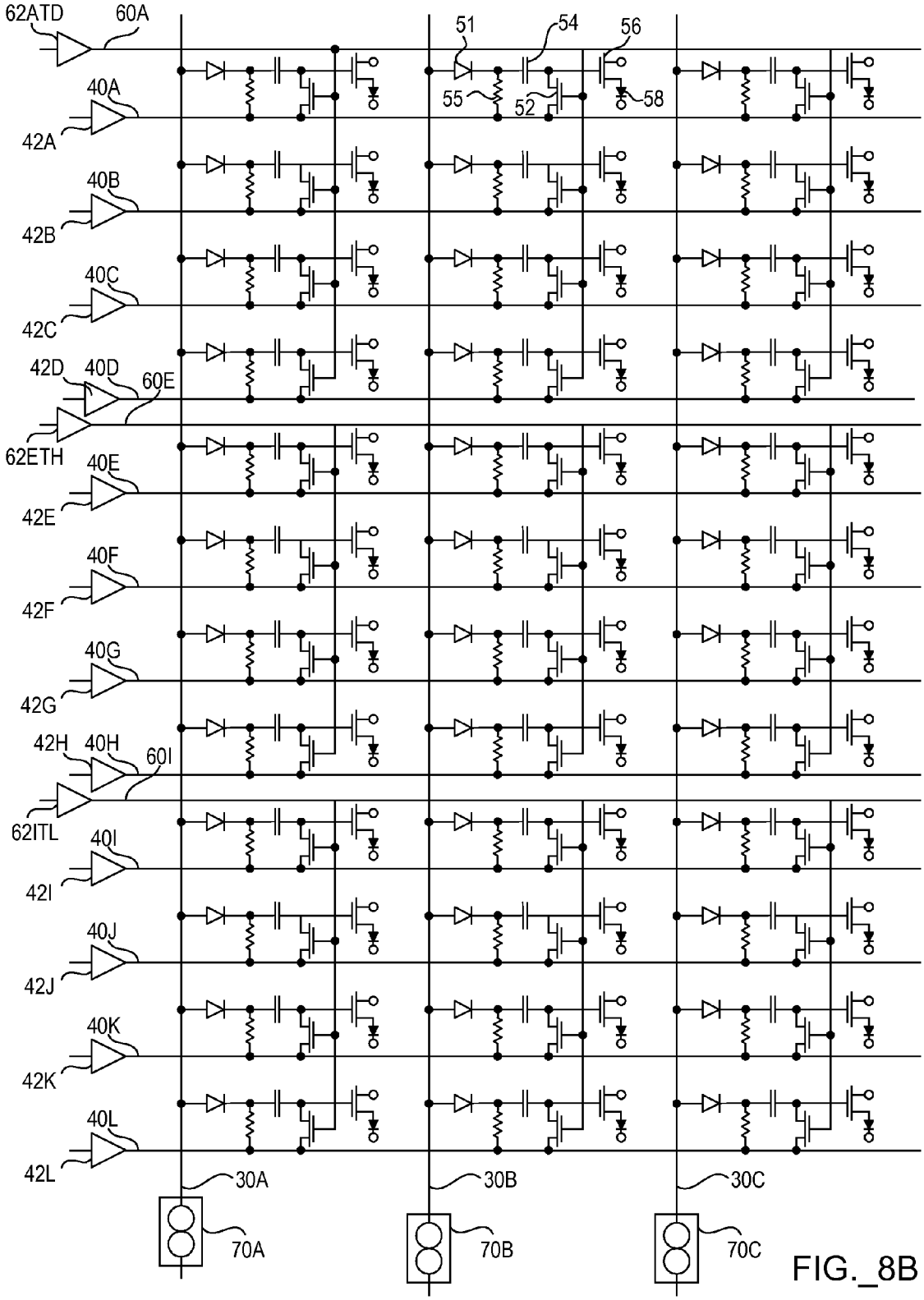

FIGS. 8A-8B are implementations of active matrix displays in which the second terminal of the capacitive element is electrically connected to the semiconductor channel of the switching transistor. For example, in the pixel element 50AB, the second terminal of the capacitive element 54 is electrically connected to the row conducting line 40A through the semiconductor channel of the switching transistor 52. In operation, the capacitive element 54 in a pixel element can be charged when that pixel element is both an enabled pixel element and a selected pixel element. For example, when the pixel element 50AB is an enabled pixel element, the switching transistor 52 in the pixel element 50AB is in a conducting state. When the pixel element 50AB is also a selected pixel element, the nonlinear element 51 in the pixel element 50AB is also in a conducting state. If a predetermined current $I_d$(AB) passes through both the nonlinear element 51 and the resistive element 55 and if a selection voltage $V_{on}$ is applied to the first terminal of the resistive element 55, then, the voltage at the second terminal of the resistive element 55 can become $V_{on}+R_0I_d$(AB). After the capacitive element 54 is charged to the voltage of the value $R_0I_d$(AB), if a deselect voltage $V_{off}$ is applied to the first terminal of the resistive element 55 in the pixel element 50AB to drive the nonlinear element 51 into a non-conducting state and if the pixel element 50AB also becomes a non-enabled pixel element such that the switching transistor 52 is also changed into a non-conducting state, then, the voltage across the capacitive element 54 can be maintained at $R_0I_d$(AB). In addition, the voltage at the second terminal of the capacitive element 54 can be maintained at $V_{off}-R_0I_d$(AB).

Figure 9A:
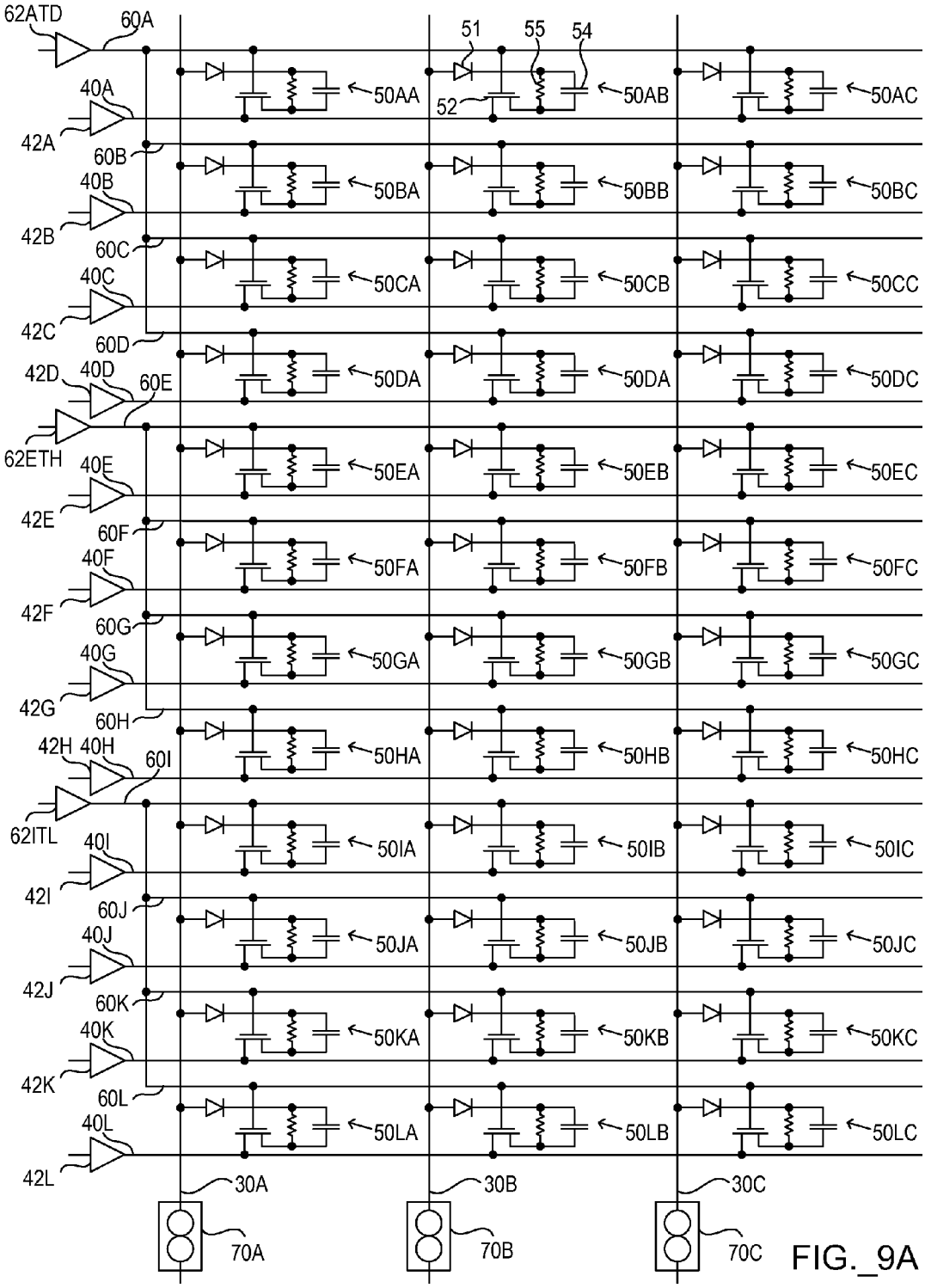
FIGS. 9A-9B are implementations of active matrix displays in which the second terminal of the capacitive element is electrically connected to the semiconductor channel of the switching transistor and the first terminal of the resistive element is electrically connected to the row conducting line through the semiconductor channel of the switching transistor.
Figure 9B:
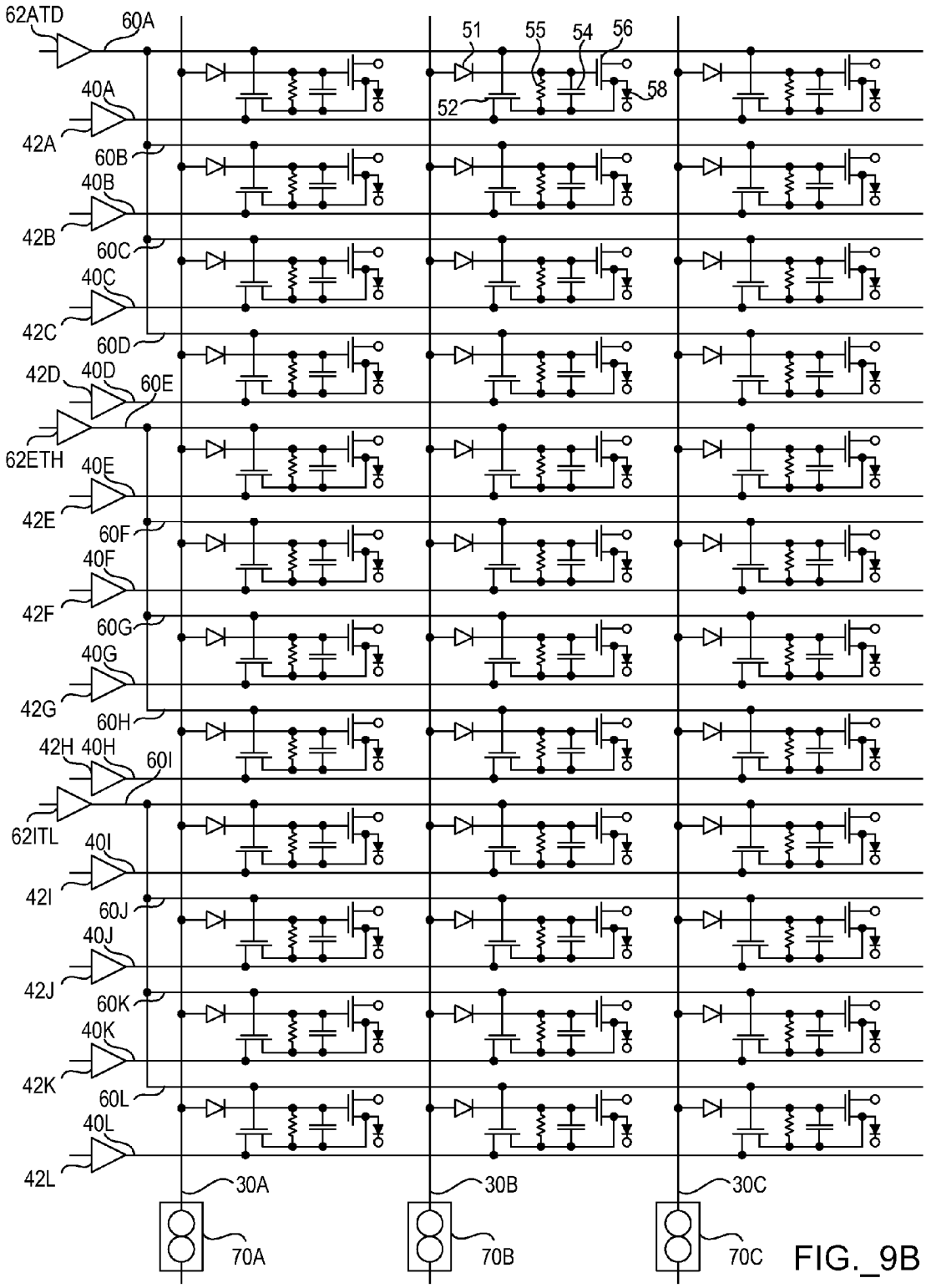

FIGS. 9A-9B are implementations of active matrix displays in which the second terminal of the capacitive element is electrically connected to the semiconductor channel of the switching transistor and the first terminal of the resistive element is electrically connected to the row conducting line through the semiconductor channel of the switching transistor. For example, in the pixel element 50AB, the second terminal of the capacitive element 54 is electrically connected to the semiconductor channel of the switching transistor 52. The first terminal of the resistive element 55 is electrically connected to the row conducting line 40A through the semiconductor channel of the switching transistor 52. In operation, the capacitive element 54 in a pixel element can be charged when that pixel element is both an enabled pixel element and a selected pixel element. For example, when the pixel element 50AB is an enabled pixel element, the switching transistor 52 in the pixel element 50AB is in a conducting state. When the pixel element 50AB is also a selected pixel element, the nonlinear element 51 in the pixel element 50AB is also in a conducting state. If a predetermined current $I_d$(AB) passes through both the nonlinear element 51 and the resistive element 55, then, the capacitive element 54 can be charged to the voltage of the value $R_0I_d$(AB). This voltage across the capacitive element 54 can be maintained if the pixel element 50AB becomes a non-enabled pixel element such that the switching transistor 52 is changed into a non-conducting state.

In the previously described implementations for driving active matrix displays (e.g., as shown in FIGS. 2A-2D, 3A-3D, 4A-4B, 5A-5B, 6A-6B, 7A-7B, 8A-8B, and 9A-9B), the data driver (e.g., 70B) generally applies a predetermined current (e.g., $I_d$(AB)) to the column conducting line (e.g., 30B) for charging the capacitive element 54 in a pixel element (e.g., 50AB). In other implementations, the data driver 70B generally applies a predetermined voltage to the column conducting line (e.g., 30B) for charging the capacitive element 54 in a pixel element (e.g., 50AB). When the data driver 70B applies a predetermined voltage instead of a predetermined current, the voltage applied to the first terminal of the capacitive element 54 may depend on the voltage drop on the nonlinear element 51 in the pixel element (e.g., 50AB). In one implementation, the voltage drop on the nonlinear element 51 can be compensated by (1) measuring the characteristics of each pixel element, (2) storing the measured characteristics of each pixel element in a calibrating memory, and (3) using the characteristics of each pixel element stored in the calibrating memory to determine the correct predetermined voltage to be applied to each pixel element. The active matrix displays can include electric circuitry for compensating the voltage drop on the nonlinear element 51.

In those implementations where the data driver 70B applies a predetermined voltage to the column conducting line (e.g., 30B) for charging the capacitive element 54 in a pixel element (e.g., 50AB), if the nonlinear element 51 is a PN diode or a PIN diode, the uniformity variations of the voltage applied to the capacitive element 54 caused by uniformity variations of the nonlinear element 51 can be reduced by using a supplementary resistor serially connected to a PN diode or a PIN diode.

Figure 14A:
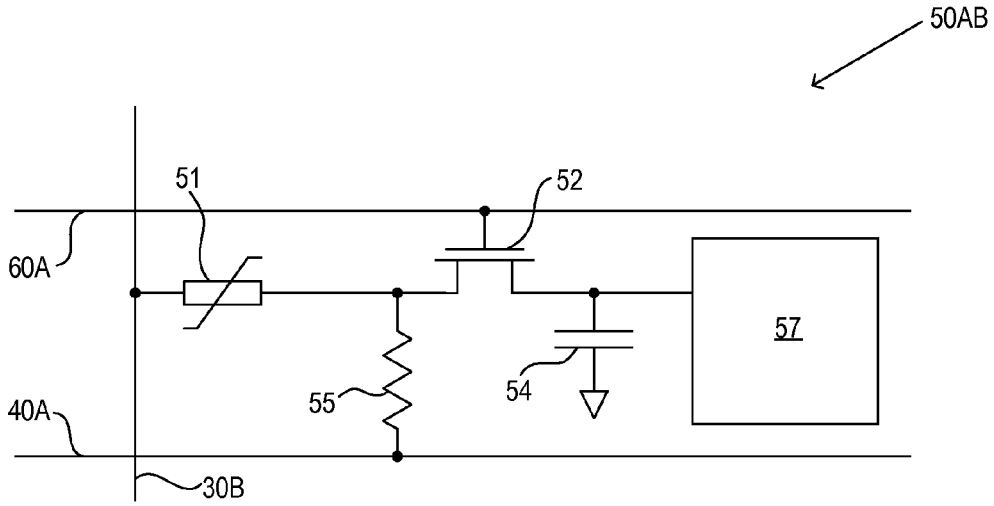
FIGS. 14A-14Q and FIGS. 15A-15D are some general implementations of the pixel elements that include one or more nonlinear elements.
Figure 14B:
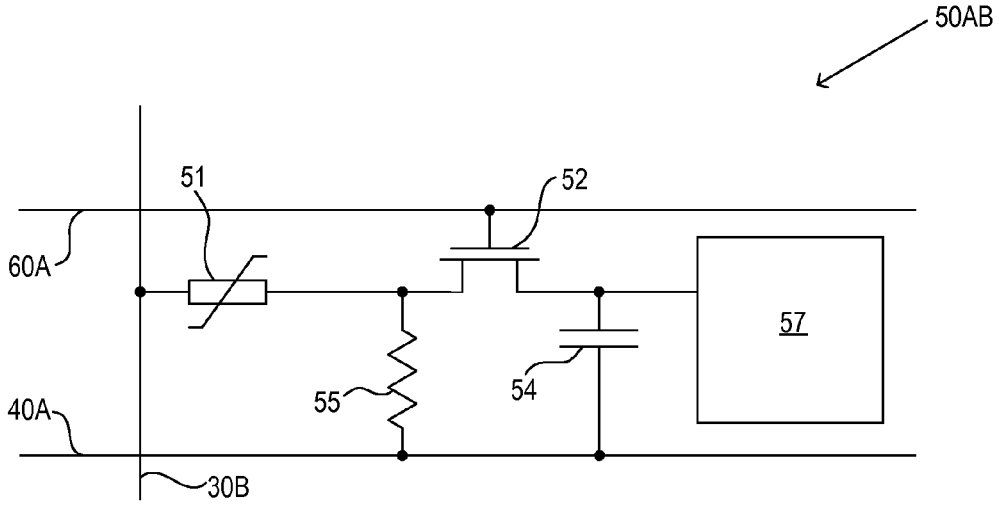
Figure 14C:
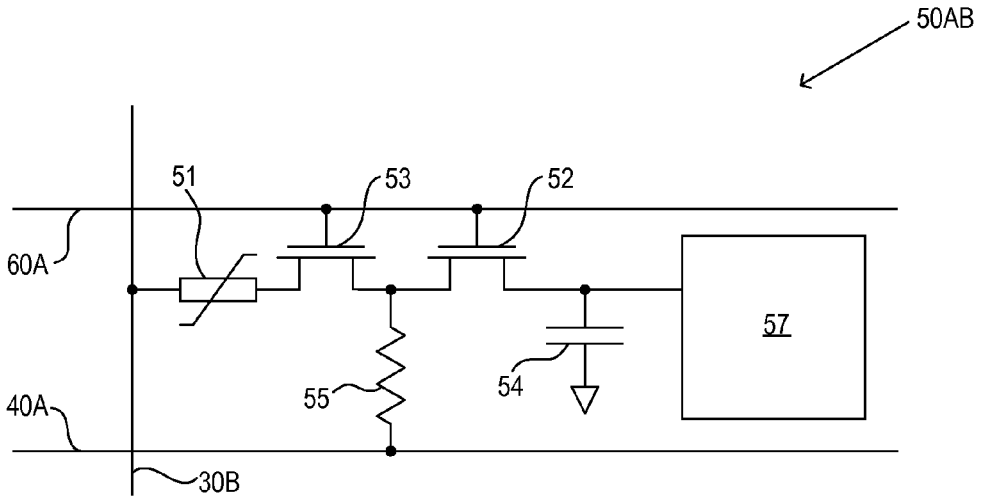
Figure 14D:
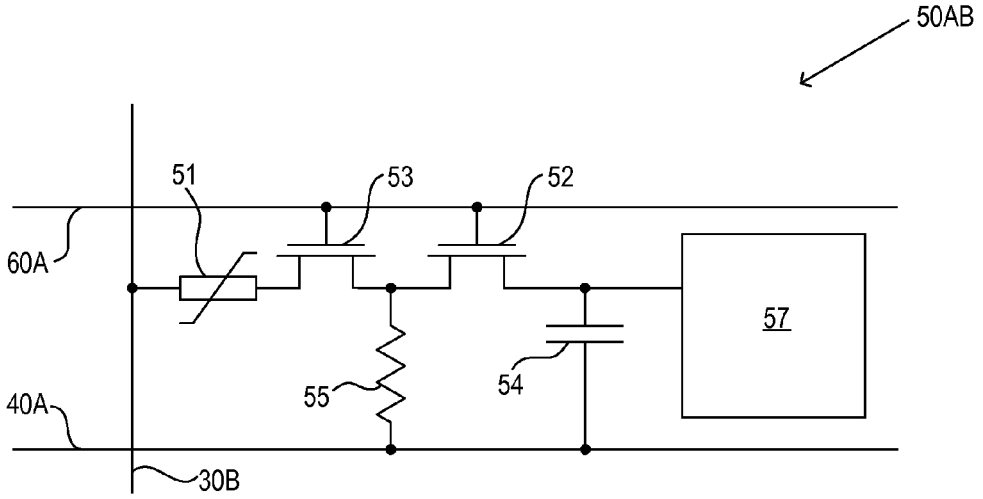
Figure 14E:
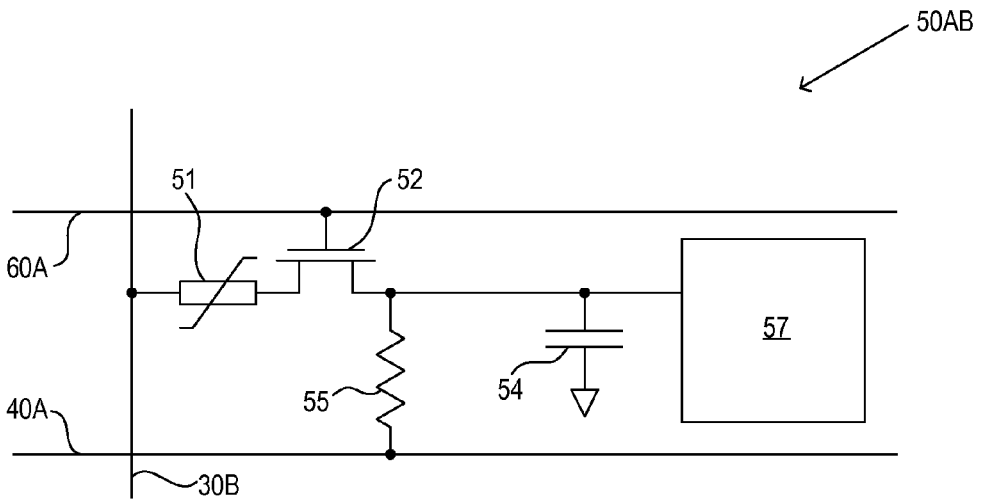
Figure 14F:
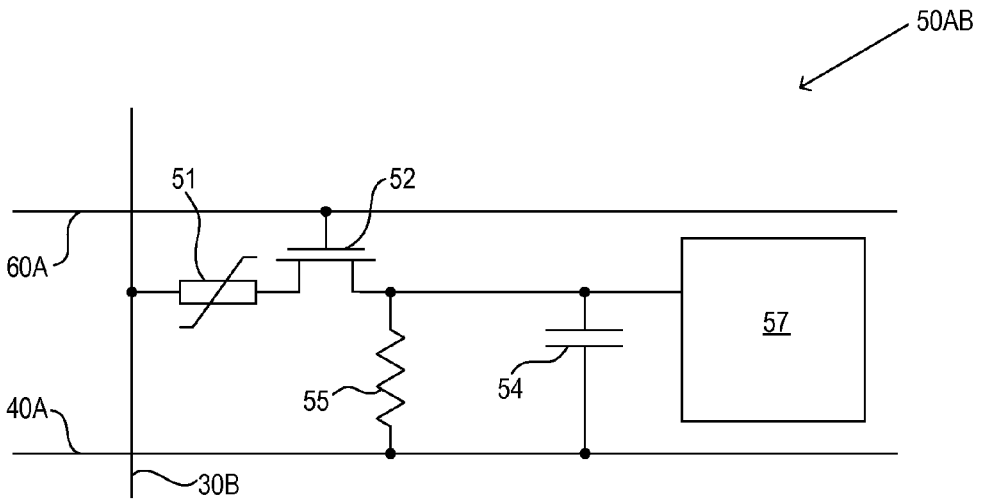
Figure 14G:
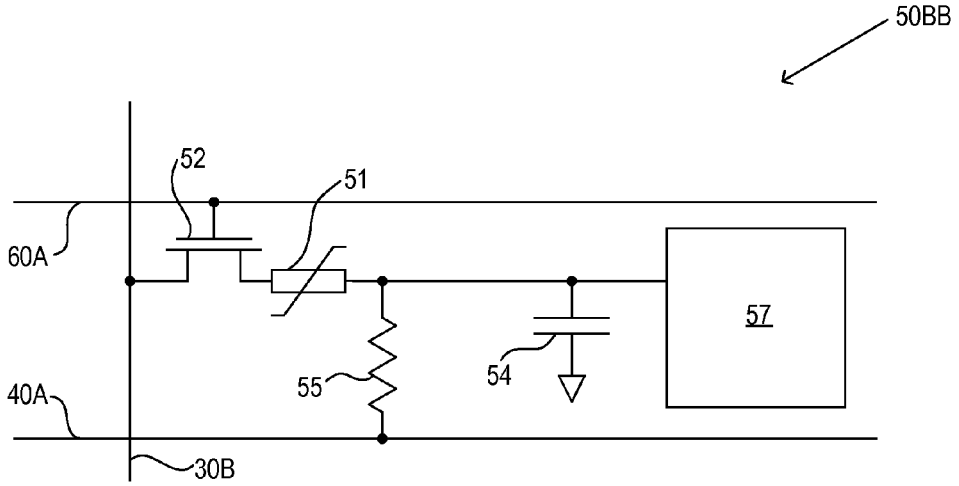
Figure 14H:
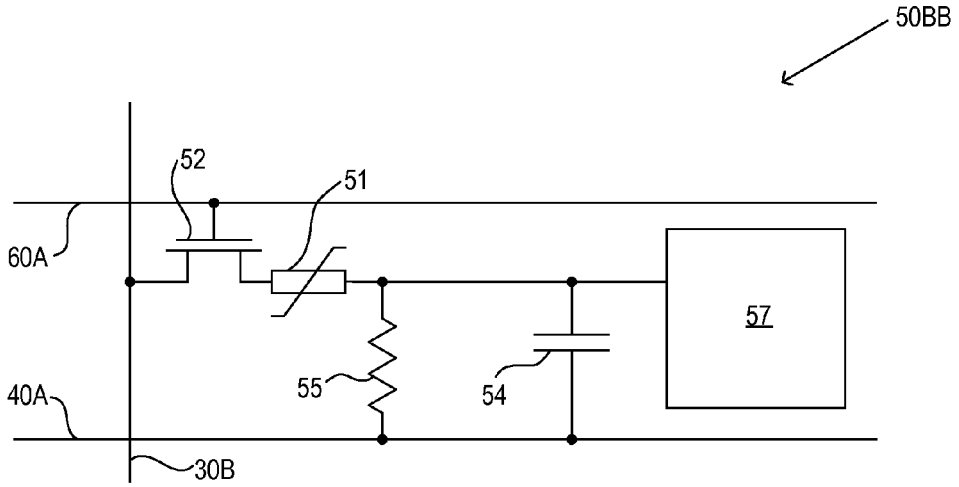
Figure 14I:
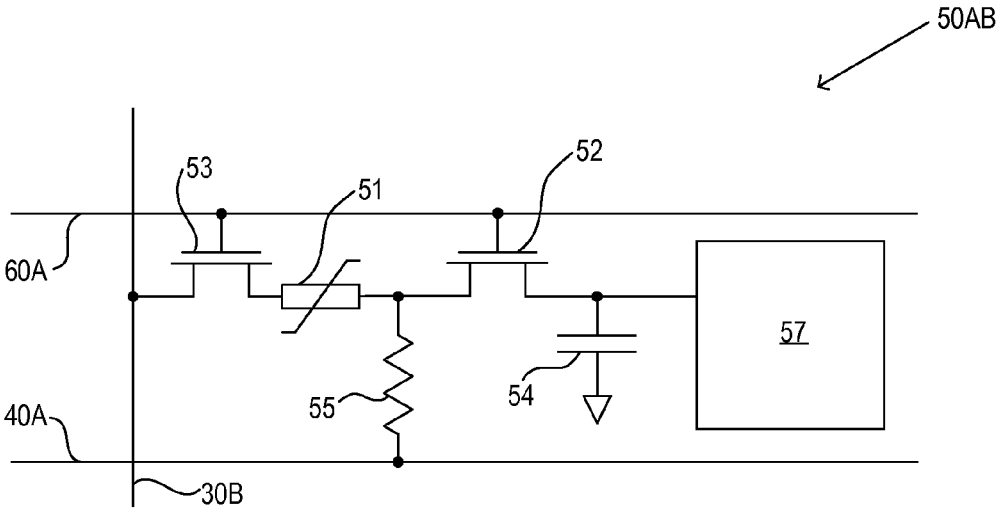
Figure 14J:
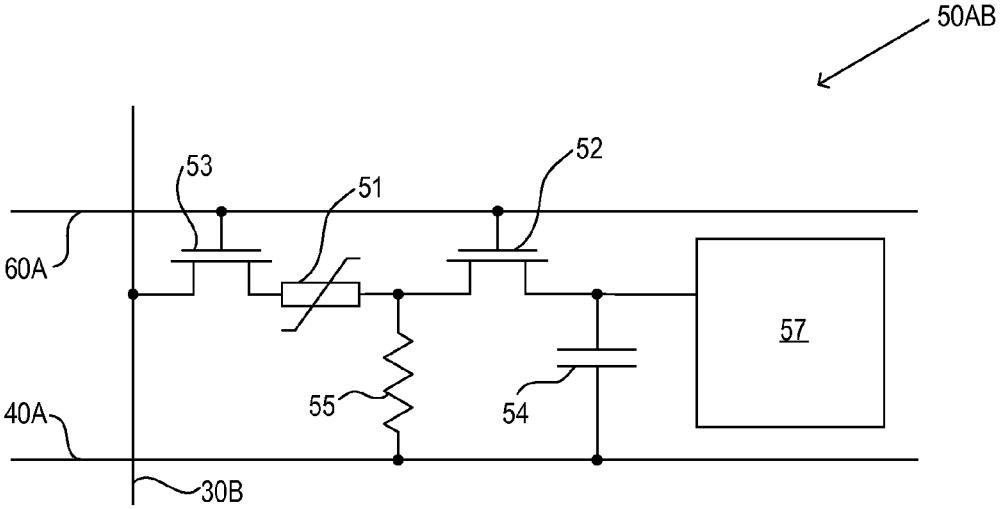
Figure 14K:
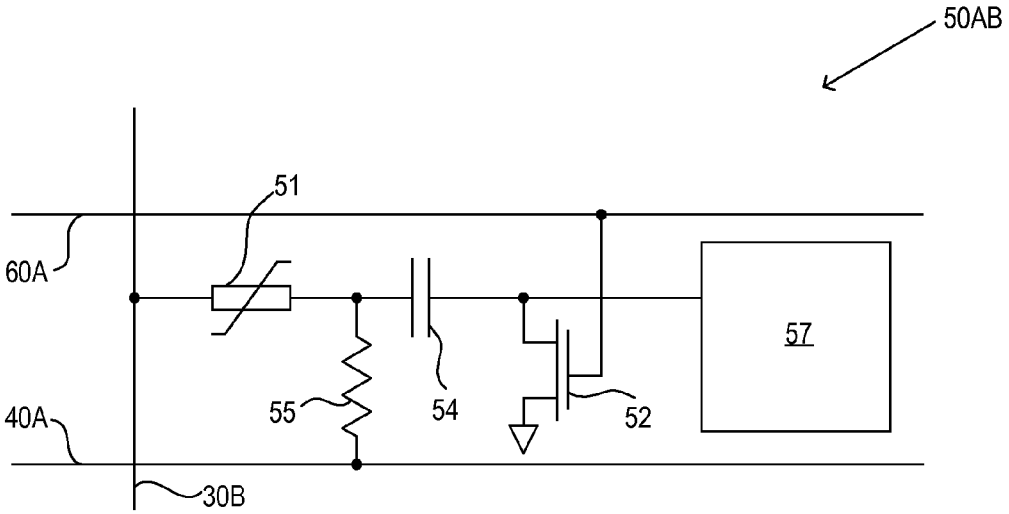
Figure 14L:
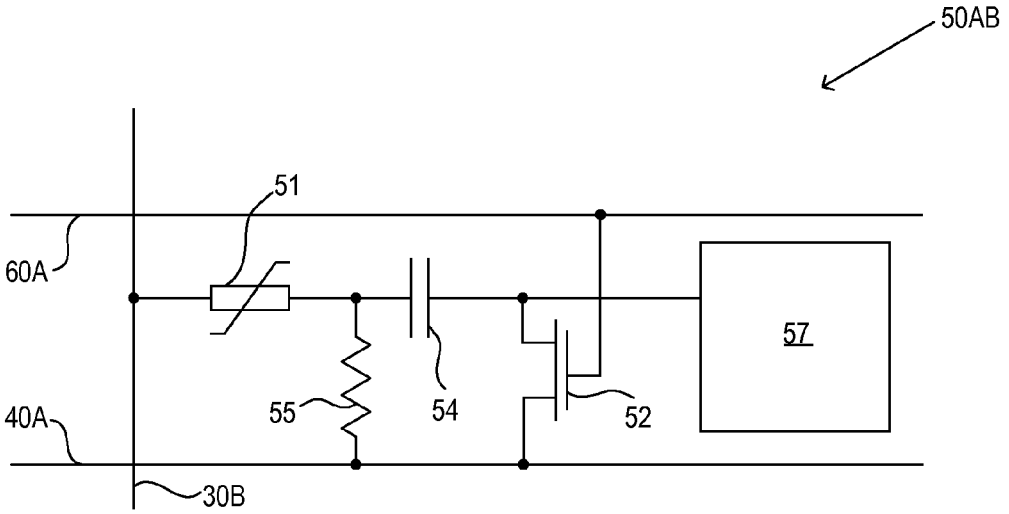
Figure 14M:
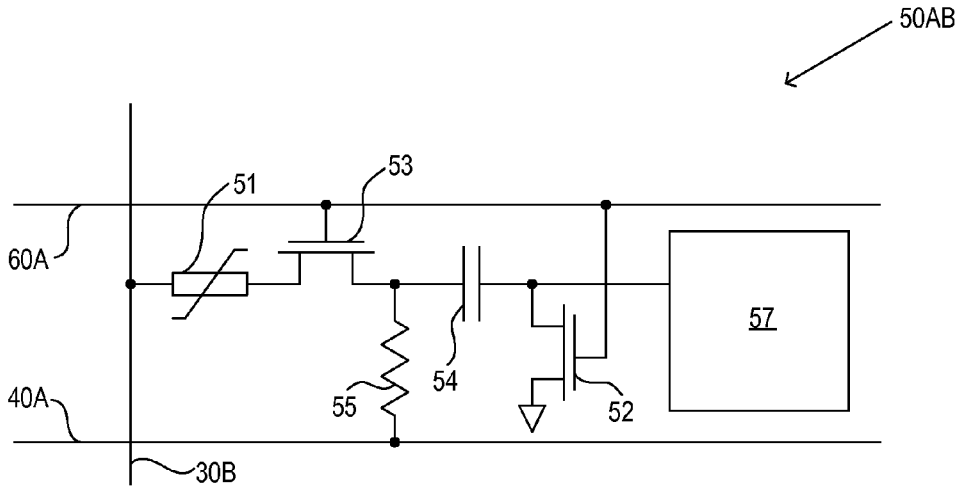
Figure 14N:
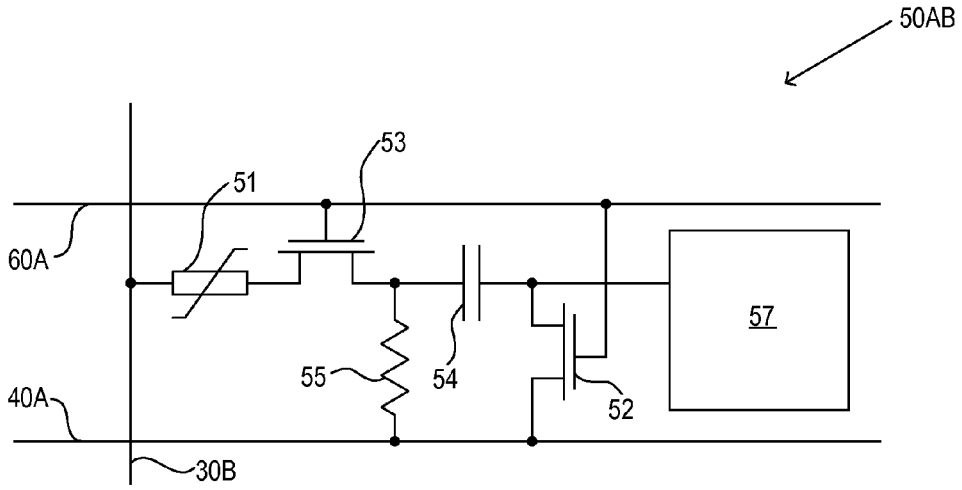
Figure 14O:
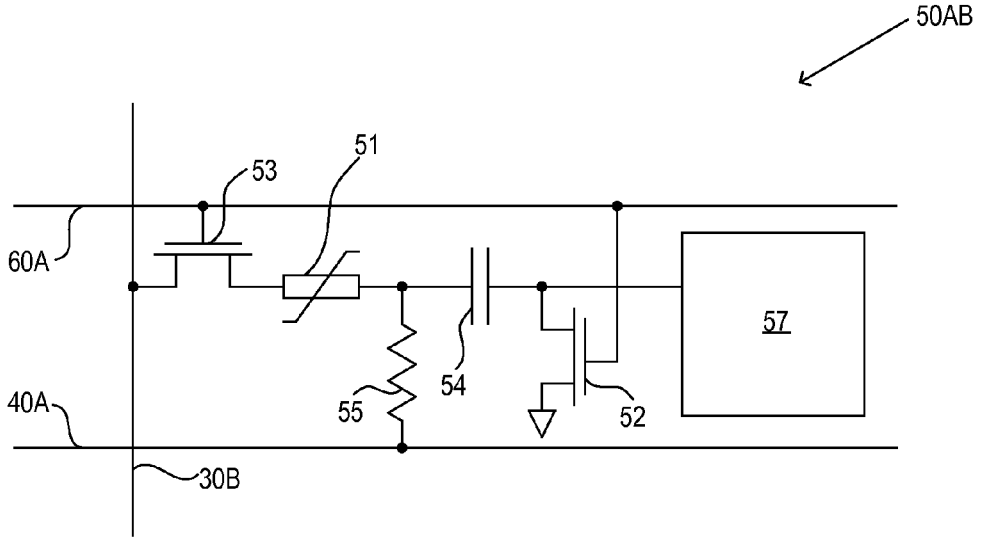
Figure 14P:
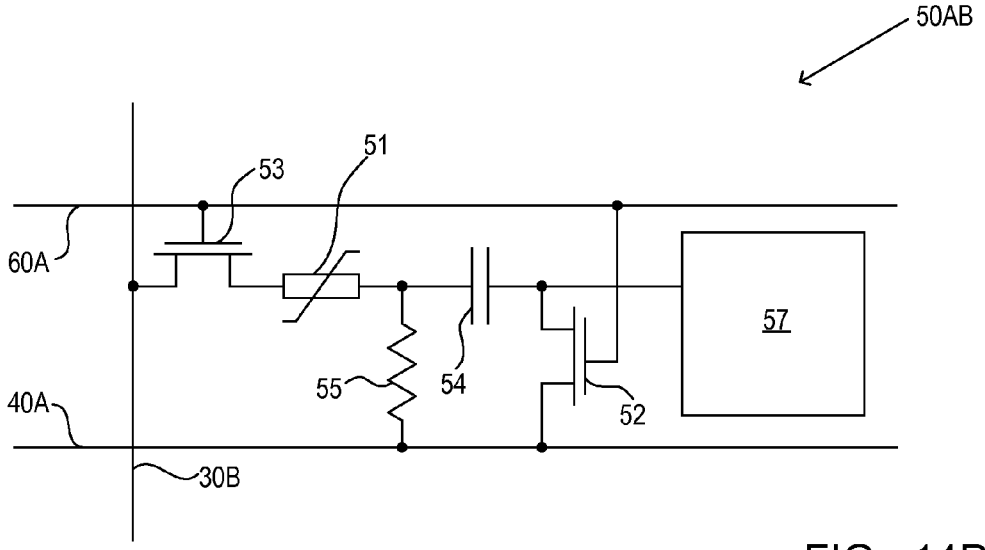
Figure 20:
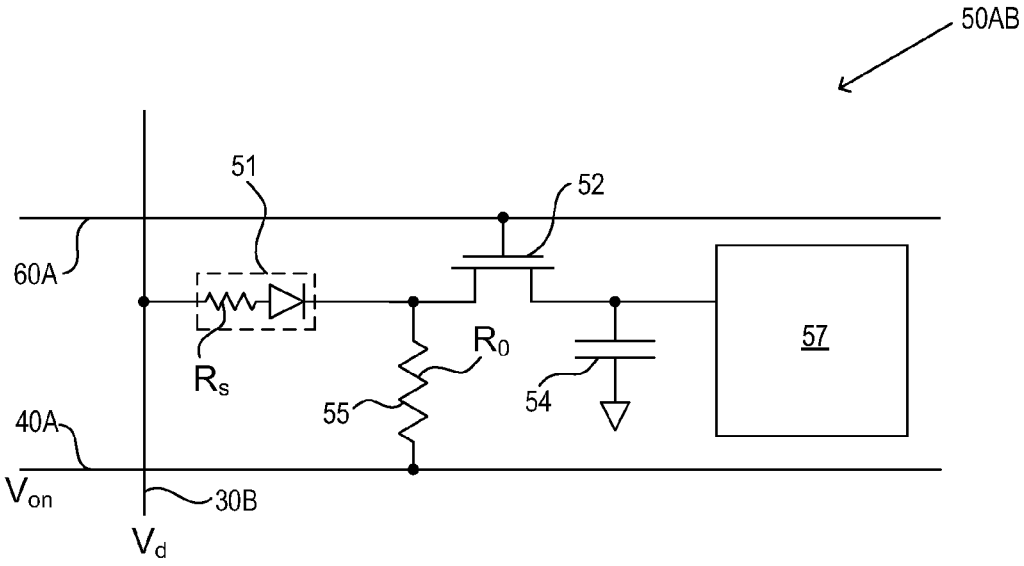
FIG. 20 shows a specific implementation of a pixel element in which the nonlinear element is implemented in the form of a supplementary resistor $R_s$ serially connected to a PN diode or a PIN diode.

As an example, FIG. 20 shows a specific implementation of the pixel element 50AB of FIG. 14A in which the nonlinear element 51 is implemented in the form of a supplementary resistor $R_s$ serially connected to a PN diode (or a PIN diode). In FIG. 20, when the nonlinear element 51 is in the conducting state, the voltage drop ΔV across the nonlinear element 51 is the sum of the voltage drop $R_sI_{FW}$ across the supplementary resistor $R_s$ and the voltage drop $V_{diode}(I_{FW})$ across the PN diode, $$\Delta V=R_sI_{FW}+V_{diode}(I_{FW}),$$

where $I_{FW}$ is the forward current passing through the PN diode and $V_{diode}(I_{FW})$ specifies the voltage-current characteristics of the PN diode. If the voltage drop $R_sI_{FW}$ across the supplementary resistor $R_s$ is sufficiently larger than the voltage drop $V_{diode}(I_{FW})$ across the PN diode, the voltage drop ΔV across the nonlinear element 51 will be given by $\Delta V \approx R_sI_{FW}$, and the uniformity variations of the voltage applied to the capacitive element 54 caused by uniformity variations of the PN diode will be reduced, when the supplementary resistor $R_s$ is manufactured with good uniformity. In addition, under the condition that the voltage drop across the resistive element 55 is much larger than the voltage drop across the nonlinear element 51, $I_{FW}$ is related to the predetermined voltage $V_d$ applied to the column conducting line 30B with the equation $I_{FW} \approx (V_d - V_{on})/R_0$, provided that the charging current supplied to the capacitive element 54 becomes sufficiently small. Under such circumstances, the voltage applied to the first terminal of the capacitive element 54 becomes $V_d - R_s(V_d - V_{on})/R_0$ approximately.

Figure 10A:
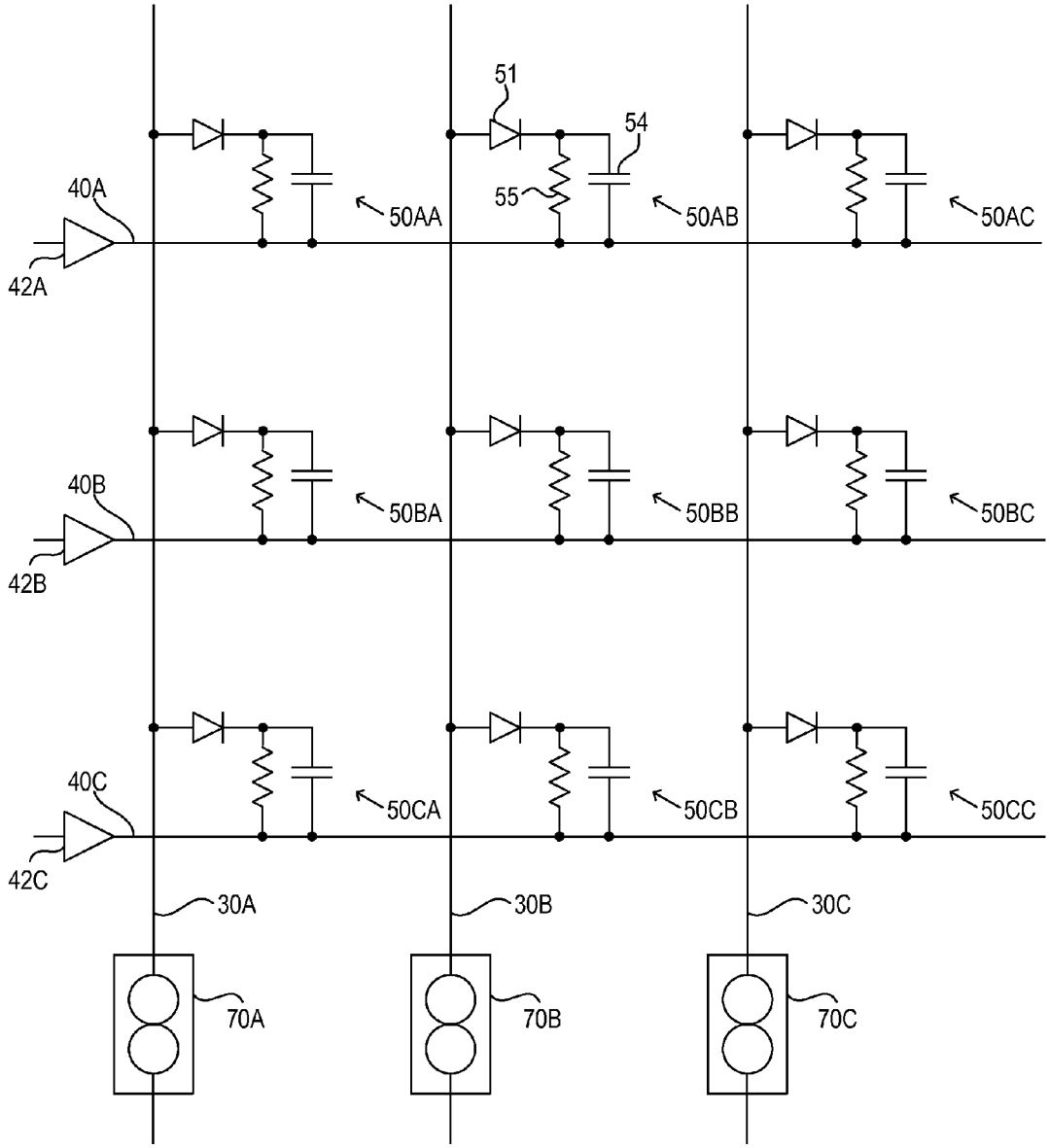
FIGS. 10A-10B are implementations of active matrix displays that have nonlinear elements in pixel elements and data drivers to provide predetermined currents to column conducting lines.
Figure 10B:
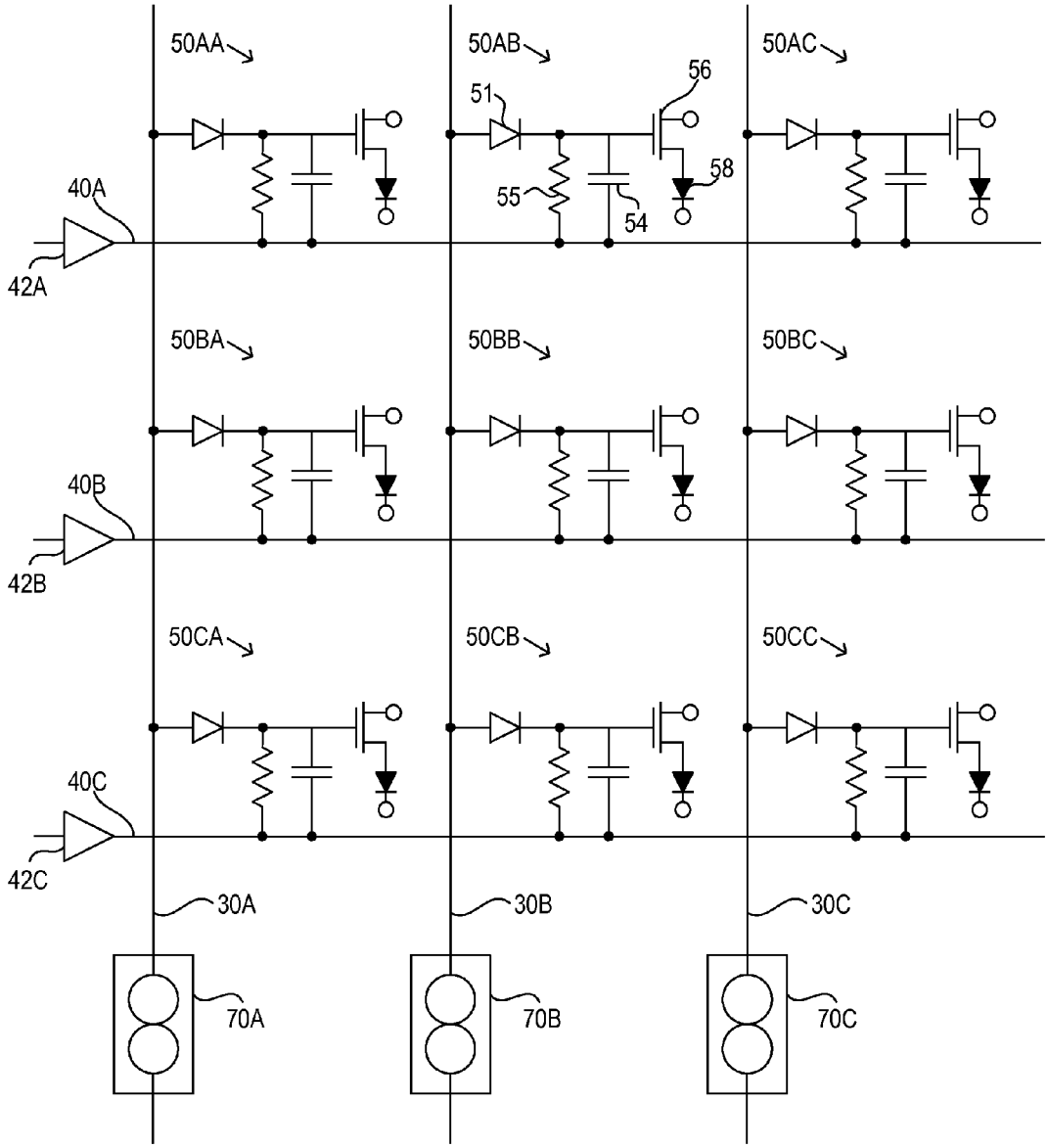

FIGS. 10A-10B are implementations of active matrix displays that have nonlinear elements in pixel elements and data drivers to provide predetermined currents to column conducting lines. In FIGS. 10A-10B, the section of the active matrix display includes a matrix of pixel elements (e.g., 50AA, 50AB, 50AC, 50BA, 50BB, 50BC, 50CA, 50CB, and 50CC), an array of column conducting lines (e.g., 30A, 30B, and 30C), an array of row conducting lines crossing the array of column conducting lines (e.g., 40A, 40B, and 40C), and a plurality of data drivers (e.g., 70A, 70B, and 70C). A pixel element (e.g., 50AB) includes a resistive element 55, a nonlinear element 51, and a capacitive element 54. The capacitive element 54 has a first terminal and a second terminal. The nonlinear element 51 has a first terminal electrically connected to a column conducting line (e.g., 30B) and has a second terminal electrically connected to the first terminal of the capacitive element 54. The resistive element 55 has a first terminal electrically connected to a row conducting line (e.g., 40A) and has a second terminal electrically connected to the first terminal of the capacitive element 54. In the implementations as shown in FIGS. 10A-10B, the second terminal of the capacitive element 54 is electrically connected to the first terminal of the resistive element 55. The data driver (e.g., 70B) can apply a predetermined current to a column conducting line (e.g., 30B). In FIGS. 10A-10B, the active matrix display also includes a plurality of selection drivers (e.g., 42A, 42B, and 42C). A selection driver (e.g., 42A) can apply a predetermined voltage to a row conducting line (e.g., 40A).

In operation, during a first predetermined time period T1, a first row of pixel elements 50AA-50AC is selected as the selected pixels for charging. During a second predetermined time period T2, a second row of pixel elements 50BA-50BC is selected for charging. During a third predetermined time period T3, a third row of pixel elements 50CA-50CC is selected for charging.

During the first predetermined time period T1, a selection voltage $V_{on}$ is applied to the row conducting line 40A to provide a forward biasing voltage for the nonlinear elements in the selected pixel elements 50AA-50AC and these nonlinear elements are driven into the conducting state. Deselect voltages are applied to the row conducting lines 40B and 40C to provide reverse biasing voltages for the nonlinear elements in the non-selected pixel elements (i.e., 50BA-50BC and 50CA-50CC) and these non-selected pixel elements are maintained at the non-conducting state. During the first predetermined time period T1, the capacitive elements 54 in the selected pixel elements 50AA, 50AB, and 50AC are charged respectively with data drivers 70A, 70B, and 70C.

For charging the selected pixel element 50AB, the data driver 70B applies a predetermined current $I_d$(AB) to the column conducting line 30B. If the total leakage current by the nonlinear elements in the non-selected pixel elements (i.e., 50BB and 50CB) can be reasonably neglected, the voltage across the capacitive element 54 in the pixel element 50AB can be charged to the value $R_0I_d$(AB) even there are voltage drops on the row conducting line 40A.

Similarly, for charging the selected pixel element 50AA, the data driver 70A applies a predetermined current $I_d$(AA) to the column conducting line 30A, the voltage across the capacitive element 54 in the pixel element 50AA can be charged to a predetermined value $R_0I_d$(AA). For charging the selected pixel element 50AC, the data driver 70C applies a predetermined current $I_d$(AC) to the column conducting line 30C, the voltage across the capacitive element 54 in the pixel element 50AC can be charged to a predetermined value $R_0I_d$(AC).

After the capacitive element 54 in a pixel element (e.g., 50AB) is charged to a target value, the nonlinear element 51 in the pixel element (e.g., 50AB) is driven into a non-conducting state and the voltage across the capacitive element 54 in the pixel element (e.g., 50AB) may change with time. Such voltage change over time, however, can follow a well defined function of time that essentially depends on some design parameters of the pixel element. When the voltage across the capacitive element 54 follows a well defined function of time, the total luminosity of a pixel element during a frame time period can be determined by the initial voltage across the capacitive element 54.

With similar operation principle, during the second predetermined time period T2, when predetermined currents $I_d$(BA), $I_d$(BB), and $I_d$(BC) are respectively applied to the column conducting lines 30A, 30B, and 30C, the capacitive element 54 in the pixel elements 50BA, 50BB, and 50BC can be respectively charged to the voltages of the values $R_0I_d$(BA), $R_0I_d$(BB), and $R_0I_d$(BC). During the third predetermined time period T3, when predetermined currents $I_d$(CA), $I_d$(CB), and $I_d$(CC) are respectively applied to the column conducting lines 30A, 30B, and 30C, the capacitive element 54 in the pixel elements 50CA, 50CB, and 50CC can be respectively charged to the voltages of the values $R_0I_d$(CA), $R_0I_d$(CB), and $R_0I_d$(CC).

Figure 11A:
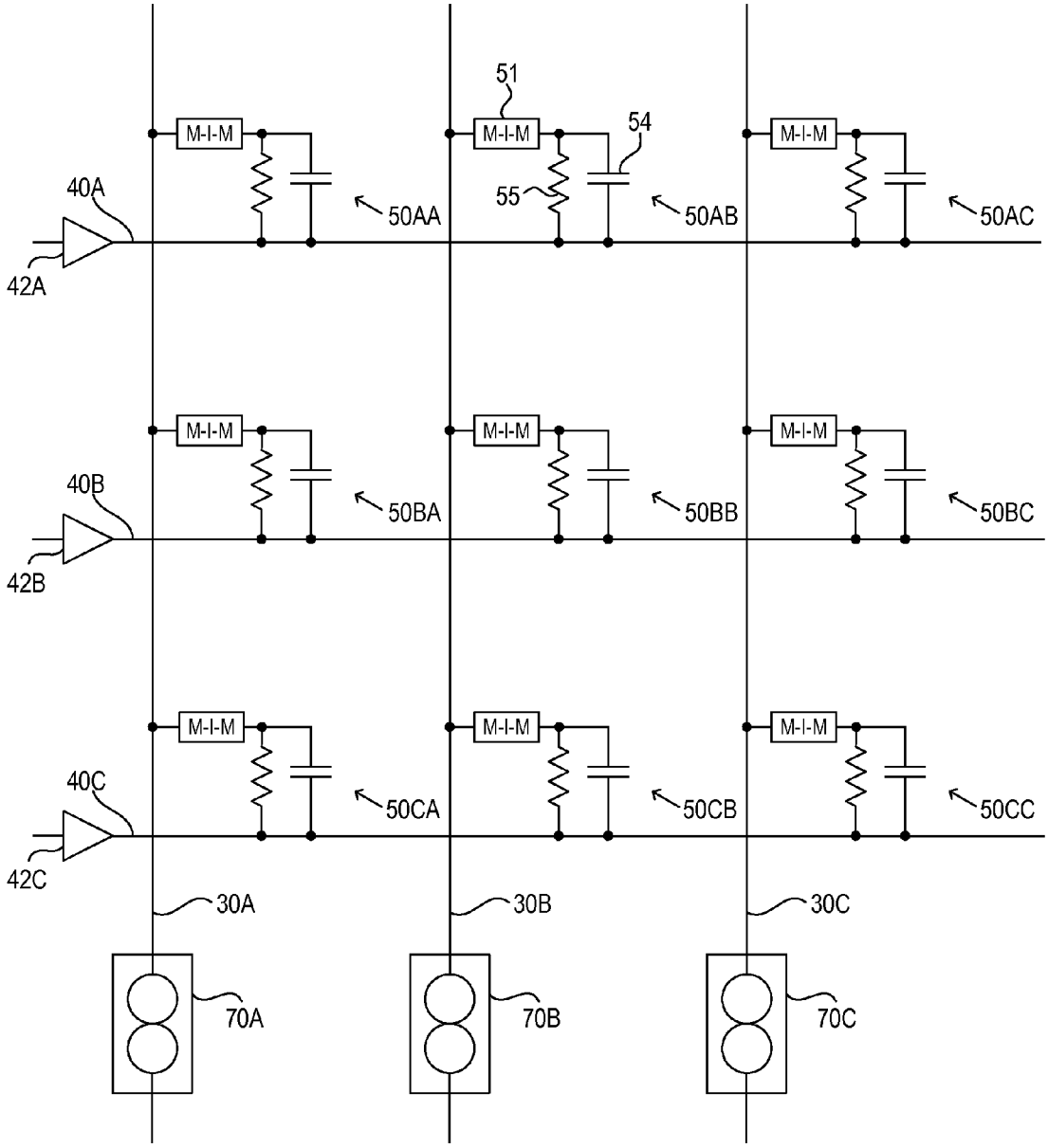
FIGS. 11A-11B shows that the nonlinear elements 51 in the pixel elements in the active matrix display can be metal-insulator-metal diodes.
Figure 11B:
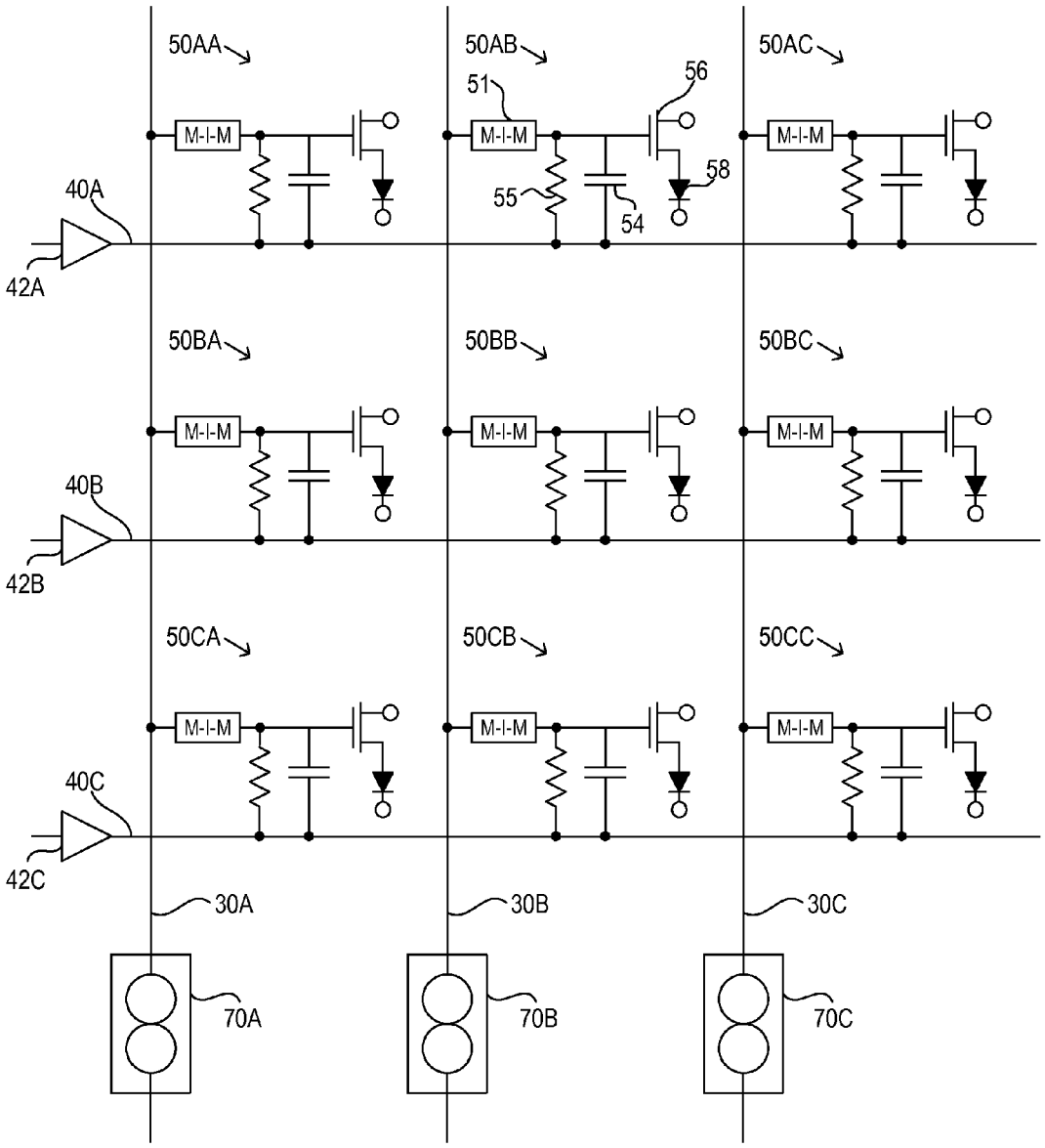

FIGS. 11A-11B shows that the nonlinear elements 51 in the pixel elements in the active matrix display can be metal-insulator-metal diodes. In general, the nonlinear elements 51 can be metal-insulator-metal diodes, PN diodes, PIN diodes, Schottky diodes, one or more serially connected diodes and resistors, or other kinds of two terminal non-linear devices. Certain kinds of three terminal devices can also be used as the nonlinear elements 51.

Figure 12A:
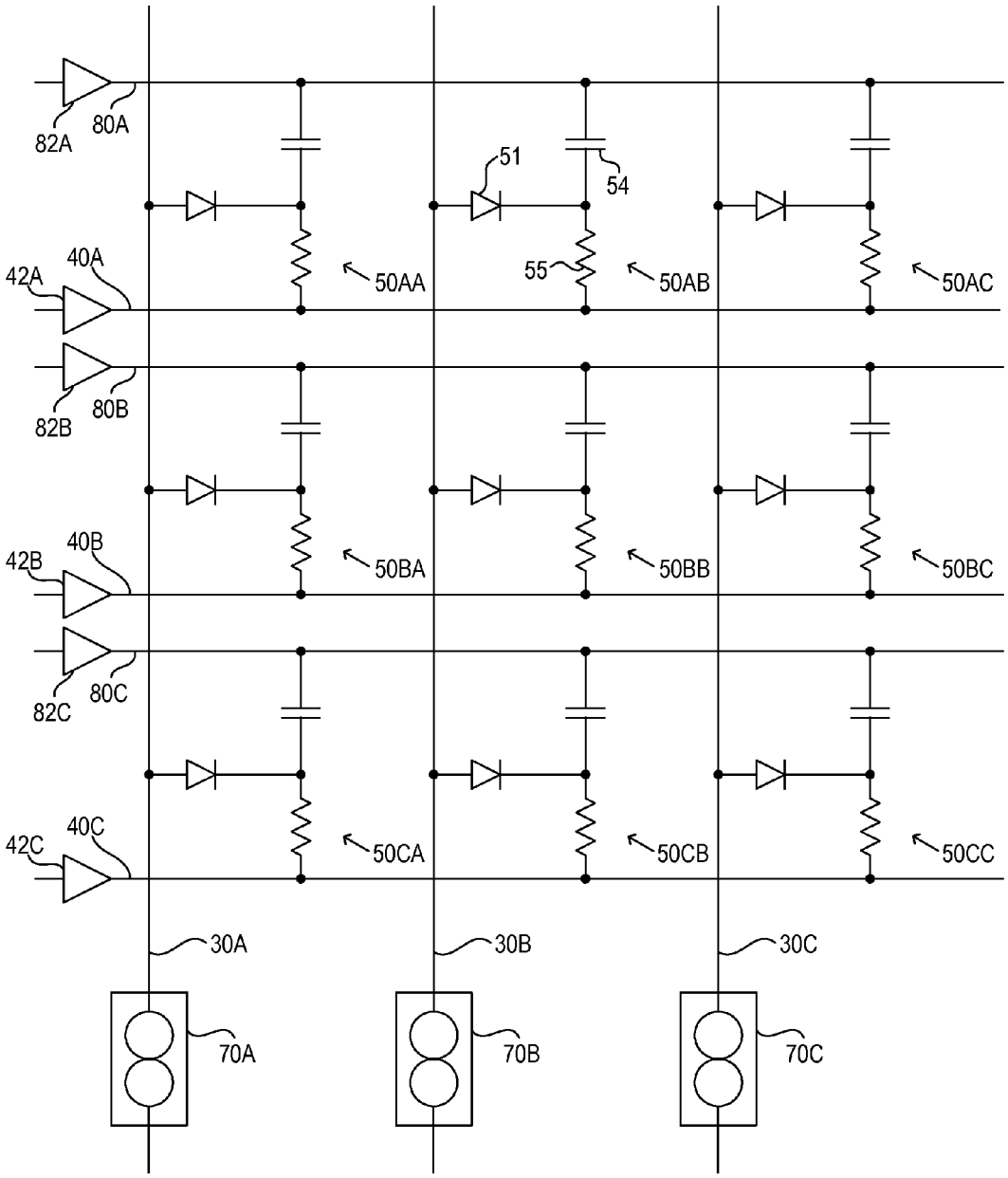
FIGS. 12A-12B are other implementations of active matrix displays that have nonlinear elements in pixel elements and data drivers to provide predetermined currents to column conducting lines.
Figure 12B:
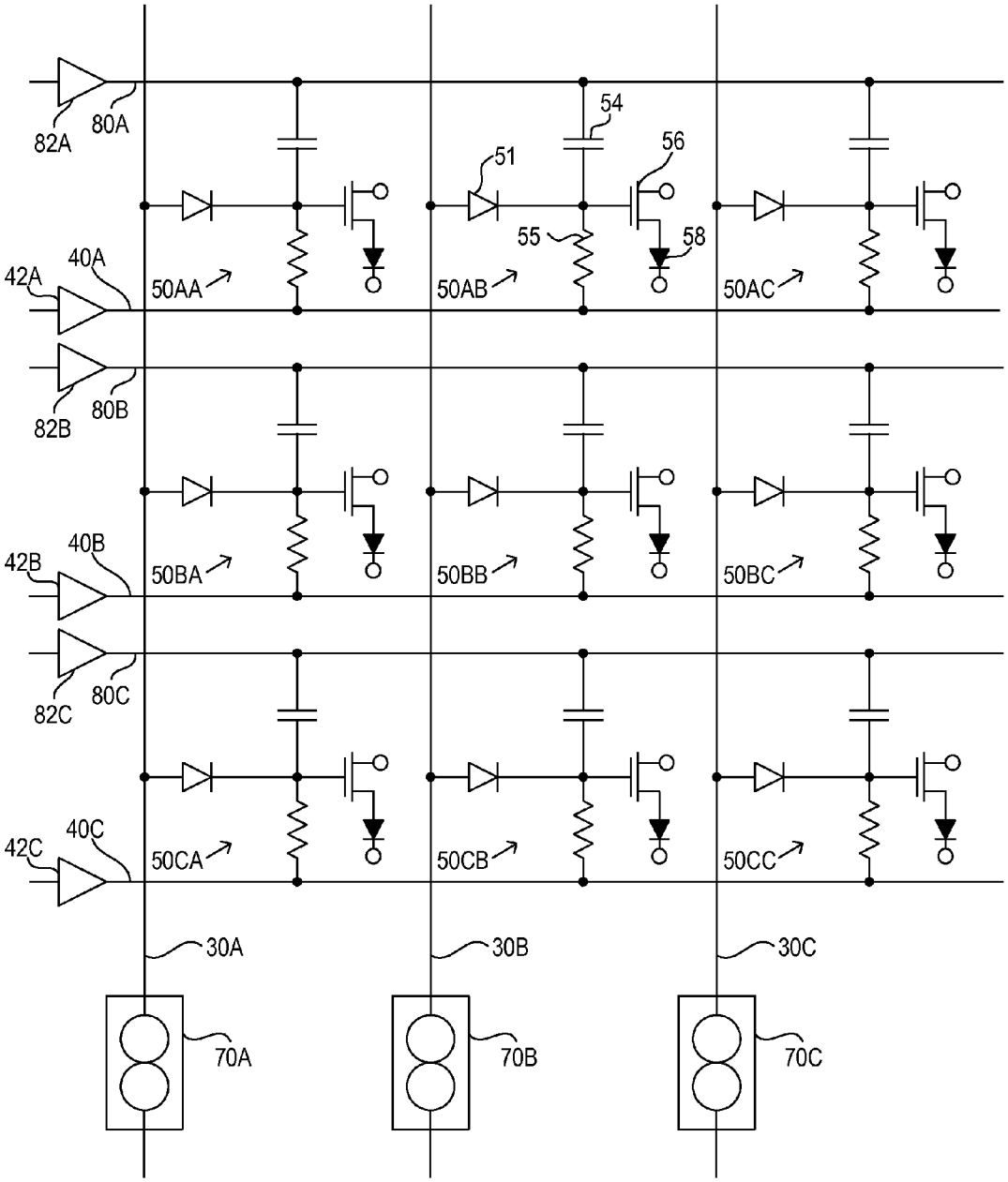

FIGS. 12A-12B are other implementations of active matrix displays that have nonlinear elements in pixel elements and data drivers to provide predetermined currents to column conducting lines. In FIGS. 12A-12B, the active matrix display includes an array of supplementary row conducting lines (e.g., 80A, 80B, and 80C) crossing the array of column conducting lines (e.g., 30A, 30B, and 30C). The second terminal of the capacitive element 54 in a pixel element (e.g., 50AB) is electrically connected to a supplementary row conducting line (e.g., 80A).

In operation, for charging the pixel element 50AB, if a predetermined current $I_d$(AB) passes through both the nonlinear element 51 and the resistive element 55 and if a selection voltage $V_{on}$ is applied to the first terminal of the resistive element 55, then, the voltage at the second terminal of the resistive element 55 can become $V_{on}+R_0I_d$(AB). If a supplementary voltage is applied to the supplementary row conducting line 80A such that the second terminal of the capacitive element 54 is set at a voltage of the value $V_{supp_on}$, then, the capacitive element 54 can be changed to a voltage of the value $V_{on}+R_0I_d(AB)-V_{supp_on}$. After the capacitive element 54 is charged to this target value, a deselect voltage $V_{off}$ is applied to the first terminal of the resistive element 55 to drive the nonlinear element 51 into a non-conducting state. Another supplementary voltage can also be applied to the supplementary row conducting line 80A. When the pixel element 50AB is changed to a non-selected pixel element, the voltage across the capacitive element 54 may still change with time. Such voltage change over time, however, can follow a well defined function of time that essentially depends on some design parameters of the pixel element. When the voltage across the capacitive element 54 follows a well defined function of time, the total luminosity of a pixel element during a frame time period can be determined by the initial voltage across the capacitive element 54.

Figure 13A:
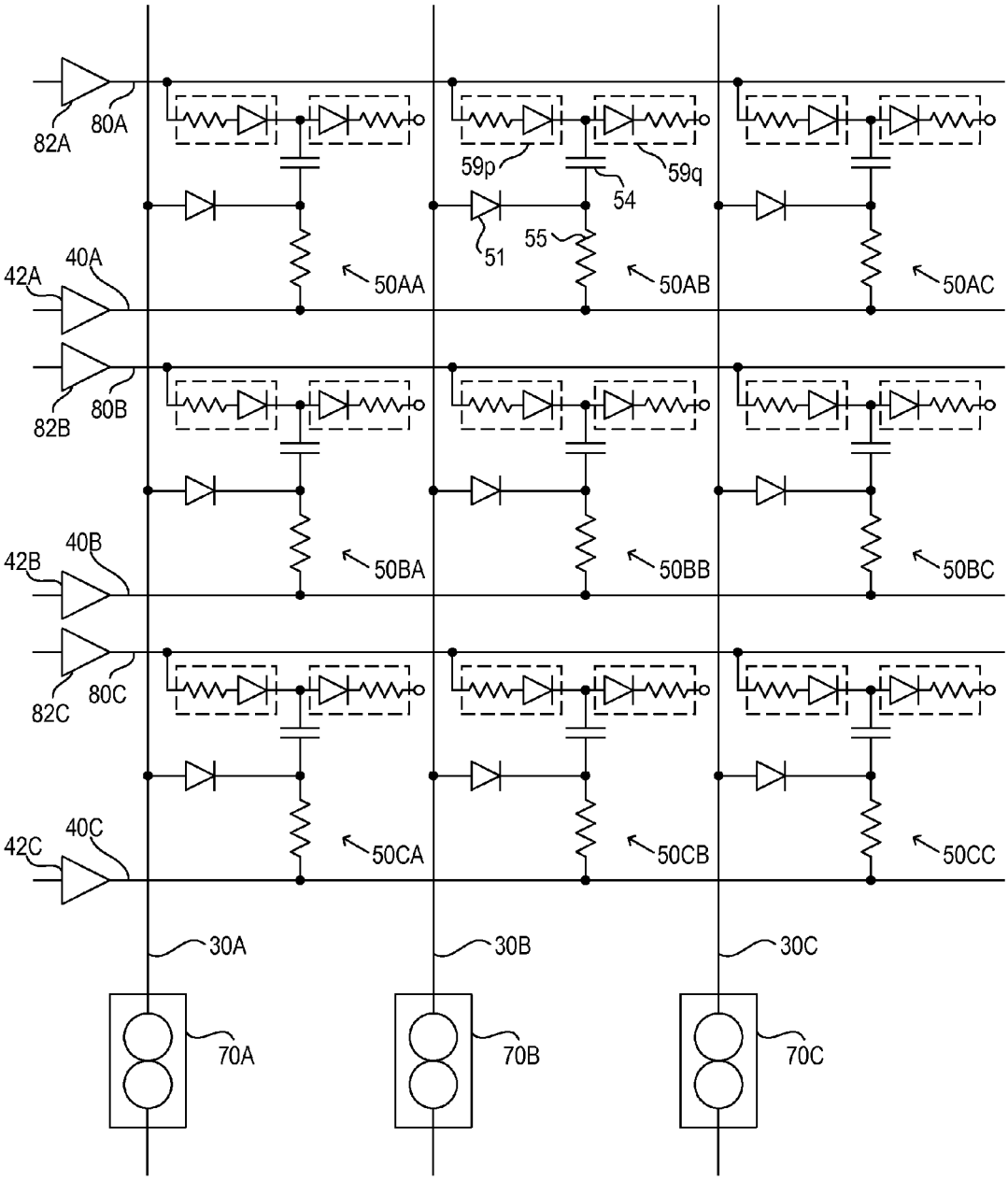
FIGS. 13A-13B are additional implementations of active matrix displays that have nonlinear elements in pixel elements and data drivers to provide predetermined currents to column conducting lines.
Figure 13B:
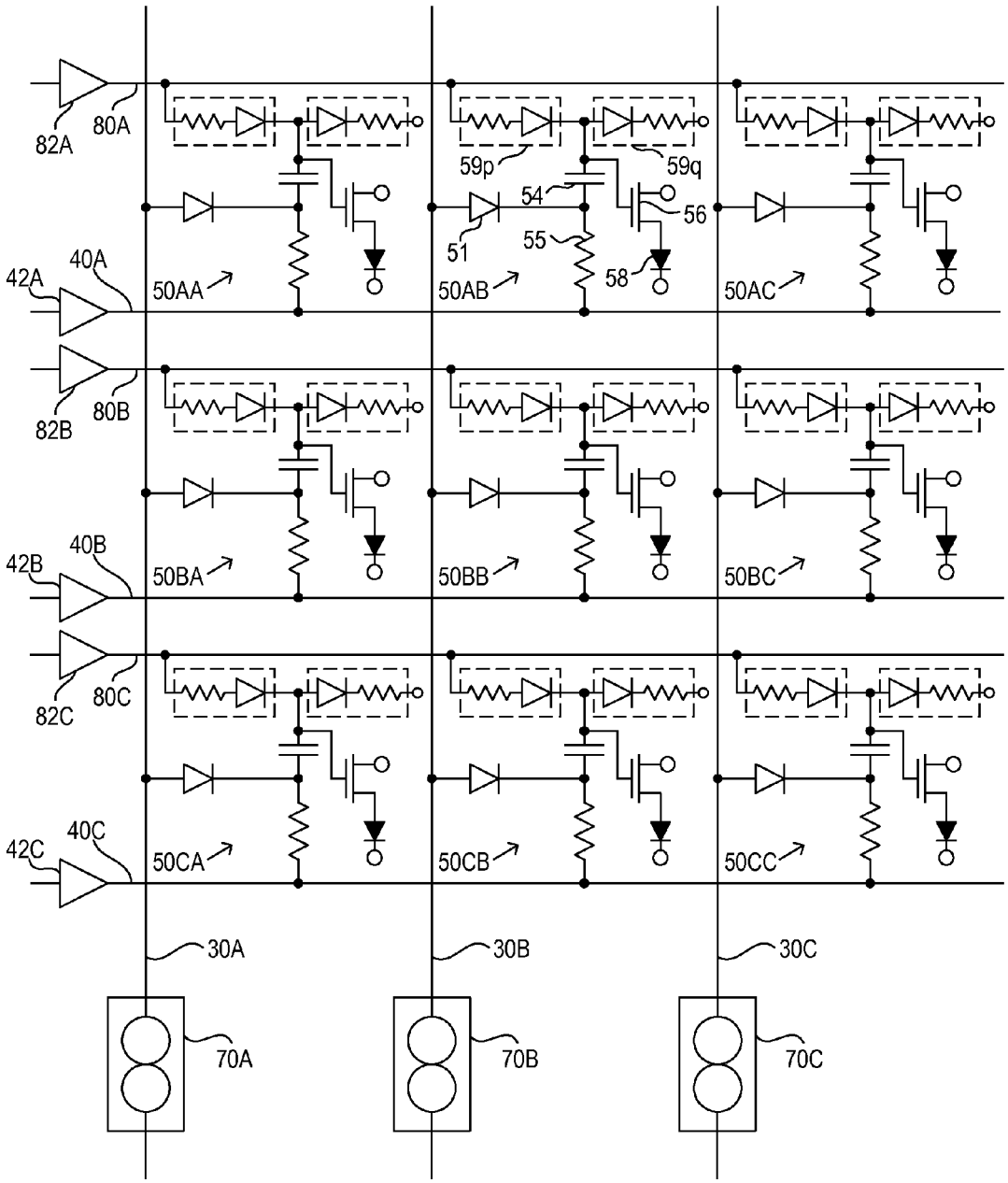

FIGS. 13A-13B are additional implementations of active matrix displays that have nonlinear elements in pixel elements and data drivers to provide predetermined currents to column conducting lines. In FIGS. 13A-13B, the active matrix display includes an array of supplementary row conducting lines (e.g., 80A, 80B, and 80C) crossing the array of column conducting lines (e.g., 30A, 30B, and 30C). The second terminal of the capacitive element 54 in a pixel element (e.g., 50AB) is electrically connected to a mid-terminal of a nonlinear element complex that includes a first nonlinear element 59*p* and a second nonlinear element 59*q*. The first nonlinear 59*p* element has a first terminal electrically connected to a supplementary row conducting line (e.g., 80A). The first nonlinear element 59*p* has a second terminal serving as the mid-terminal of the nonlinear element complex. The second nonlinear element 59*q* element has a first terminal electrically connected to the second terminal of the first nonlinear element 59*p*. The second nonlinear element 59*q* element has a second terminal electrically connected to a common voltage. In other implementations, the second nonlinear element 59*q* element can have a second terminal electrically connected to an additional supplementary row conducting line. In one implementation, the first nonlinear element 59*p* and the second nonlinear element 59*q* each include a PN diode serially connected with a resistor. In another implementation, the first nonlinear element 59*p* and the second nonlinear element 59*q* can be MIM diodes or other kinds of diodes.

In operation, for charging the pixel element 50AB, the nonlinear element 51 in the pixel element 50AB is drive into a conducting state. Both the first nonlinear element 59*p* and the second nonlinear element 59*q* of the nonlinear element complex in the pixel element 50AB are also drive into a conducting state. For charging the pixel element 50AB, if a predetermined current $I_d$(AB) passes through both the nonlinear element 51 and the resistive element 55 and if a selection voltage $V_{on}$ is applied to the first terminal of the resistive element 55, then, the voltage at the second terminal of the resistive element 55 can become $V_{on}+R_0I_d$(AB). If the voltage at the mid-terminal of the nonlinear element complex is $V_{mid}$, then, the capacitive element 54 can be changed to a voltage of the value $V_{on}+R_0I_d(AB)-V_{mid}$. After the capacitive element 54 is charged to a target value, the nonlinear element 51 is driven into a non-conducting state; both the first nonlinear element 59*p* and the second nonlinear element 59*q* of the nonlinear element complex are also driven into non-conducting states. After the pixel element 50AB is changed to a non-selected pixel element, the voltage across the capacitive element 54 in the pixel element 50AB can be essentially maintained if leakage currents through the first nonlinear element 59*p* and the second nonlinear element 59*q* in the pixel element 50AB can be neglected.

FIGS. 14A-14Q and FIGS. 15A-15D are some general implementations of the pixel elements that include one or more nonlinear elements. In FIGS. 14A-14Q and FIGS. 15A-15D, a pixel element 50AB includes a resistive element 55, a nonlinear element 51, and a capacitive element 54. The capacitive element 54 has a first terminal and a second terminal. The nonlinear element 51 has a first terminal electrically connected to a column conducting line 30B and has a second terminal electrically connected to the first terminal of the capacitive element 54. The resistive element 55 has a first terminal electrically connected to a row conducting line 40A and has a second terminal electrically connected to the first terminal of the capacitive element 54. In some implementations, the pixel element 50AB also includes a switching transistor 52. In some implementations, the pixel element 50AB also includes a secondary switching transistor 53. In some implementations, the pixel element 50AB also includes additional nonlinear elements 59*p* and 59*q*.

Figure 16A:
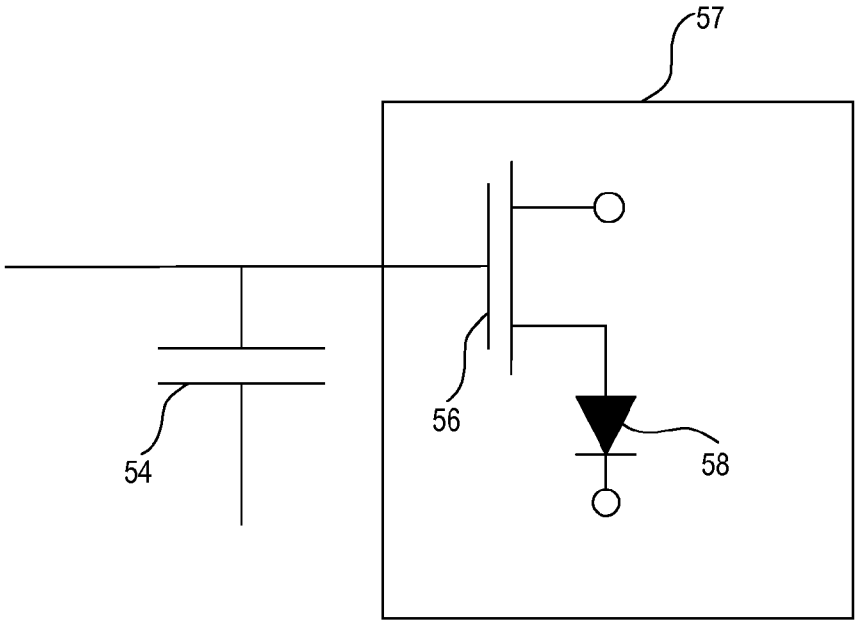
FIGS. 16A-16B are implementations of the pixel-sub-circuit that includes a driving transistor and a light emitting diode.
Figure 16B:
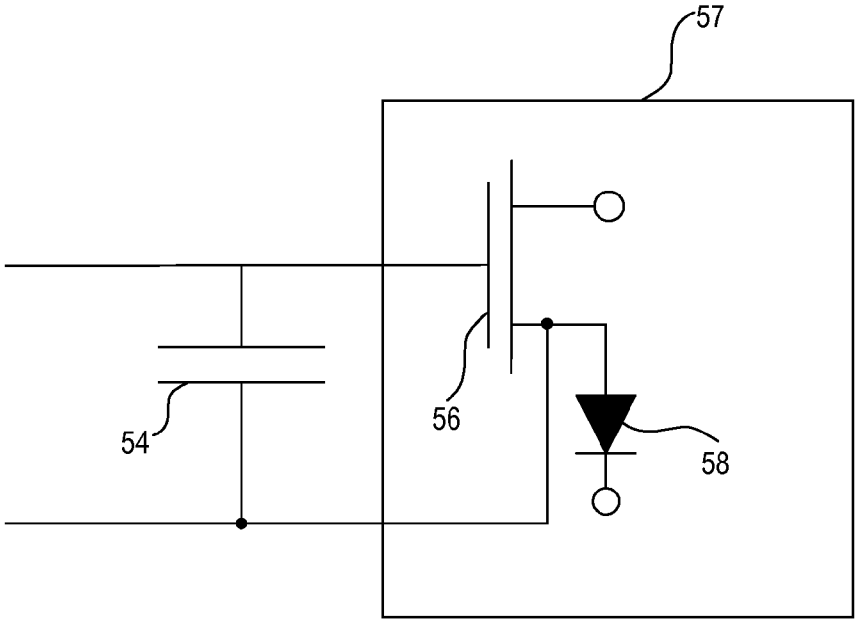

In FIGS. 14A-14Q and FIGS. 15A-15D, the pixel element 50AB also includes a pixel-sub-circuit 57 that is electrically connected to the capacitive element 54. In some implementations, the pixel-sub-circuit 57 is electrically connected to the first terminal of the capacitive element 54. In some implementations, the pixel-sub-circuit 57 is electrically connected to the second terminal of the capacitive element 54. In some implementations, both the first terminal and the second terminal of the capacitive element 54 are electrically connected to the pixel-sub-circuit 57. In some implementations, as shown in FIGS. 16A-16B, the pixel-sub-circuit 57 can include a driving transistor 56 and a light emitting diode 58. In other implementations, the pixel-sub-circuit 57 can include other and additional electronic components.

In the implementations of active matrix displays as described previously, an active matrix display that has nonlinear elements in pixel elements generally can be driven by data drivers configured to supply predetermined currents to column conducting lines. In one implementation, a data driver can include a current source having certain compliance voltage. The current source can supply a constant current to a column conducting line when the voltage on that column conducting line is less than the compliance voltage. In another implementation, for supplying a predetermined current to a column conducting, a voltage can be applied to the column conducting line through a high impedance element. The value of the predetermined current can be changed either by changing the value of the voltage applied to the column conducting line or by changing the value of the high impedance element.

Figure 17A:
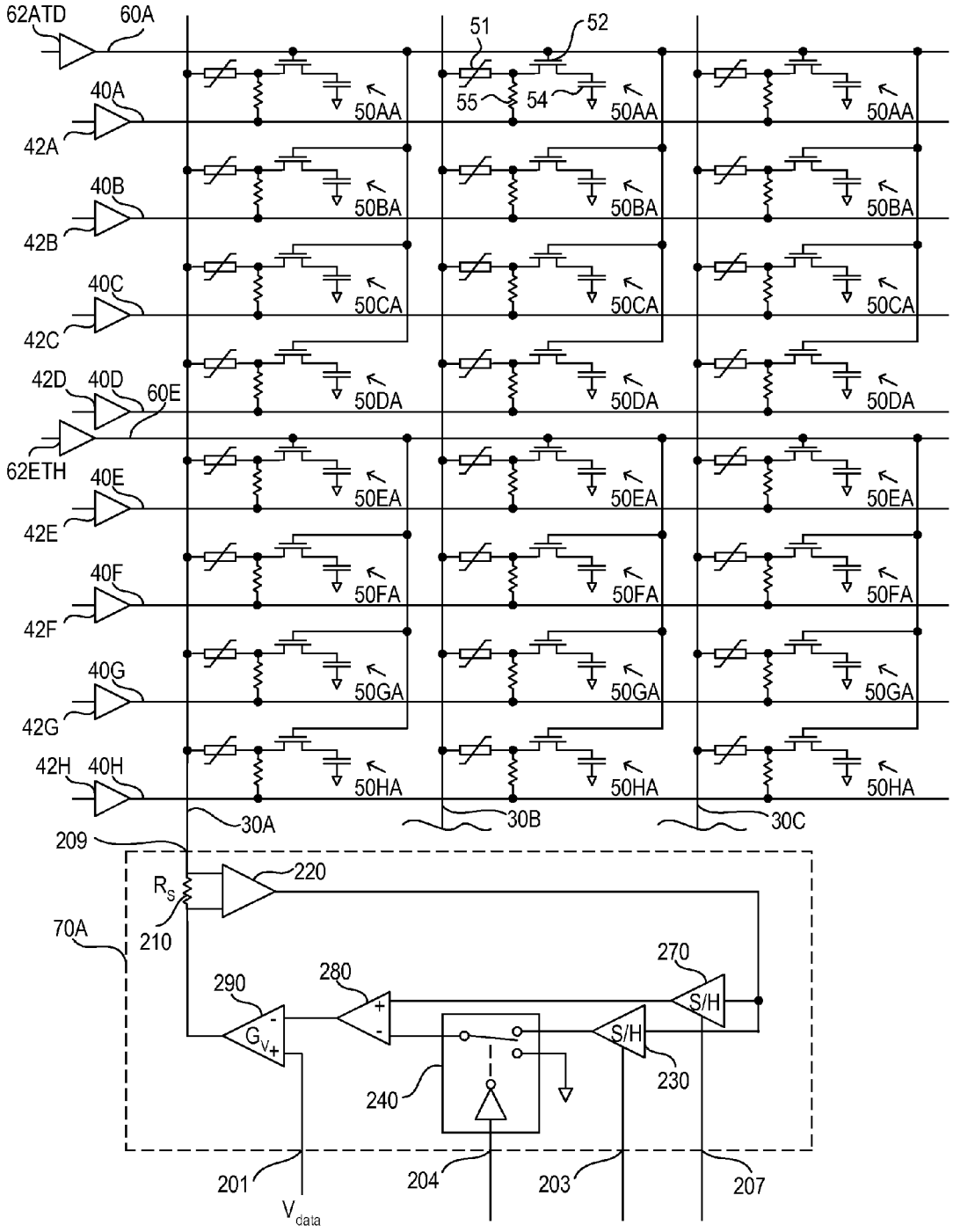
FIGS. 17A-17B illustrate an implementation of the data driver that can supply a predetermined current to a column conducting line in an active matrix display having nonlinear elements in pixel elements.
Figure 17B:
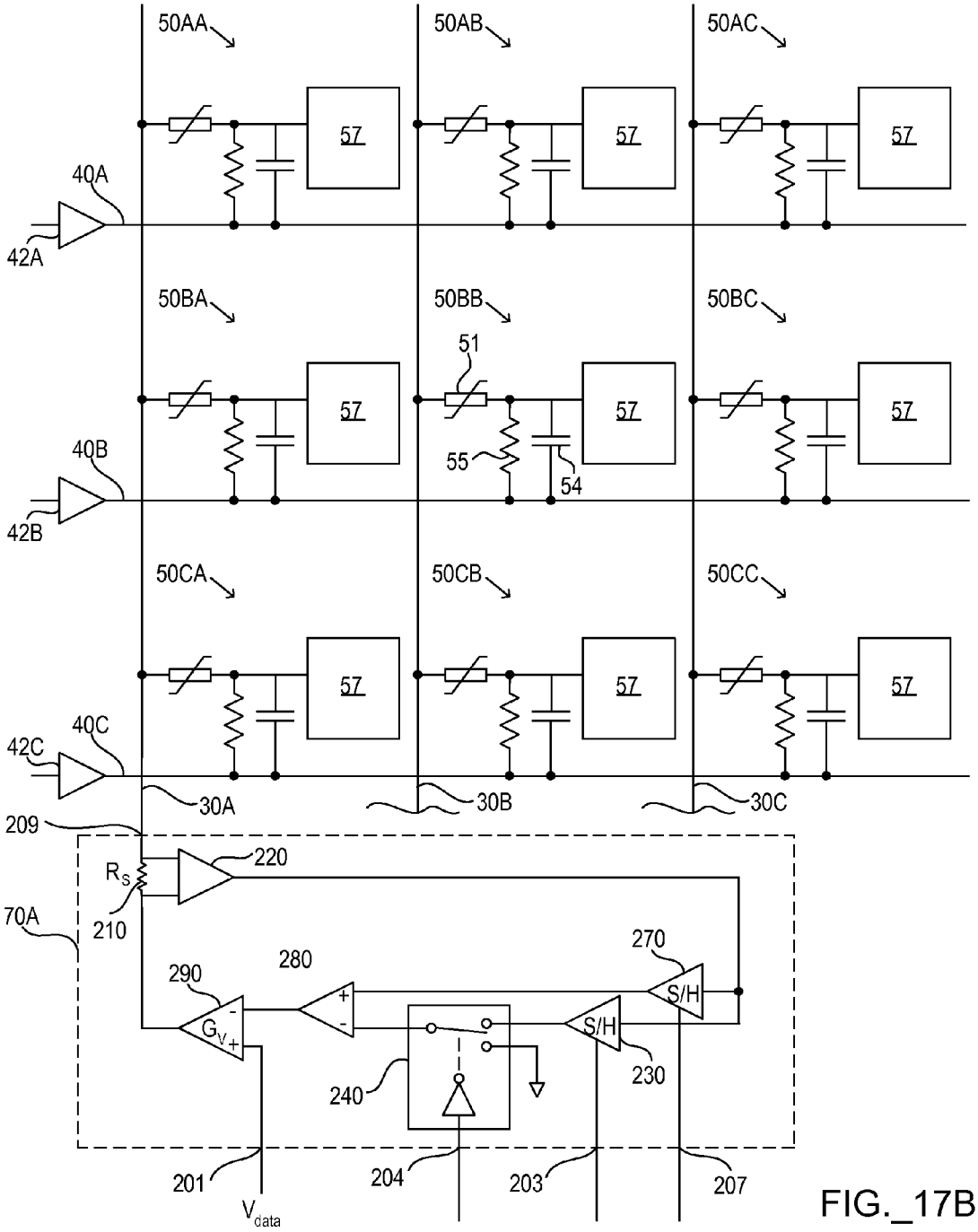

FIGS. 17A-17B illustrate an implementation of the data driver that can supply a predetermined current to a column conducting line in an active matrix display having nonlinear elements in pixel elements. In FIGS. 17A-17B, the data driver 70A is electrically connected a column conducting line 30A. The column conducting line 30A is electrically connected to a column of pixel elements (e.g., 50AA, 50BA, 50CA, . . . ). The data driver 70A can supply a predetermined current to the column conducting line 30A while making some corrections about the leakage currents due to the nonlinear elements in those non-selected pixel elements.

The data driver 70A includes a current sensing resistor 210, an instrumentation amplifier 220, a first sample-and-hold circuit 230, a switch circuit 240, a second sample-and-hold circuit 270, a first differential amplifier 280, and a second differential amplifier 290. The current sensing resistor 210 has a resistive value Rs. The data driver 70A also includes a data input 201, a data output 209, a switch control input 204, a first circuit-mode input 203 for setting the first sample-and-hold circuit 230 into either the sample mode or the hold mode, and a second circuit-mode input 207 for setting the second sample-and-hold circuit 270 into either the sample mode or the hold mode.

In operation, during a first time period $T_s$, the second sample-and-hold circuit 270 is set to the sampling mode. A signal is applied to the switch control input 204 to enable the switch circuit 240 to connect the inverting input of the first differential amplifier 280 to a zero voltage. During the first time period $T_s$, the current sensing resistor 210, the instrumentation amplifier 220, the second sample-and-hold circuit 270, the first differential amplifier 280, and the second differential amplifier 290 can complete a negative feedback loop. When a data voltage V(AA) is applied to the data input 201 of the data driver 70A after the pixel element 50AA is selected as the selected element, a predetermined current of the value $I_d(AA)=V(AA)/RsGv$ is applied to the column conducting line 30A. Here, Gv is the voltage gain of the second differential amplifier 290. This predetermined current may not completely pass through the nonlinear element 51 in the selected pixel element 50AA if there are significant amount of leakage currents by the nonlinear elements in the non-selected pixel elements (e.g., 50BA, 50CA, . . . ).

To measure the total amount of the leakage currents, during a second time period $T_M$, the first sample-and-hold circuit 230 is set to the sampling mode while the second sample-and-hold circuit 270 is set to the holding mode. During the second time period $T_M$, the output voltage of the second differential amplifier 290 is essentially held at a constant voltage. At the end of the second time period $T_M$, when the pixel element 50AA is also changed to a non-selected pixel element along with the other non-selected pixel elements (e.g., 50BA, 50CA, . . . ), the total leakage current $I_{leak}$ by the nonlinear elements in all non-selected pixel elements can be measured by measuring a voltage across the current sensing resistor 210. After this measurement, if the first sample-and-hold circuit 230 is changed to the holding mode, the measured total leakage current $I_{leak}$ can be essentially memorized by a voltage held in the first sample-and-hold circuit 230.

During a third time period $T_C$, the pixel element 50AA is selected as the selected element, the first sample-and-hold circuit 230 is set to the holding mode while the second sample-and-hold circuit 270 is set to the sampling mode, and a signal is applied to the switch control input 204 to enable the switch circuit 240 to connect the inverting input of the first differential amplifier 280 to the output of the first sample-and-hold circuit. During the third time period $T_C$, the current sensing resistor 210, the instrumentation amplifier 220, the second sample-and-hold circuit 270, the first differential amplifier 280, and the second differential amplifier 290 can complete a negative feedback loop. When the second differential amplifier 290 receives a data voltage V(AA), a predetermined current of the value $I_d(AA)=V(AA)/RsGv+I_{leak}$ is applied to the column conducting line 30A. If the total amount of leakage currents by the nonlinear elements in the non-selected pixel elements (e.g., 50BA, 50CA, . . . ) is almost equal to $I_{leak}$ (which includes additional leakage current if the pixel element 50AA is also a non-selected pixel element), then, the current passing through the nonlinear element 51 in the selected pixel element 50AA is almost equal to V(AA)/RsGv. Consequently, the voltage applied to the first terminal of the capacitive element 54 is almost equal to $R_0V(AA)/RsGv+V_{on}$. Here, $V_{on}$ is the voltage at the first terminal of the resistive element 55.

For those implementations of active matrix displays in which the second terminal of the capacitive element 54 is connected to the first terminal of the resistive element 55, the voltage applied across the capacitive element 54 in a selected pixel element (e.g., 50AA) can be almost equal to $R_0V(AA)/RsGv$. Thus, the voltage applied across the capacitive element 54 can be almost entirely determined by a data voltage (e.g., the input voltage V(AA) applied to the data driver 70A) and a few circuit parameters (e.g., $R_0$, Rs, and Gv).

The data driver 70A in FIGS. 17A-17B is just one sample implementation of the data driver that can apply a predetermined current to a column conducting line while making some corrections about the leakage currents due to the non-selected pixel elements. Many other implementations are possible.

For those implementations of active matrix displays in which the second terminal of the capacitive element 54 is not connected to the first terminal of the resistive element 55, and the voltage applied on the first terminal of the resistive element 55 also depends on some voltage drops on a row conducting line, it may still possible to correct the voltage drops. For example, in a simple model in which the resistance of the row conducting line between two adjacent pixel elements is uniformly AR, the voltage on the second terminal of the resistive element 55 in the pixel elements 50AA, 50AB, and 50AC is respectively given by the following equations:

$$V_{AA}=V_{on}+R_0I_d(AA)+\Delta R[Id(AA)+Id(AB)+Id(AC)];$$

$$V_{AB}=V_{on}+R_0I_d(AB)+\Delta R[Id(AA)+2Id(AB)+2Id(AC)];$$

and $$V_{Ac}=V_{on}+R_0I_d(AC)+\Delta R[Id(AA)+2Id(AB)+3Id(AC)].$$

Here, the current Id(AA), Id(AB), and Id(AC) is respectively the current passing through the resistive element 55 in the pixel elements 50AA, 50AB, and 50AC. By solving above linear equations, the required current Id(AA), Id(AB), and Id(AC) for creating the desired target voltage values can be calculated.

Figure 18:
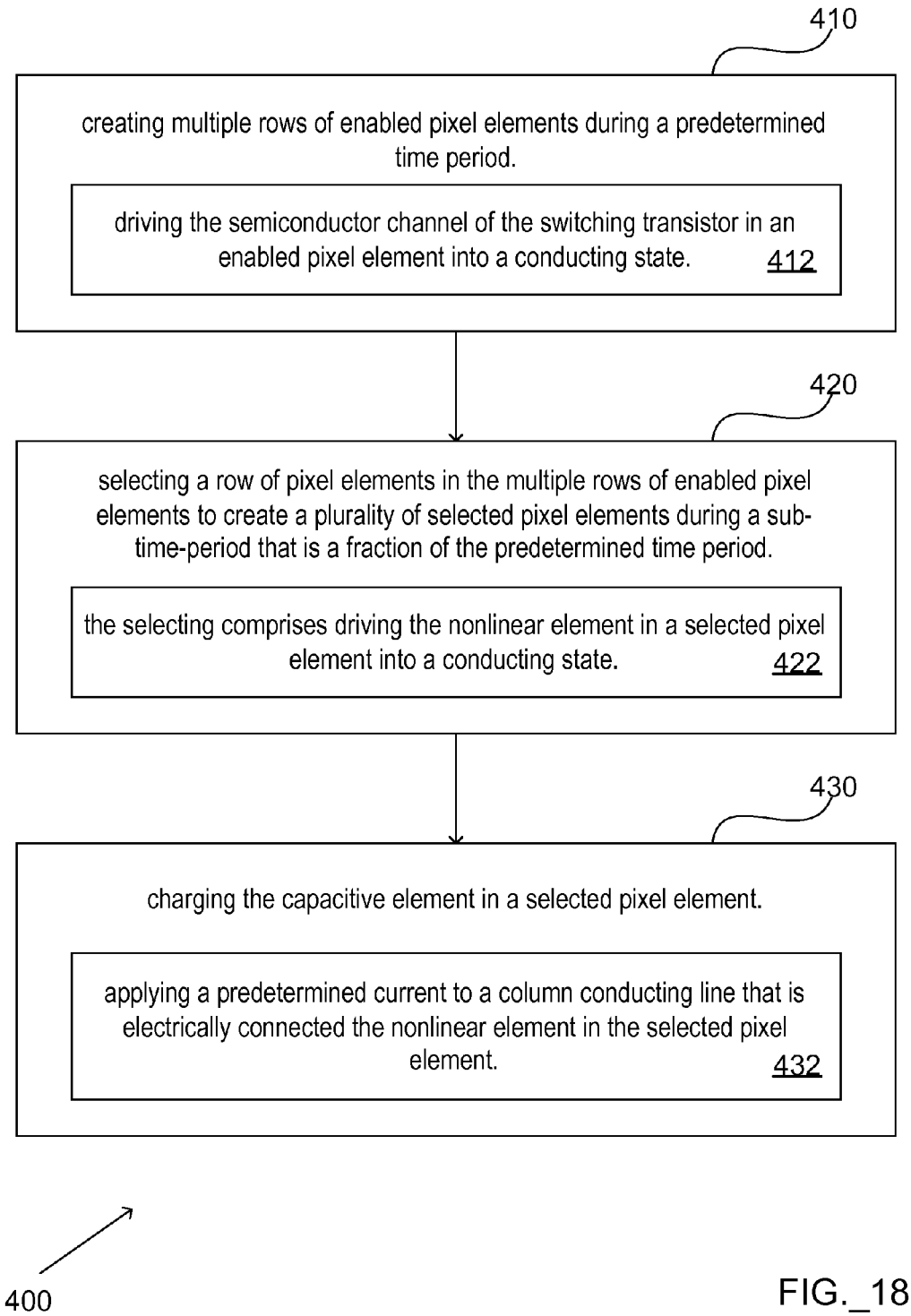
FIG. 18 shows an example method of driving an active matrix display that includes enabling lines and nonlinear elements in pixel elements.

FIG. 18 shows an example method 400 of driving an active matrix display that includes enabling lines and nonlinear elements in pixel elements. The method 400 includes blocks 410, 420, and 430.

The block 410 includes creating multiple rows of enabled pixel elements during a predetermined time period. The block 410 further includes a block 412 which includes driving the semiconductor channel of the switching transistor in an enabled pixel element into a conducting state.

As examples, when the block 410 is applied to the active matrix display as shown FIGS. 2A-2D, a group of multiple rows of pixel elements 50AA-50AC, 50BA-50BC, 50CA-50CC, and SODA-50DC can be enabled as the enabled pixel elements during a predetermined time period T1. The semiconductor channel of the switching transistor 52 in each of these enabled pixel elements can be driven into a conducting state by an enabling signal applied to the gate of the switching transistor 52. In one implementation, the enabling signal is provided by the enabling driver 62ATD.

The block 420 includes selecting a row of pixel elements in the multiple rows of enabled pixel elements to create a plurality of selected pixel elements during a sub-time-period that is a fraction of the predetermined time period. The block 420 further includes a block 422 which includes driving the nonlinear element in a selected pixel element into a conducting state.

As examples, when the block 420 is applied to the active matrix display as shown FIGS. 2A-2D, if the enabled pixel elements include pixel elements 50AA-50AC, 50BA-50BC, 50CA-50CC, and SODA-50DC during the predetermined time period T1, the block 420 can include selecting a row of pixel elements 50AA-50AC as the selected pixel elements during a sub-time-period T1(1). In one implementation, this sub-time-period T1(1) can be about one fourth of the predetermined time period T1, and the nonlinear element 51 in each of these selected pixel element is driven into a conducting state. In one implementation, a selection voltage is applied to the row conducting line 40A to drive the nonlinear element 51 in each of the pixel elements 50AA-50AC into a conducting state.

The block 430 includes charging the capacitive element in a selected pixel element. In one implementation, the block 430 includes a block 432 which includes applying a predetermined current to a column conducting line that is electrically connected the nonlinear element in the selected pixel element. In other implementations, the block 430 can includes a block 432 which includes applying a predetermined voltage to a column conducting line.

As examples, when the block 430 is applied to the active matrix display as shown FIGS. 2A-2D, if the selected pixel elements include the pixel elements 50AA, 50AB, and 50AC, the block 430 can include charging the capacitive element 54 in the selected pixel element 50AA, the selected pixel element 50AB, or the selected pixel element 50AC. In one implementation, predetermined currents $I_d$(AA), $I_d$(AB), and $I_d$(AD) can be respectively applied to the column conducting lines 30A, 30B, and 30C for charging respectively the capacitive element 54 in the pixel elements 50AA, 50AB, and 50AC. In other implementations, predetermined voltages can be respectively applied to the column conducting lines 30A, 30B, and 30C for charging respectively the capacitive element 54 in the pixel elements 50AA, 50AB, and 50AC.

Figure 19:
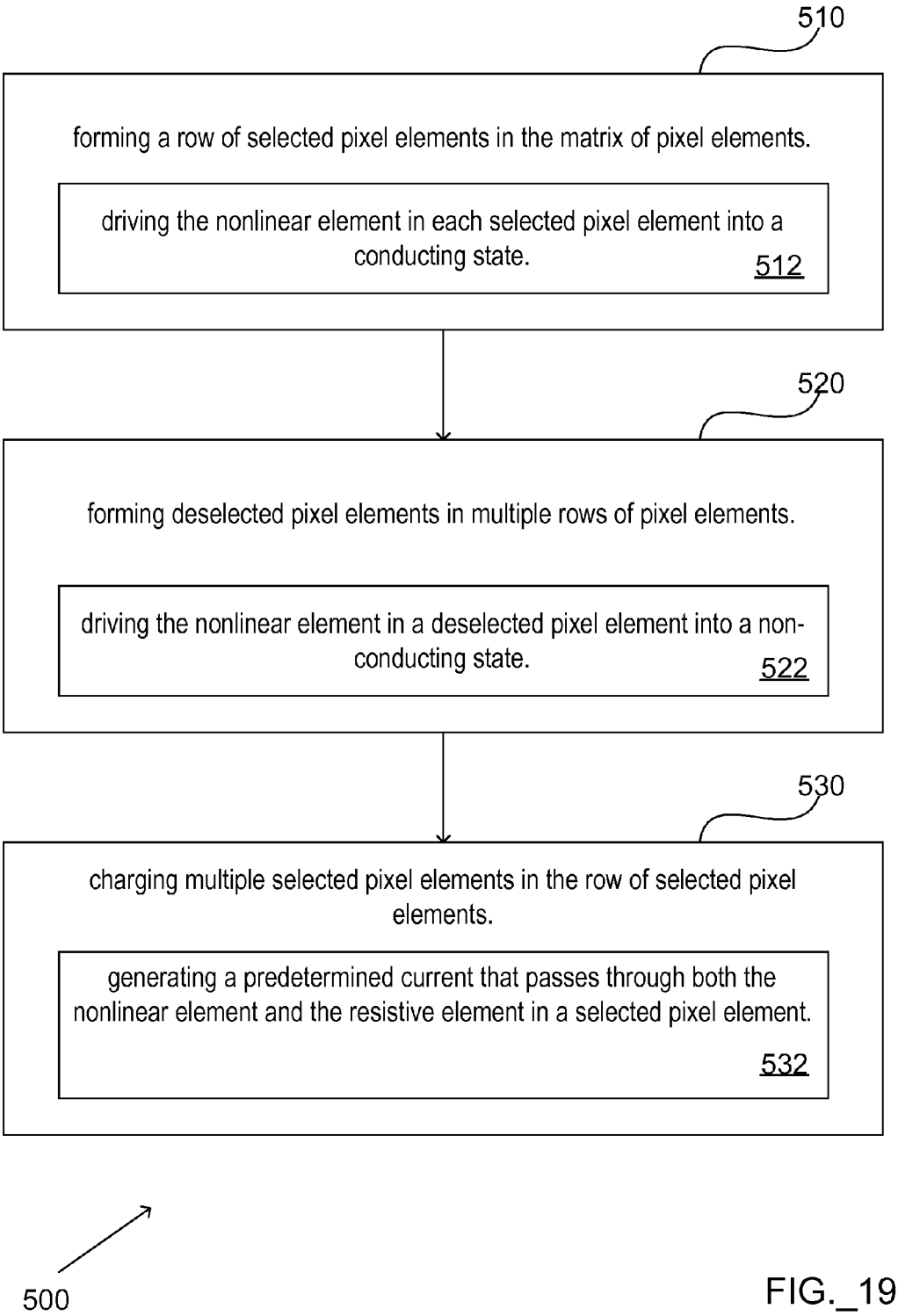
FIG. 19 shows an example method of driving an active matrix display that includes nonlinear elements in pixel elements.

FIG. 19 shows an example method 500 of driving an active matrix display that includes nonlinear elements in pixel elements. The method 500 includes blocks 510, 520, and 530.

The block 510 includes forming a row of selected pixel elements in the matrix of pixel elements. The block 510 further includes a block 512 which includes driving the nonlinear element in each selected pixel element into a conducting state.

As examples, when the block 510 is applied to the active matrix display as shown FIGS. 2A-2D and FIGS. 10A-10B, a row of pixel elements 50AA-50AC can be selected as the selected pixel elements. The nonlinear element 51 in each of these selected pixel element is driven into a conducting state. In one implementation, a selection voltage is applied to the row conducting line 40A to drive the nonlinear element 51 in each of the selected pixel elements 50AA-50AC into a conducting state.

The block 520 includes forming non-selected pixel elements in multiple rows of pixel elements. The block 520 further includes a block 522 which includes driving the nonlinear element in a non-selected pixel element into a non-conducting state.

As examples, when the block 520 is applied to the active matrix display as shown FIGS. 2A-2D and, the non-selected pixel elements can include the pixel elements 50BA-50LA, 50BB-50LB, and 50BC-50LC. In one implementation, deselect voltages are applied to the row conducting lines 40B-40L to drive the nonlinear element 51 in the pixel elements 50BA-50LA, 50BB-50LB, and 50BC-50LC into a non-conducting state.

As examples, when the block 520 is applied to the active matrix display as shown FIGS. 5A-5B and FIGS. 6A-6B, when the enabled pixel elements include the pixel elements 50AA-50AC, 50BA-50BC, 50CA-50CC, and 50DA-50DC, the non-selected pixel elements can include pixel elements 50BA-50BC, 50CA-50CC, and 50DA-50DC. In one implementation, deselect voltages are applied to the row conducting lines 40B-40D to drive the nonlinear element 51 in pixel elements 50BA-50BC, 50CA-50CC, and 50DA-50DC into a non-conducting state.

As examples, when the block 520 is applied to the active matrix display as shown FIGS. 10A-10B, the non-selected pixel elements can include pixel elements 50BA-50BC and 50CA-50CC. In one implementation, deselect voltages are applied to the row conducting lines 40B and 40C to drive the nonlinear element 51 in pixel elements 50BA-50BC and 50CA-50CC into a non-conducting state.

The block 530 includes charging multiple selected pixel elements in the row of selected pixel elements. The block 530 further includes a block 532 which includes generating a predetermined current that passes through both the nonlinear element and the resistive element in a selected pixel element.

Figure 14Q:
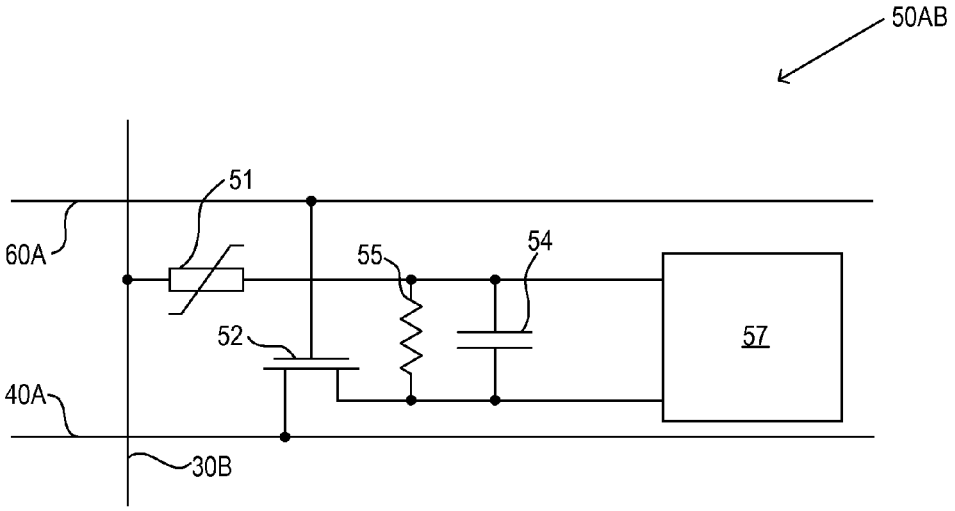
Figure 15A:
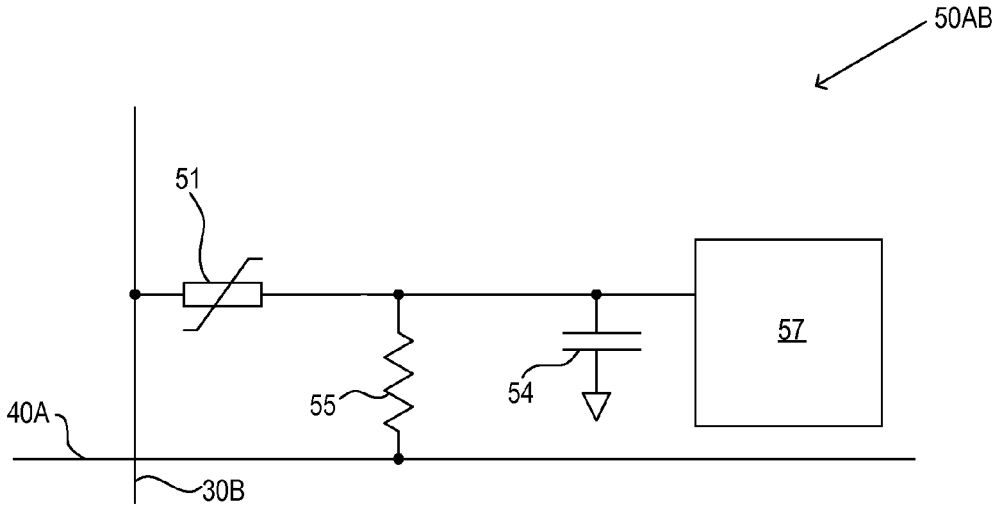
Figure 15B:
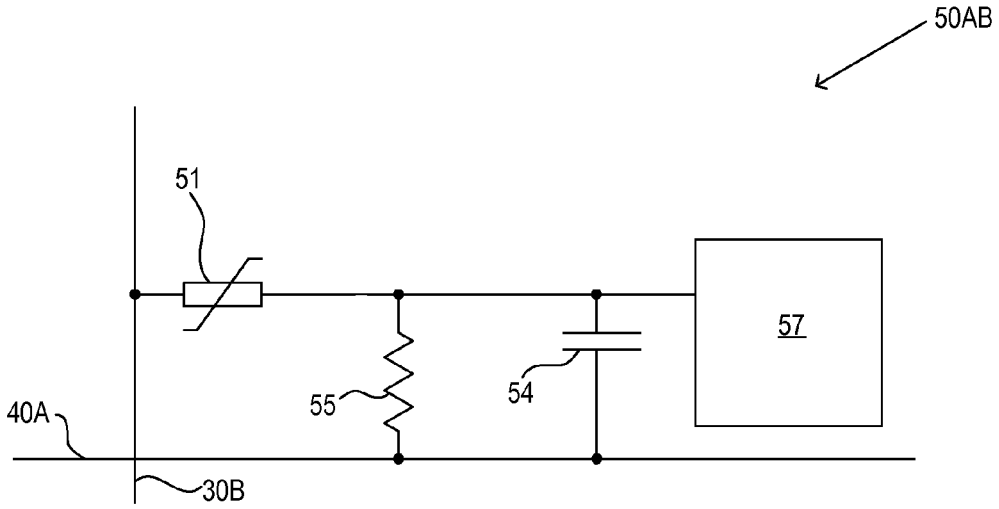
Figure 15C:
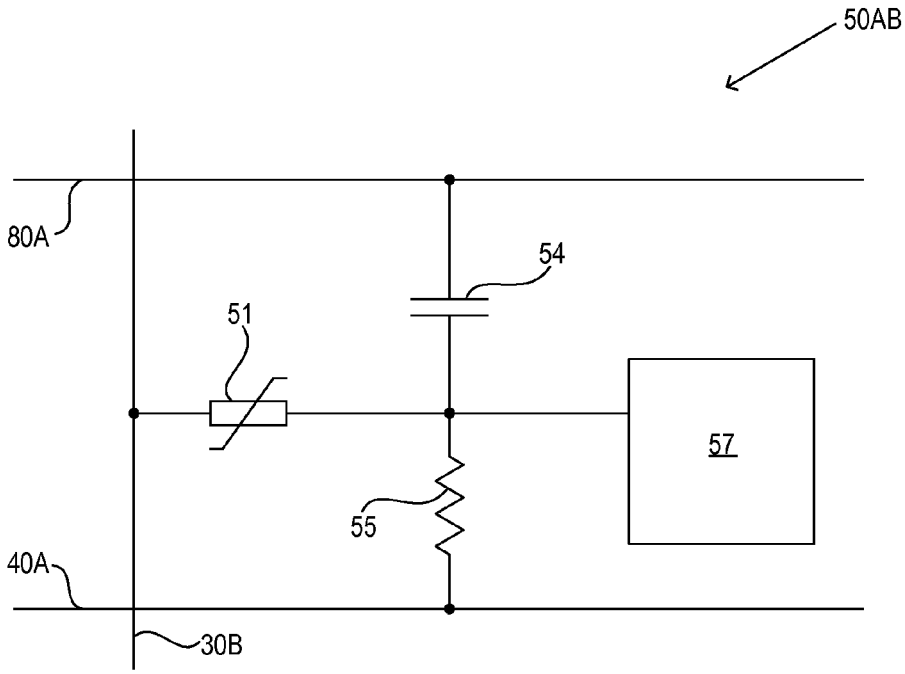
Figure 15D:
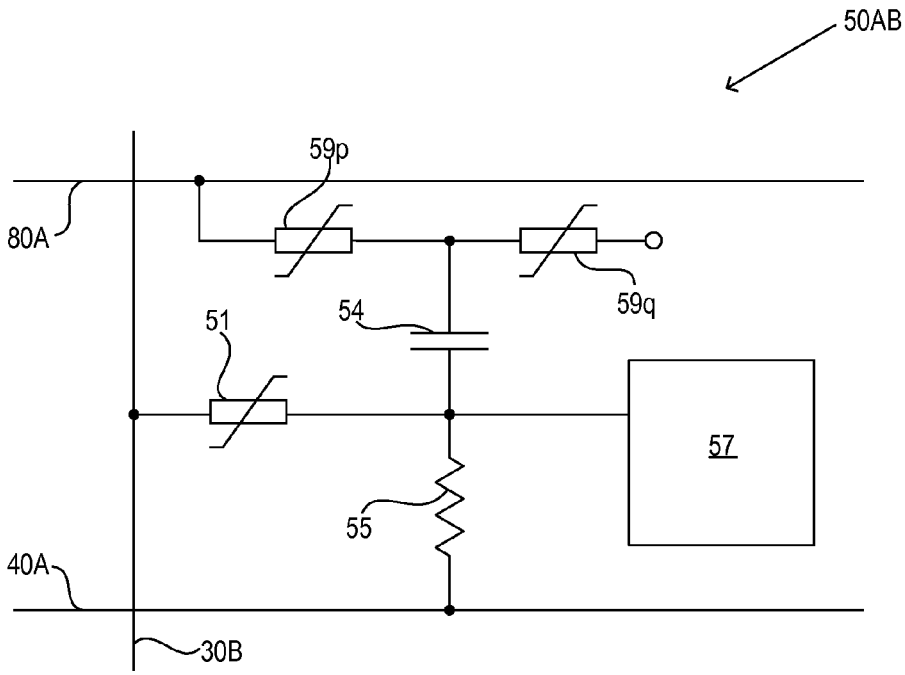
Figure 22:
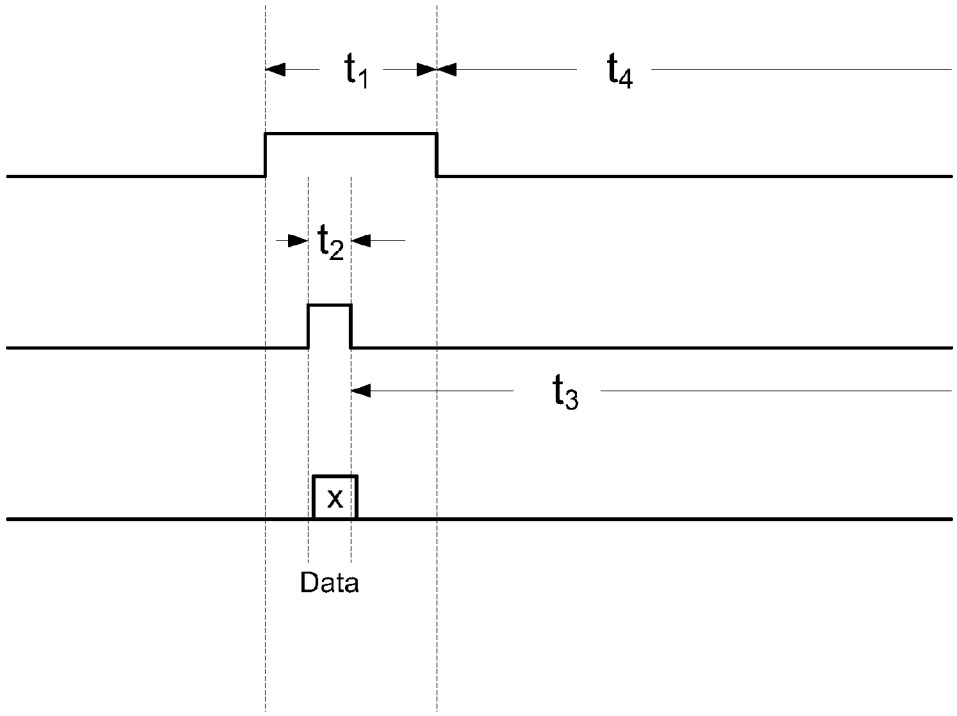
FIG. 22 shows a timing diagram for driving a pixel element in the active matrix display in accordance with some embodiments.

As examples, when the block 530 is applied to the active matrix display as shown FIGS. 2A-2D and FIGS. 10A-10B, if the selected pixel elements include the pixel elements 50AA, 50AB, and 50AC, the block 530 can include charging the capacitive element 54 in the selected pixel elements 50AA, 50AB, and 50AC. In one implementation, predetermined currents $I_d$(AA), $I_d$(AB), and $I_d$(AD) can be respectively applied to the column conducting lines 30A, 30B, and 30C for charging respectively the capacitive element 54 in the pixel elements 50AA, 50AB, and 50AC FIG. 22 shows a timing diagram for driving a pixel element in the active matrix display in accordance with some embodiments. In general, such pixel element includes (a) at least one switching transistor having a semiconductor channel, (b) at least one nonlinear element, and (c) at least one capacitive element. An exemplary pixel element can be similar to the pixel element 50AB as shown in FIGS. 2A-2D and FIG. 23. Other exemplary pixel elements include the pixel elements as shown in FIGS. 14A-14Q.

Figure 23:
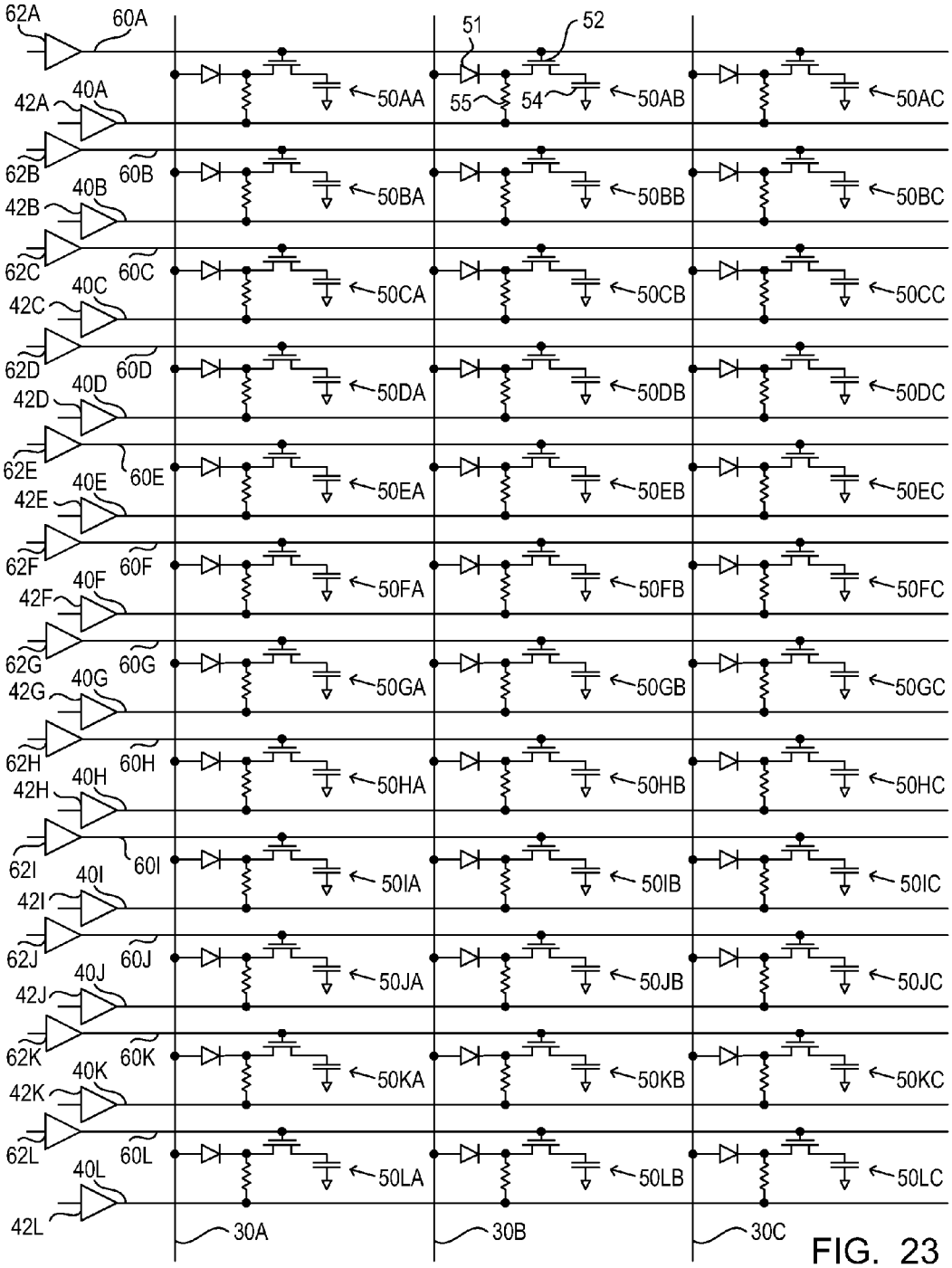
FIG. 23 is an implementation of active matrix displays that have enabling lines and nonlinear elements in pixel elements.

When a pixel element (e.g., the pixel element 50AB as shown in FIG. 2A or FIG. 23) is driven with the timing diagram as shown in FIG. 22, the semiconductor channel of the switching transistor 52 is driven into a conducting state from a non-conducting state, and the semiconductor channel is maintained at the conducting state during a first time period $t_1$. The nonlinear element 51 is driven into a conducting state from a non-conducting state, and the nonlinear element 51 is maintained at the conducting state during a second time period $t_2$ that is within the first time period $t_1$. While the semiconductor channel of the at least one switching transistor 52 maintains at the conducting state and the at least one nonlinear element 51 maintains at the conducting state, the capacitive element 54 is charged with a column conducting line 30B through the semiconductor channel of the switching transistor 52 and through the nonlinear element 51. After the second time period $t_2$, the nonlinear element 51 is driven into the non-conducting state from the conducting state, and the nonlinear element 51 is maintained at the non-conducting state during a third time period $t_3$. In FIG. 22, the semiconductor channel of the switching transistor 52 is driven into the non-conducting state from the conducting state, and the semiconductor channel is maintained at the non-conducting state during a fourth time period $t_4$ that is after the first time period $t_1$.

In general, when the semiconductor channel of the switching transistor 52 is at the non-conducting state during the fourth time period $t_4$, the change of the voltage across the capacitive element 54 due to any leakage current through the semiconductor channel of the switching transistor 52 can be generally neglected. When the nonlinear element 51 is at the non-conducting state after the beginning the third time period $t_3$, the change of the voltage across the capacitive element 54 due to any leakage current through the nonlinear element 51 can be generally neglected at least until the beginning of the fourth time period $t_4$. In some implementations, when the nonlinear element 51 is at the non-conducting state after the beginning the third time period $t_3$, the voltage across the capacitive element 54 can be substantially maintained at least until the beginning of the fourth time period $t_4$. In some other implementations, when the nonlinear element 51 is at the non-conducting state after the beginning of the third time period $t_3$, the residual conductivity of the nonlinear element 51 at the non-conducting state can be small enough such that the change of the voltage across the capacitive element 54 during the time period from the beginning of the third time period $t_3$ to the beginning of the fourth time period $t_4$ can be easily corrected. For example, when the nonlinear element 51 in the pixel element 50AB of FIG. 2A or FIG. 23 is at the non-conducting state during the time period from the beginning of the third time period $t_3$ to the beginning of the fourth time period $t_4$, if the residual conductivity of the nonlinear element 51 is significantly smaller than the conductivity of the resistive element 55, the change of the voltage across the capacitive element 54 during this time period can be easily corrected based on the RC time constant.

In one specific implementation, when the active matrix display in FIGS. 2A-2D operates following the timing diagram as shown in FIG. 21, the fourth time period $t_4$ of FIG. 22 can be at least two times as long as the first time period $t_1$ of FIG. 22. Taking the pixel element 50AB as an example, during a first predetermined time period T1, the semiconductor channel of the switching transistor 52 in the pixel element 50AB is driven into the conducting state from the non-conducting state and is maintained at the conducting state. At least during subsequent time periods T2 and T3, the semiconductor channel of the switching transistor 52 in the pixel element 50AB is driven into the non-conducting state from the conducting state and is maintained at the non-conducting state. In some specific implementations, the sum of the time periods T2 and T3 is about two times as long as the time period T1.

The active matrix display in FIGS. 2A-2D and the timing diagram as shown in FIG. 21 are merely some exemplary implementations. In some other implementations, the fourth time period $t_4$ can be at least four times as long as the first time period $t_1$. It can also be at least sixteen times as the first time period $t_1$, sixty four times as long as the first time period $t_1$, or any other time period the people skilled in the art would like to select.

In one specific implementation, an active matrix display has N rows of pixel elements divided into K sections. The fourth time period t4 can be selected to be K−1 times as long as the first time period $t_1$. In one example, in which an active matrix display has 12 rows of pixel elements divided into 3 sections, the fourth time period $t_4$ can be selected to be 2 times as long as the first time period $t_1$. In another example, in which an active matrix display has 1024 rows of pixel elements divided into 256 sections, the fourth time period $t_4$ can be selected to be 255 times as long as the first time period $t_1$. In another example, in which an active matrix display has 1024 rows of pixel elements divided into 128 sections, the fourth time period $t_4$ can be selected to be 127 times as long as the first time period $t_1$.

In one specific implementation, an active matrix display has N rows of pixel elements divided into K sections. The second time period $t_2$ can be selected to be about equal to $T_{frame}/N$ or somewhat smaller than $T_{frame}/N$, and the first time period $t_1$ can $T_{frame}/N$, be selected to be about $T_{frame}/K$, where $T_{frame}$ is one frame time period. In one example, in which an active matrix display has 12 rows of pixel elements divided into 3 sections, the second time period $t_2$ can be selected to be about $T_{frame}/12$, and the first time period $t_1$ can be selected to be about $T_{frame}/3$ or somewhat smaller than $T_{frame}/3$. In another example, an active matrix display has 1024 rows of pixel elements divided into 256 sections, the second time period $t_2$ can be selected to be about $T_{frame}/1024$ or somewhat smaller, and the first time period $t_1$ can be selected to be about $T_{frame}/256$ or somewhat smaller than $T_{frame}/256$. In another example, an active matrix display has 1024 rows of pixel elements divided into 128 sections, the second time period $t_2$ can be selected to be about $T_{frame}/1024$ or somewhat smaller, and the first time period $t_1$ can be selected to be about $T_{frame}/128$ or somewhat smaller than $T_{frame}/128$.

In some other implementations, an active matrix display has N rows of pixel elements and it does not need to be divided into sections. The second time period $t_2$ can be selected to be about equal to $T_{frame}/N$ or somewhat smaller than $T_{frame}/N$, and the first time period $t_1$ can be selected to be about K times of $t_2$, that is, $t_1=Kt_2$, where K generally can be selected to be a positive real number (i.e., not just an integer) that is larger than 1.2, 2.0, 3.0, 4.0, 8.0, 16.0, 32.0, 64.0, 128.0, or 256.0.

Figure 24A:
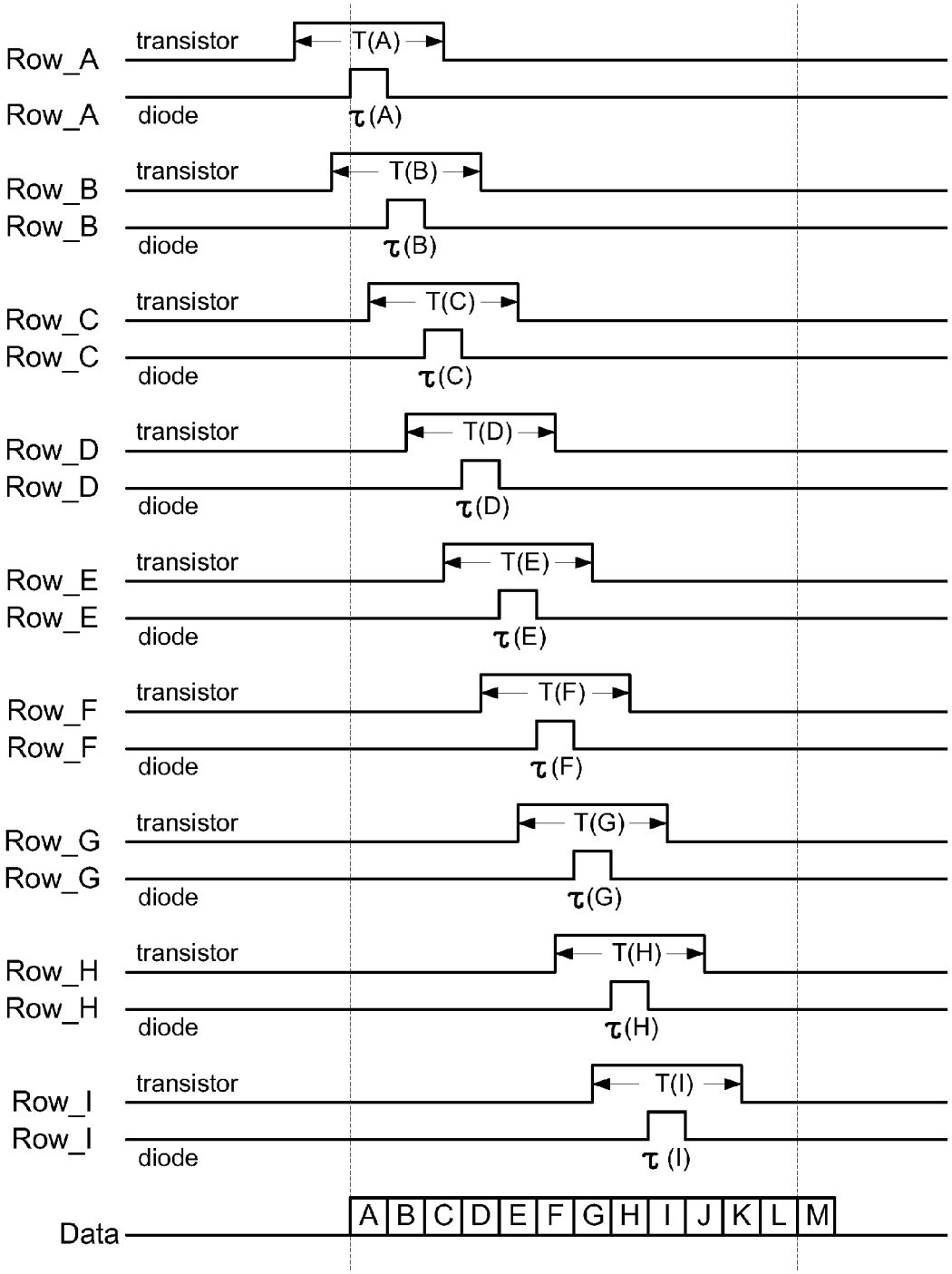
FIGS. 24A-24B and FIGS. 25A-25B depicts some timing diagrams to illustrate the method for driving an active matrix display in accordance with some embodiments.
Figure 24B:
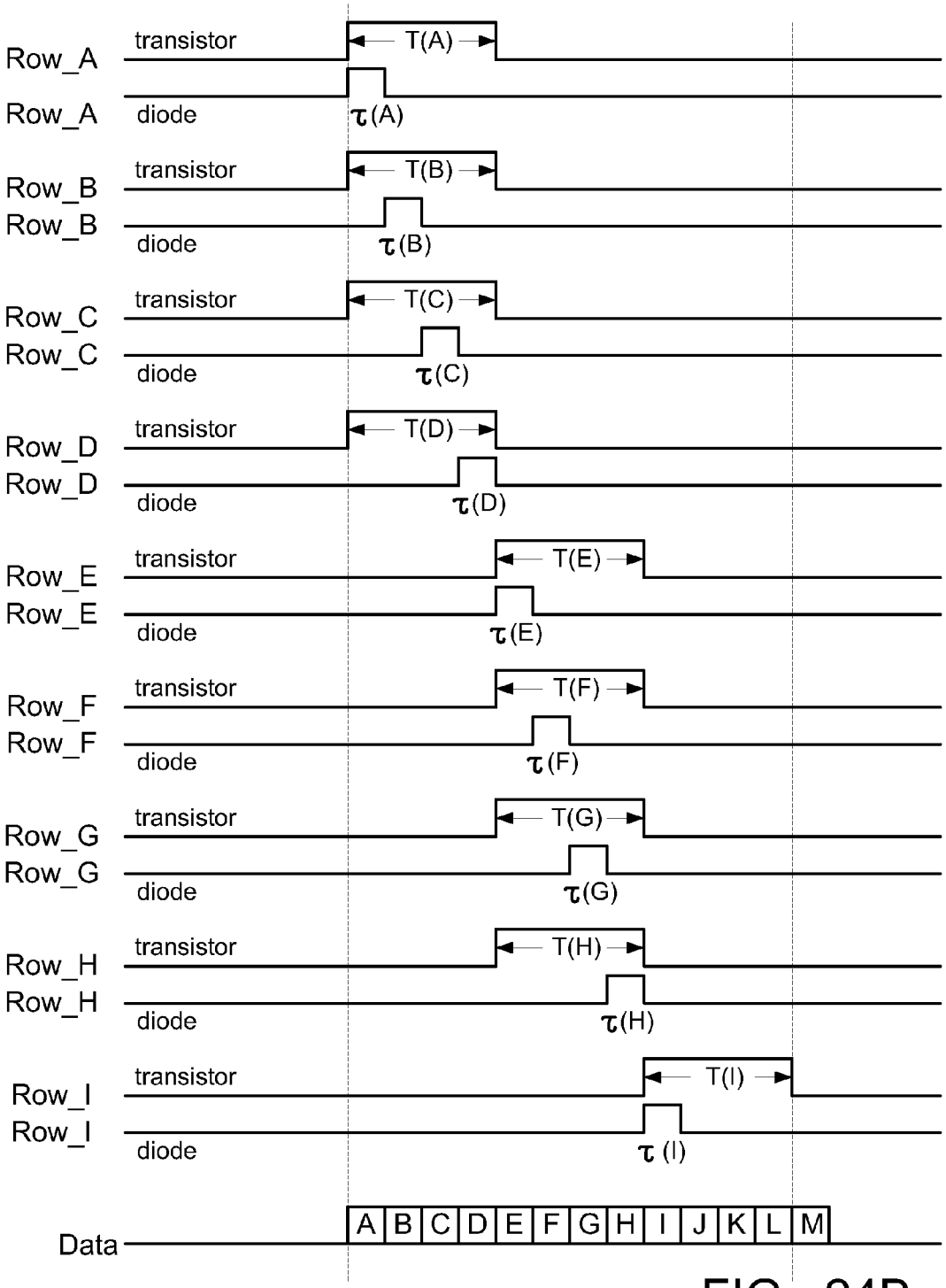

FIGS. 24A-24B each depicts a timing diagram to illustrate a method for driving an active matrix display in accordance with some embodiments. Such method for driving an active matrix display as illustrated by the timing diagram of FIGS. 24A-24B can be applied to an exemplary display device as shown in FIG. 23. In FIGS. 24A-24B, each row of pixel elements is allocated with a corresponding allocated time period τ and is associated with a corresponding associated time period T. For example, the rows A, B, C, D, and E are respectively allocated with the allocated time periods τ(A), τ(B), τ(C), τ(D), and τ(E), and the rows A, B, C, D, and E are also respectively associated with the associated time periods T(A), T(B), T(C), T(D), and T(E). For each of the pixel elements in these rows, the corresponding allocated time period is smaller than the corresponding associated time period, and the corresponding allocated time period is within the corresponding associated time period. In an exemplary implementation, for each of the rows as shown in FIGS. 24A-24B, the corresponding associated time period is about four times as long as the corresponding allocated time period. In other implementations, the associated time period for a given pixel element can be K times of the corresponding allocated time period, such as, T(A)=K τ(A), with K being a real number that can be selected to be larger than 1.2, 2.0, 3.0, 4.0, 8.0, 16.0, 32.0, 64.0, 128.0, or 256.0. In the exemplary implementation as shown in FIGS. 24A-24B, the associated time periods T(A), T(B), T(C), T(D), and T(E) each overlap with at least three other associated time periods.

In one example, a column of pixel elements (e.g., the column B) in FIG. 23 can be driven with the method as illustrated by the timing diagram of FIGS. 24A-24B. In FIGS. 24A-24B, the methods includes selecting a first pixel element 50AB for charging the first pixel element 50AB with a first pixel data applied to the column conducting line 30B during a first allocated time period τ(A) while the semiconductor channel of the at least one switching transistor in the first pixel element 50AB maintains at the conducting state and the at least one nonlinear element in the first pixel element 50AB maintains at the conducting state. To select the first pixel element 50AB for charging, the method includes driving the semiconductor channel of the at least one switching transistor in the first pixel element 50AB into the conducting state from the non-conducting state, and maintaining the semiconductor channel of the at least one switching transistor in the first pixel element 50AB at the conducting state for duration of a first associated time period T(A). To select the first pixel element 50AB for charging, the method also includes driving the at least one nonlinear element in the first pixel element 50AB into the conducting state from the non-conducting state, and maintaining the at least one nonlinear element in the first pixel element 50AB at the conducting state for a duration of the first allocated time period τ(A) that is within the first associated time period T(A).

In FIGS. 24A-24B, the methods includes selecting a second pixel element 50BB 50BB for charging the second pixel element 50BB with a second pixel data applied to the column conducting line 30B during a second allocated time period τ(B) while the semiconductor channel of the at least one switching transistor in the second pixel element 50BB maintains at the conducting state and the at least one nonlinear element in the second pixel element 50BB maintains at the conducting state, and wherein the second allocated time period τ(B) is after the first allocated time period τ(A). To select the second pixel element 50BB for charging, the method includes driving the semiconductor channel of the at least one switching transistor in the second pixel element 50BB into the conducting state from the non-conducting state, and maintaining the semiconductor channel of the at least one switching transistor in the second pixel element 50BB at the conducting state for duration of a second associated time period T(B). To select the second pixel element 50BB for charging, the method also includes driving the at least one nonlinear element in the second pixel element 50BB into the conducting state from the non-conducting state, and maintaining the at least one nonlinear element in the second pixel element 50BB at the conducting state for a duration of the second allocated time period τ(B) that is within the second associated time period T(B).

In FIGS. 24A-24B, the methods includes selecting a third pixel element 50CB for charging the third pixel element 50CB with a third pixel data applied to the column conducting line 30B during a third allocated time period τ(C) while the semiconductor channel of the at least one switching transistor in the third pixel element 50CB maintains at the conducting state and the at least one nonlinear element in the third pixel element 50CB maintains at the conducting state, and wherein the third allocated time period τ(C) is after the second allocated time period τ(B).

In FIGS. 24A-24B, the methods includes selecting a fourth pixel element 50DB for charging the fourth pixel element 50DB with a fourth pixel data applied to the column conducting line 30B during a fourth allocated time period τ(D) while the semiconductor channel of the at least one switching transistor in the fourth pixel element 50DB maintains at the conducting state and the at least one nonlinear element in the fourth pixel element 50DB maintains at the conducting state, and wherein the fourth allocated time period τ(D) is after the third allocated time period τ(C).

In FIGS. 24A-24B, the methods includes selecting a fifth pixel element 50EB for charging the fifth pixel element 50EB with a fifth pixel data applied to the column conducting line 30B during a fifth allocated time period τ(E) while the semiconductor channel of the at least one switching transistor in the fifth pixel element 50EB maintains at the conducting state and the at least one nonlinear element in the fifth pixel element 50EB maintains at the conducting state, and wherein the fifth allocated time period τ€ is after the fourth allocated time period τ(D).

In FIGS. 24A-24B, the allocated time periods τ(A), τ(B), τ(C), τ(D), and τ(E) do not overlaps with each other, the pixel data applied to the column conducting line 30B can be in the form of a predetermined current or a predetermined voltage. In some implementations, as shown in FIGS. 25A-25B, when the pixel data applied to the column conducting line 30B is in the form of a predetermined voltage, the allocated time periods τ(A), τ(B), τ(C), τ(D), and τ(E) can overlap with each other.

Figure 25A:
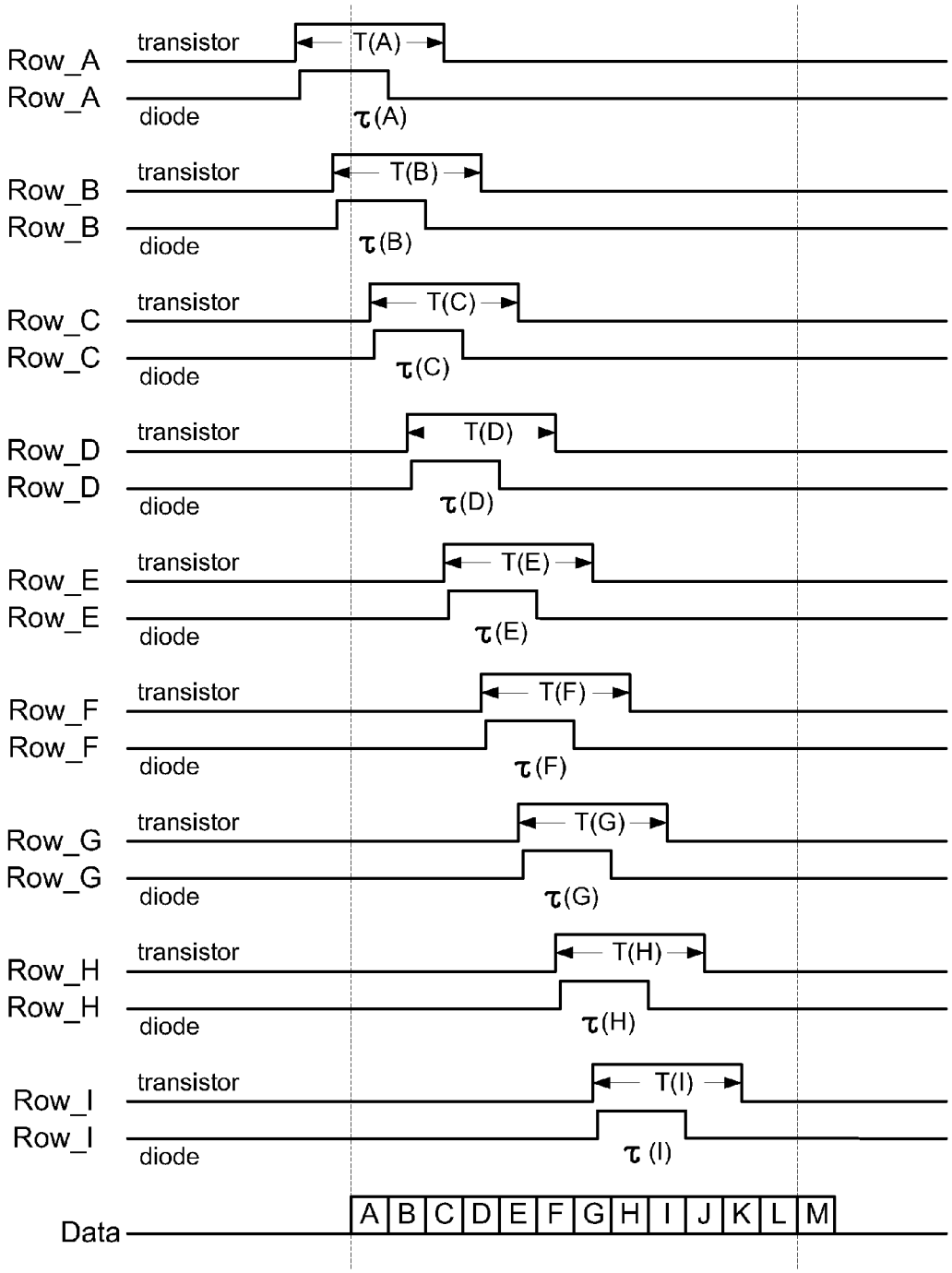
Figure 25B:
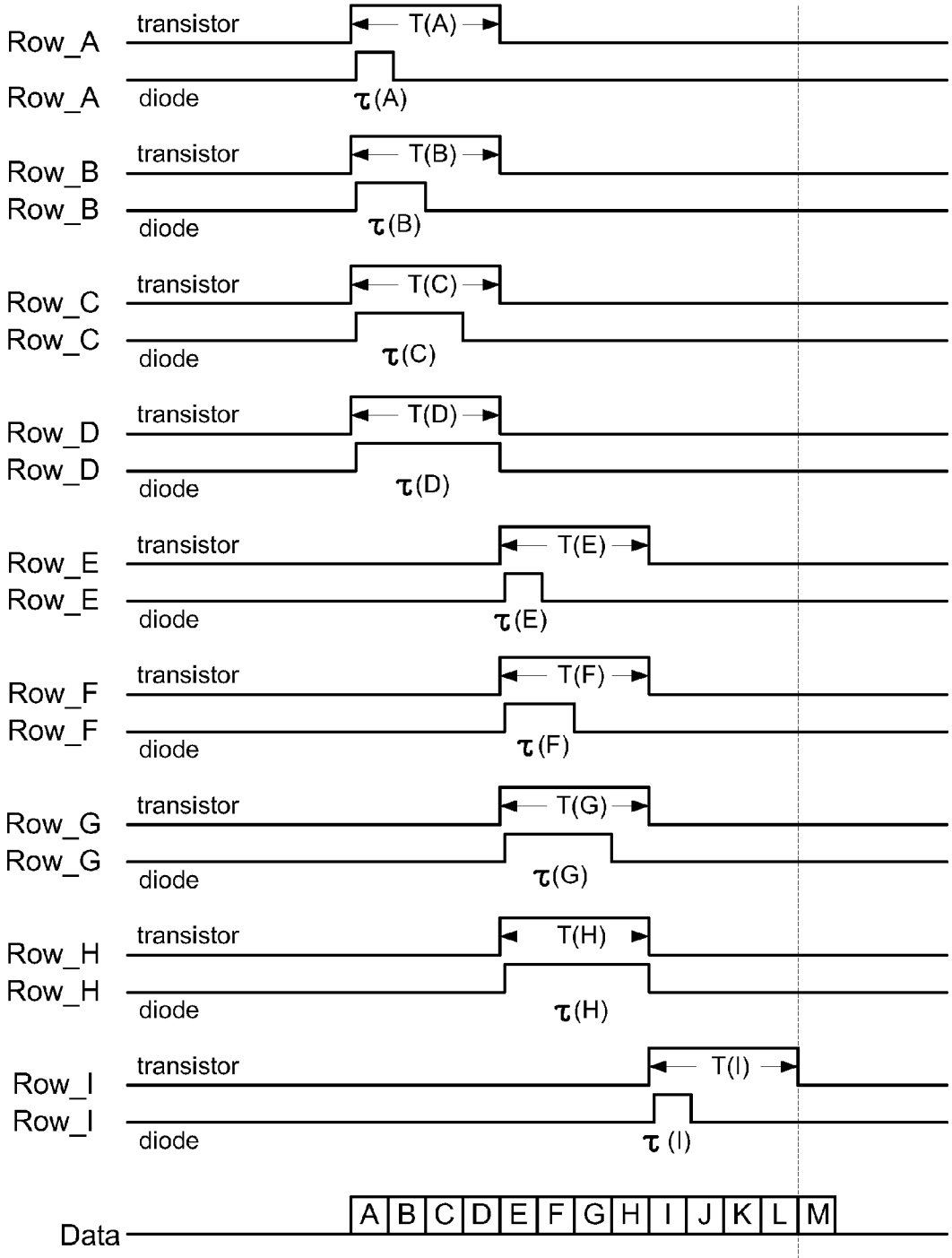

In FIGS. 25A-25B, the endings of the allocated time periods τ(A), τ(B), τ(C), τ(D), and τ(E) are sequentially delayed from each other with sufficient time to allow the predetermined voltage on the column conducting line 30B be applied to the capacitive element in each corresponding pixel element. For example, because the allocated time period τ(A) overlaps with the allocated time period τ(B), during the allocated time period τ(A), the predetermined voltage on the column conducting line 30B for the pixel element 50AB can be applied to the capacitive elements in both the capacitive element 50AB and the capacitive element 50BB. At the end of the allocated time period τ(A), the predetermined voltage for the pixel element 50AB is written into (or otherwise "frozen into") the pixel element 50AB. After the end of the allocated time period τ(A), the predetermined voltage on the column conducting line 30 for the pixel element 50AB is applied to the capacitive elements in both the capacitive element 50BB and possibly other pixel elements. If there is sufficient delay between the end of the allocated time period τ(A) and the end of the allocated time period τ(B), at the end of the allocated time period τ(B), the predetermined voltage for the pixel element 50BB can be written into (or otherwise "frozen into") the pixel element 50BB.

In FIGS. 24A-24B and FIGS. 25A-25B, the changes of the conducting states for the switching transistors and the nonlinear elements are illustrated. These changes of the conducting states for the switching transistors and the nonlinear elements can be achieved by applying signals with variety kinds of waveforms to the array of row conducting lines and the array of enabling lines. These signals applied to the array of row conducting lines and the array of enabling lines can be in the form of rectangular pulses or other kinds of pulses with ramp-ups and ramp-downs. The changes of the conducting states for the switching transistors and the nonlinear elements generally can have delays from the signals applied to the array of row conducting lines and the array of enabling lines.

The implementations of the pixel elements descried in Applicant's instant applications are merely examples. The methods descried in Applicant's instant applications can be applied to many other kinds of pixel elements. In particular, if a current design or a future design of certain pixel element includes an FET linear switch for controlling a data signal applied to a storage capacitor, after such pixel element is modified by replacing such FET linear switch with a linear switch that includes a nonlinear element and a switching transistor, the modified pixel element generally can be controlled by some implementations of the methods as descried in Applicant's instant applications.

Figure 26A:
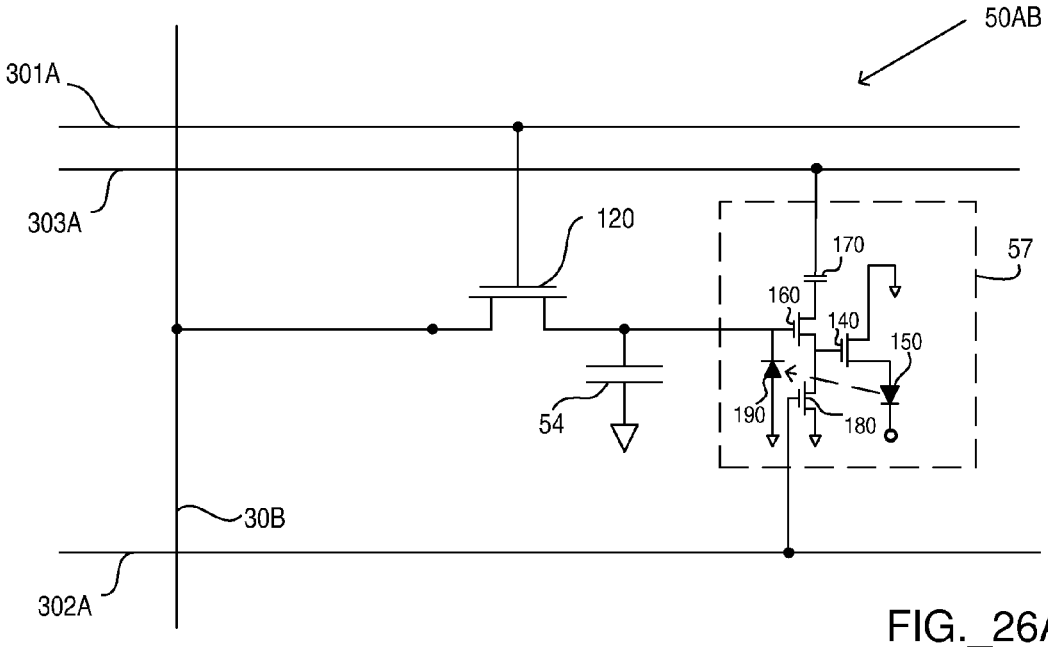
FIG. 26A is a pixel element that includes an FET linear switch for controlling a data signal applied to a storage capacitor in accordance with some embodiments.
Figure 27A:
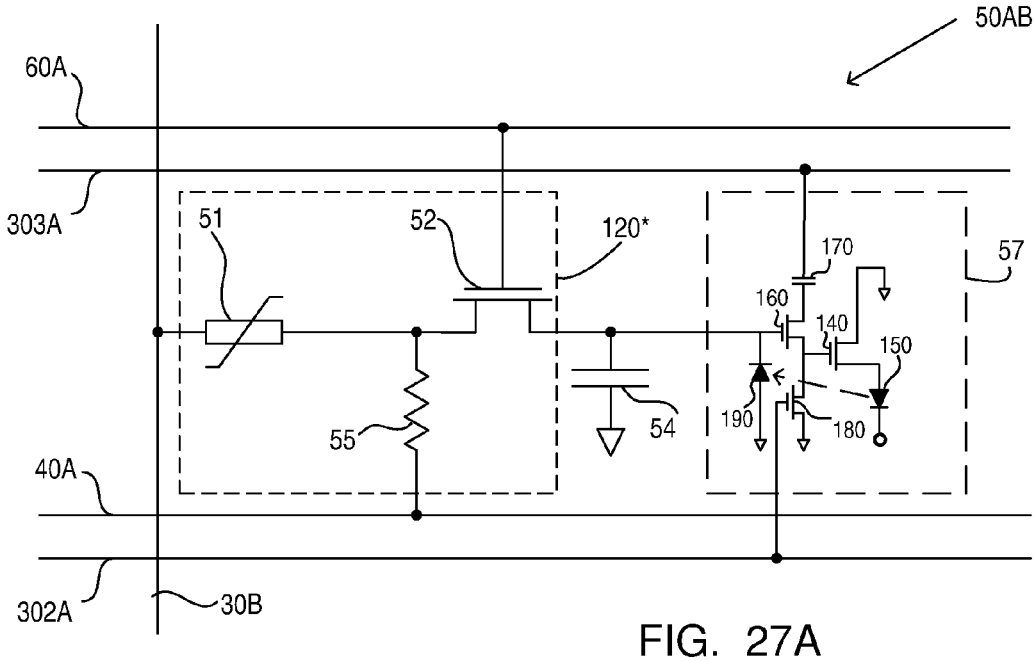
FIG. 27A is a modified pixel element in which a compound-switch is used to substitute the FET linear switch in the pixel element of FIG. 26A in accordance with some embodiments.
Figure 27B:
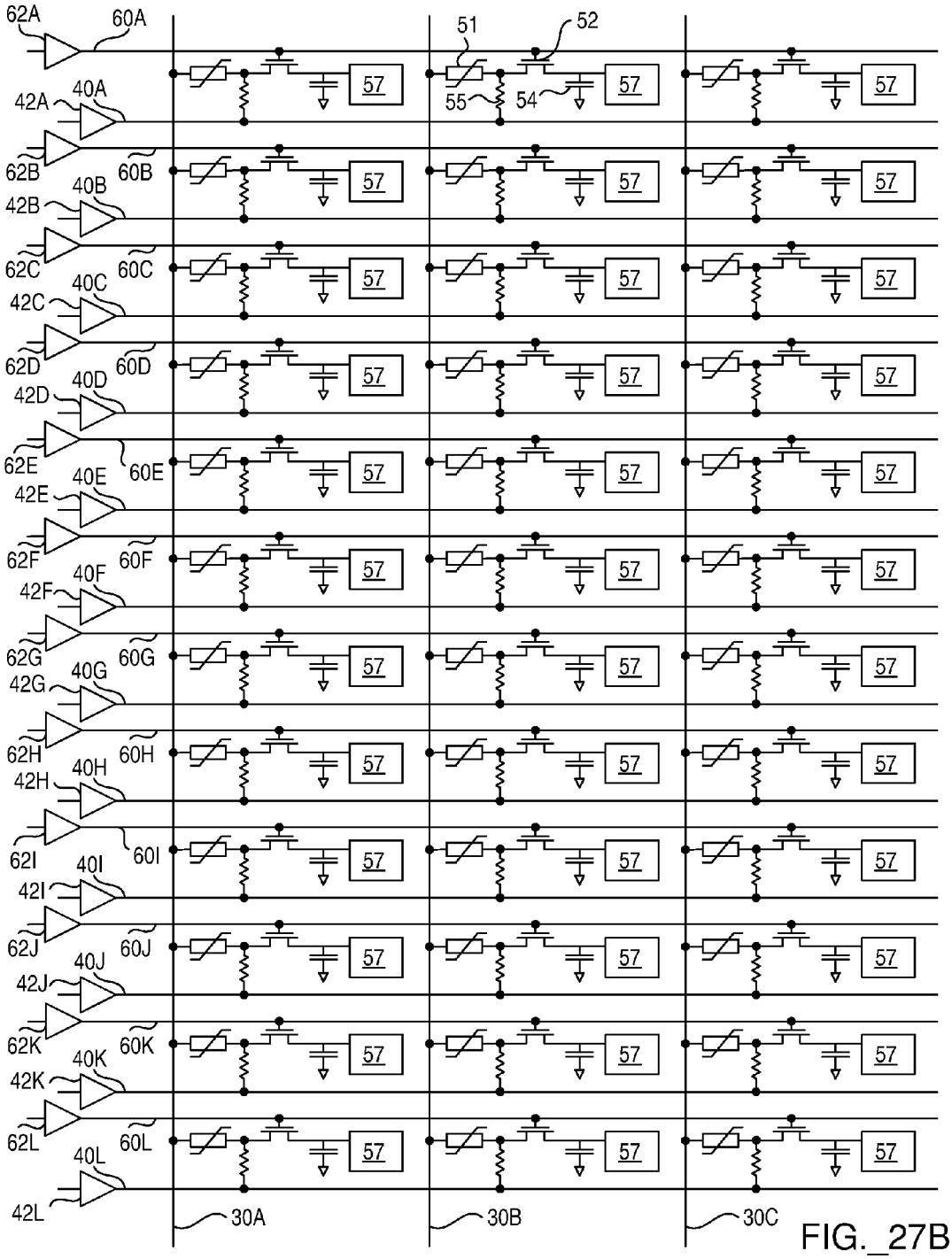
FIG. 27B is a matrix of the pixel elements in which the pixel element is implemented as shown in FIG. 27A in accordance with some embodiments.

In one example, the pixel element in FIG. 26A includes an FET linear switch 120 for controlling a data signal applied to a storage capacitor 130 from a column conducting line 30B. After such pixel element is modified by replacing such FET linear switch 120 with a compound-switch 120* that includes a nonlinear element 51 and a switching transistor 52, this modified pixel element 50AB (as shown in FIG. 27A) can be used in the active matrix display of FIG. 27B and it can be controlled by some implementations of the methods as descried in Applicant's instant applications. In FIG. 27B, only the row conducting lines 40A-40L for controlling the nonlinear element 51 and the row conducting lines 60A-60L for controlling the switching transistor 52 are shown in the figure. In FIG. 27B, the pixel-sub-circuit 57 sometimes may need to be controlled by other row conducting lines, and these additional row conducting lines (if needed) for controlling the pixel-sub-circuit 57 are not explicitly shown and these conducting lines are neglected in order to maintain the clarity of the figure.

Figure 26B:
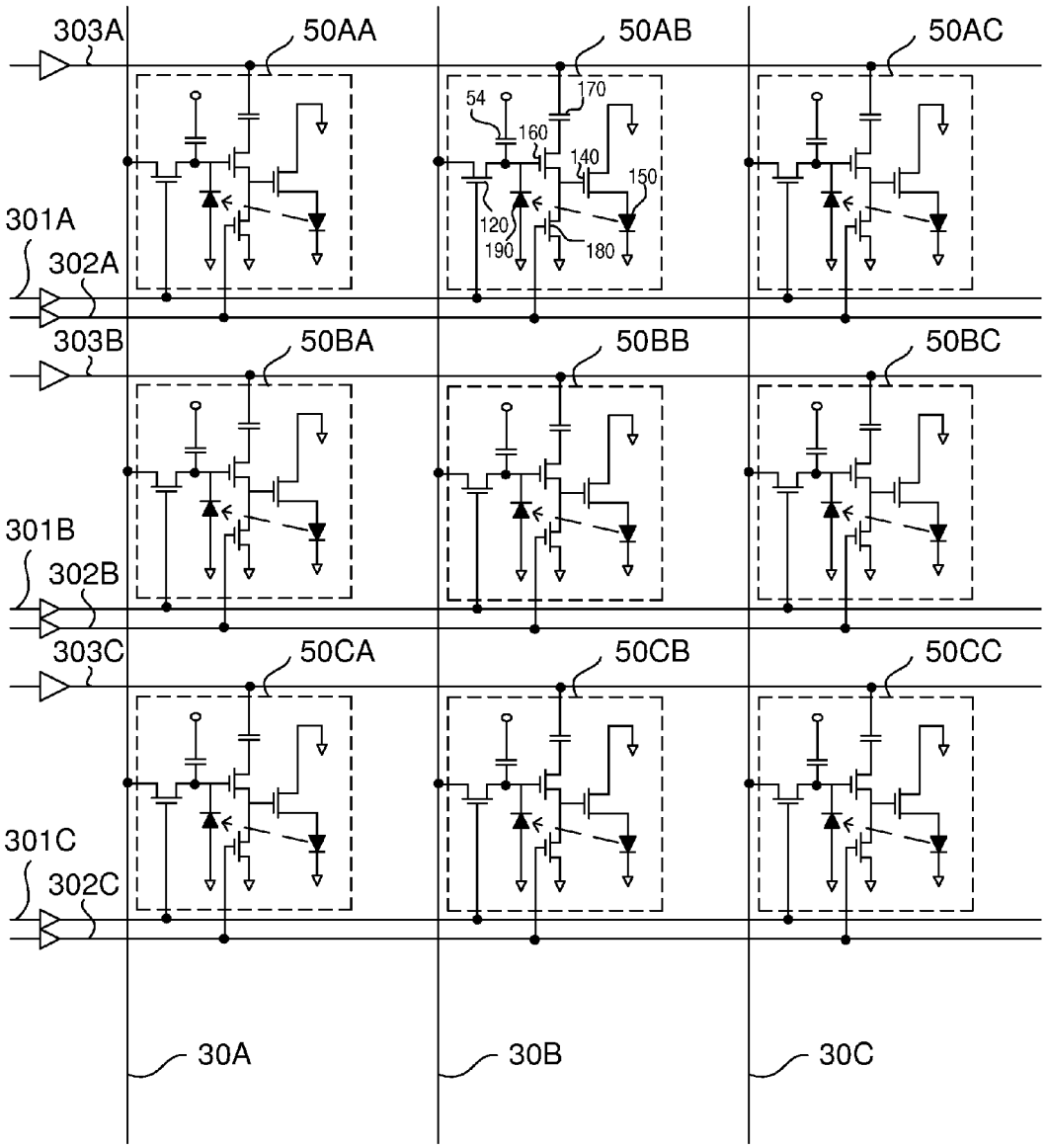
FIG. 26B is a matrix of the pixel elements in which the pixel element is implemented as shown in FIG. 26A in accordance with some embodiments.

The operation principle of the pixel element in FIG. 26A, when used in the active matrix display of FIG. 26B, is described in more details in U.S. patent application Ser. Nos. 12/404,326, 12/404,327, 12/404,328, and 12/404,329, which are all filed on Mar. 15, 2009, by the same inventor as present application. The entire content of U.S. patent application Ser. Nos. 12/404,326, 12/404,327, 12/404,328, and 12/404,329 are incorporated herein by reference.

Figure 26C:
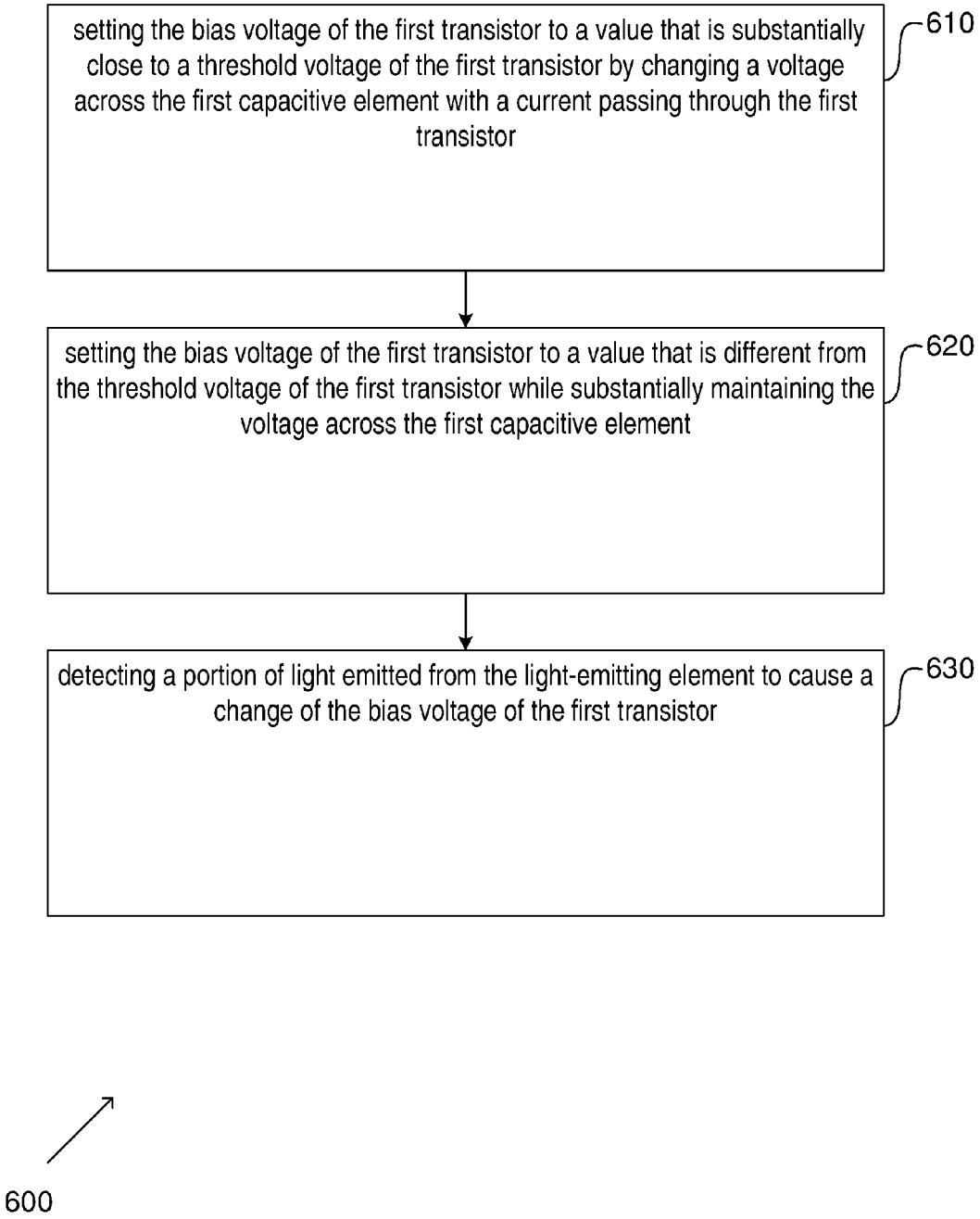
FIG. 26C is a flow chart summarizing an operation of the pixel element in FIG. 26A in accordance with some embodiments.

In one implementation, the operation of the pixel element in FIG. 26A is summarized in FIG. 26C. As shown in FIG. 26C, at block 610, the bias voltage of the first transistor 160 is set to a value that is substantially close to a threshold voltage of the first transistor 160 by changing a voltage across the first capacitive element 170. Next, at the block 620, the bias voltage of the first transistor 160 is set to a value that is different from the threshold voltage of the first transistor 160 by applying a data voltage to the second capacitor 54 through the switching transistor 120 (which function as a linear switch), while substantially maintaining the voltage across the first capacitive element 170. Finally, at the block 630, a portion of light emitted from the light-emitting element 150 is detected by the photo-detecting element 190 to cause a change of the bias voltage of the first transistor 160. When the bias voltage of the first transistor 160 again reaches the threshold voltage of the first transistor 160, light emitted from the light-emitting element 150 will be stopped.

When the pixel element in FIG. 26A is modified by replacing the FET linear switch 120 with a compound-switch 120* that includes a nonlinear element 51 and a switching transistor 52, it becomes modified pixel element as shown in FIG. 27A; when this modified pixel element is used in the active matrix display as shown in FIG. 27B, the operation on this modified pixel element needs to be somewhat modified accordingly. Specifically, if the FET linear switch 120 needs to be kept at non-conducting state during a given operation on the pixel element in FIG. 26A, then, the compound-switch 120 needs to be kept at non-conducting state during the corresponding given operation on the modified pixel element in FIG. 27A; alternatively, if the FET linear switch 120 needs to be kept at conducting state during a given operation on the pixel element in FIG. 26A, then, the compound-switch 120* needs to be kept at conducting state during the corresponding given operation on the modified pixel element in FIG. 27A. Here, the compound-switch 120* is in conducting state when both the switching transistor 52 and the nonlinear element 51 of the compound-switch are in conducting state; the compound-switch 120* is in non-conducting state if the compound-switch 120* is not in conducting state. In FIG. 27A, the compound-switch 120* in the modified pixel element 50 AB is controlled by the row conducting lines 40A and 60**A.

For example, in FIG. 26C at the block 620, during the given operation on the pixel element in FIG. 26A, the bias voltage of the first transistor 160 is set to a value that is different from the threshold voltage of the first transistor 160 by applying a data voltage to the second capacitor 130 through the switching transistor 120 (which function as a linear switch) while the switching transistor 120 is in conducting state. During the corresponding given operation on the modified pixel element in FIG. 27A, the bias voltage of the first transistor 160 is set to a value that is different from the threshold voltage of the first transistor 160 by applying a data voltage to the capacitive element 54 through the compound-switch 120* while the compound-switch 120* is in conducting state by keeping both the switching transistor 52 and the nonlinear element 51 in conducting state. After applying a data voltage to the capacitive element 54 through the compound-switch 120*, the nonlinear element 51 is driven into non-conducting state from conducting state, and the semiconductor channel of the switching transistor 52 is driven into non-conducting state from conducting state for settling the semiconductor channel into non-conducting state after the nonlinear element 51 is settled into non-conducting state.

Additionally, during the operations on the modified pixel element in FIG. 27A, before a data voltage applied to the capacitive element 54 can passes through the compound-switch 120*, both the semiconductor channel of the switching transistor 52 and the nonlinear element 51 are settled into conducting state. In the preferred embodiments, the semiconductor channel of the switching transistor 52 is settled into conducting state before the nonlinear element 51 is settled into conducting state. For the purpose of setting both the semiconductor channel of the switching transistor 52 and the nonlinear element 51 into conducting state, in some embodiments (which is not so commonly used in many of the methods described in the instant Application), it is possible to have an implementation in which the semiconductor channel of the switching transistor 52 is settled into conducting state after the nonlinear element 51 is settled into conducting state.

Figure 27C:
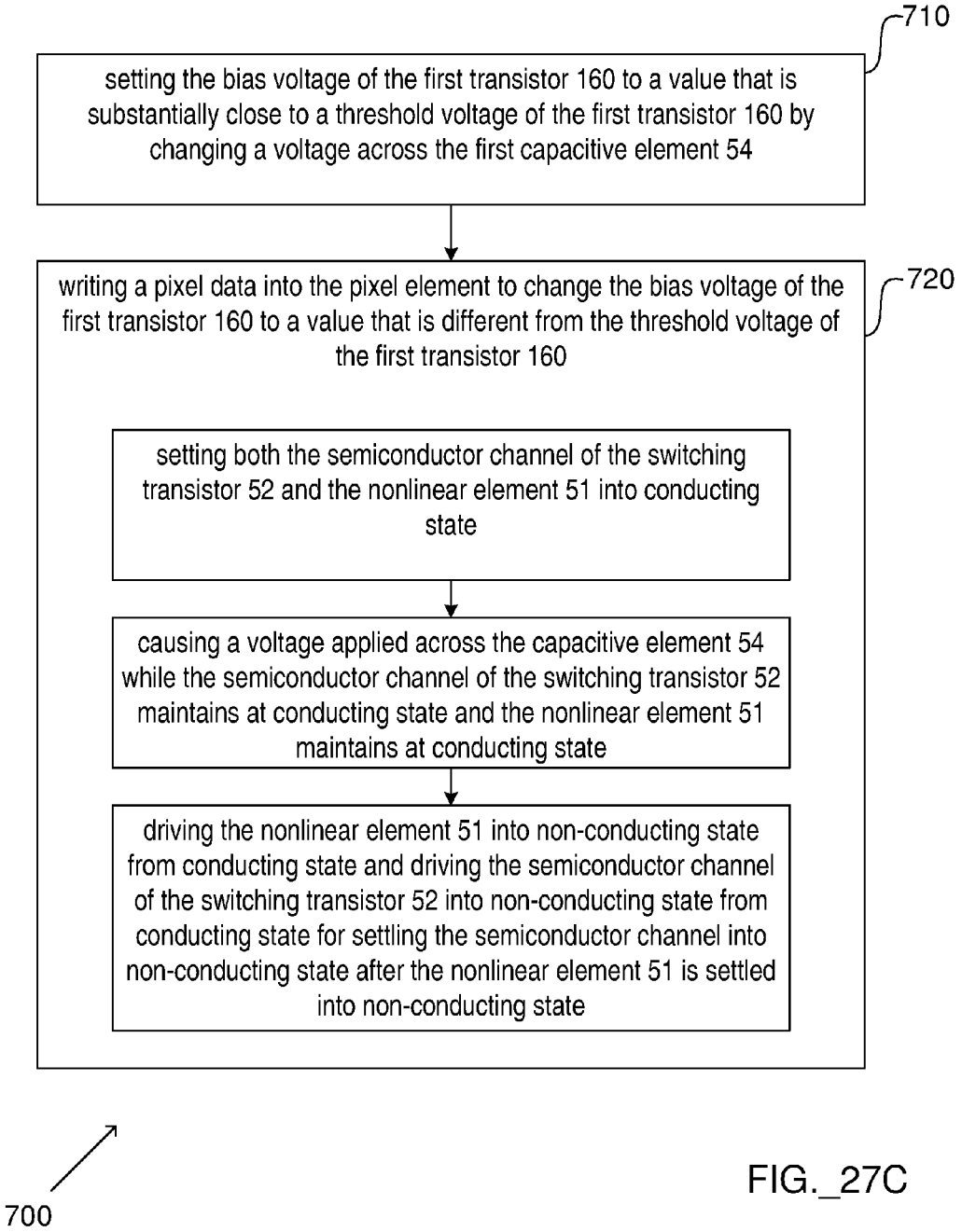
FIG. 27C and FIG. 27D are flow charts to illustrate a method for driving a pixel element having a compound-switch in accordance some embodiments.

FIG. 27C is a flow chart to illustrate a method 700 for driving the modified pixel element in FIG. 27A in accordance some embodiments. The method 700 includes steps 710 and 720. The step 710 includes setting the bias voltage of the first transistor 160 to a value that is substantially close to a threshold voltage of the first transistor 160 by changing a voltage across the first capacitive element 54. The step 720 includes writing a pixel data into the pixel element to change the bias voltage of the first transistor 160 to a value that is different from the threshold voltage of the first transistor 160. In some implementations, the writing step further includes the following steps: (1) the step of setting both the semiconductor channel of the switching transistor 52 and the nonlinear element 51 into conducting state; (2) the step of causing a voltage applied across the capacitive element 54 while the semiconductor channel of the switching transistor 52 maintains at conducting state and the nonlinear element 51 maintains at conducting state; and (3) the step of driving the nonlinear element 51 into non-conducting state from conducting state and driving the semiconductor channel of the switching transistor 52 into non-conducting state from conducting state for settling the semiconductor channel into non-conducting state after the nonlinear element 51 is settled into non-conducting state.

The method 700 generally also includes a step of causing the light-emitting element 150 to emit light. Before the light-emitting element 150 is caused to emit light, light-emitting element 150 can be prevented from emitting light by applying a control signal to row conducting line 302A. In some implementations, the light-emitting element 150 is prevented from emitting light during the step 710. In some implementations, the light-emitting element 150 is prevented from emitting light before the step 720. In some implementations, the light-emitting element 150 is prevented from emitting light during both the step 710 and the step 720. In some implementations, the light-emitting element 150 is prevented from emitting light before the operation at the step 720 is finished. In some implementations, the light-emitting element 150 is prevented from emitting light at least after the start of the operation at the step 710 (e.g., the emitting of light may be prevented even before the start of the operation at the step 710), and the light-emitting element 150 is caused to emit light only after the operation at the step 720 is finished.

Figure 27D:
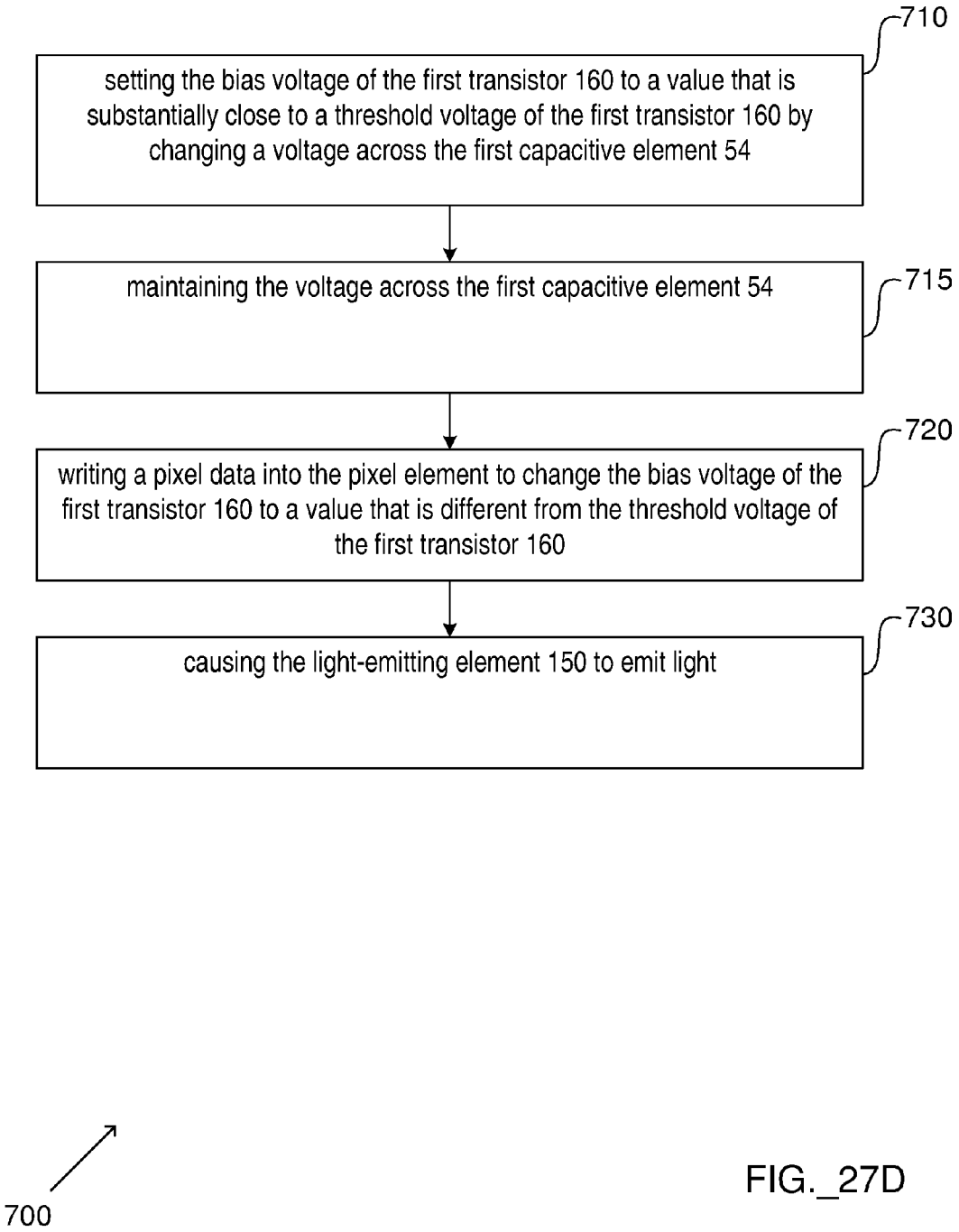
Figure 28A:
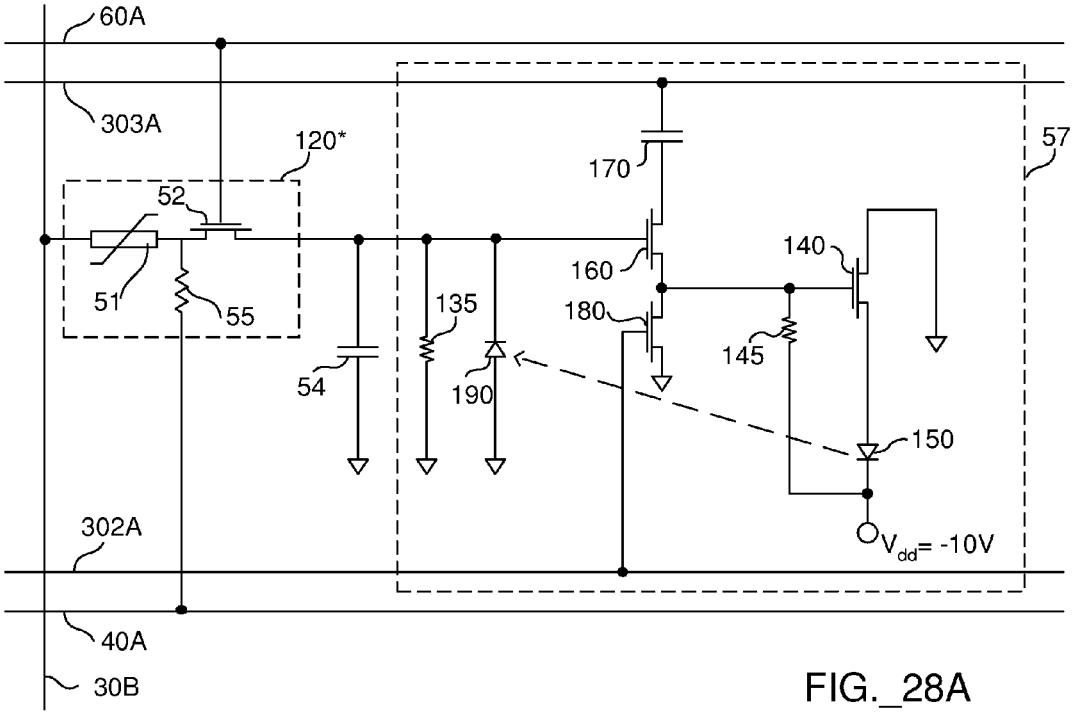
FIGS. 28A-28H and FIG. 29 illustrate some exemplary pixel elements that can be driven with the method as shown in FIG. 27C or FIG. 27D in accordance some embodiments.
Figure 28B:
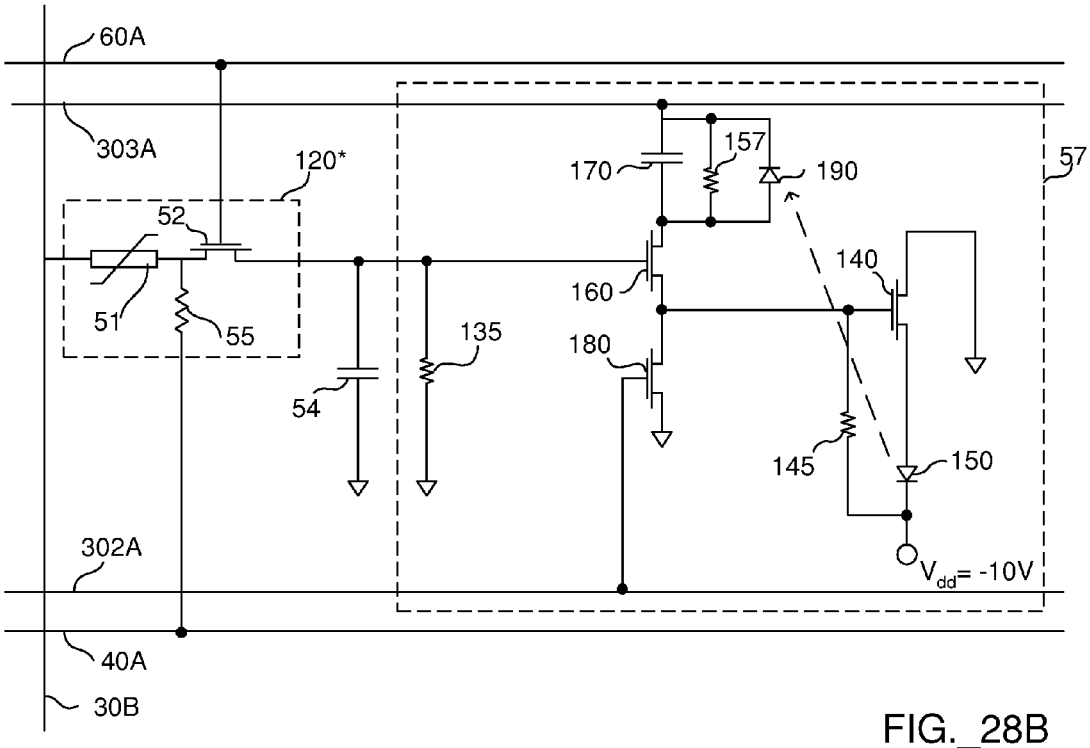
Figure 28C:
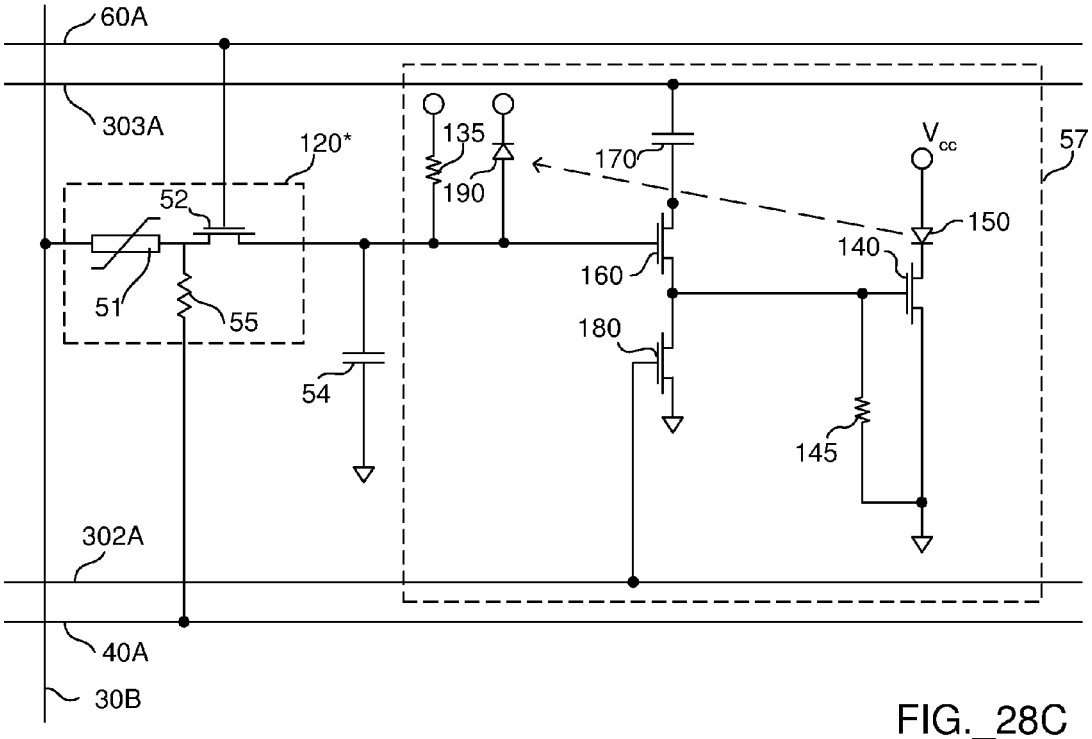
Figure 28D:
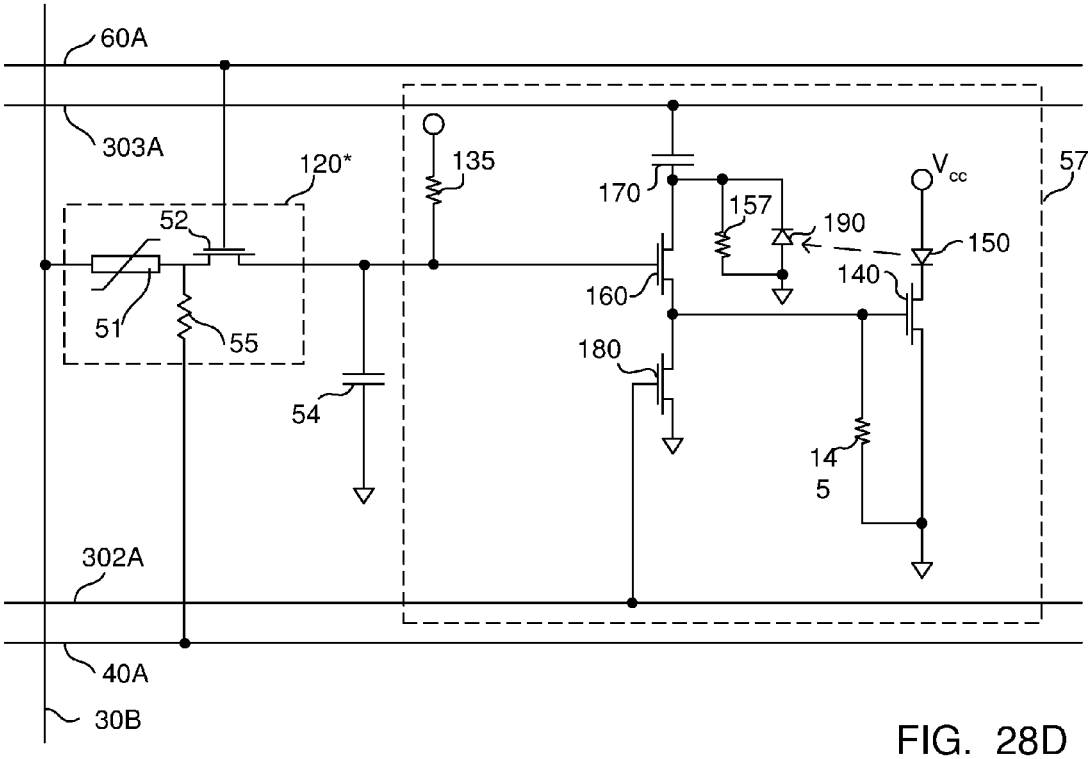
Figure 28E:
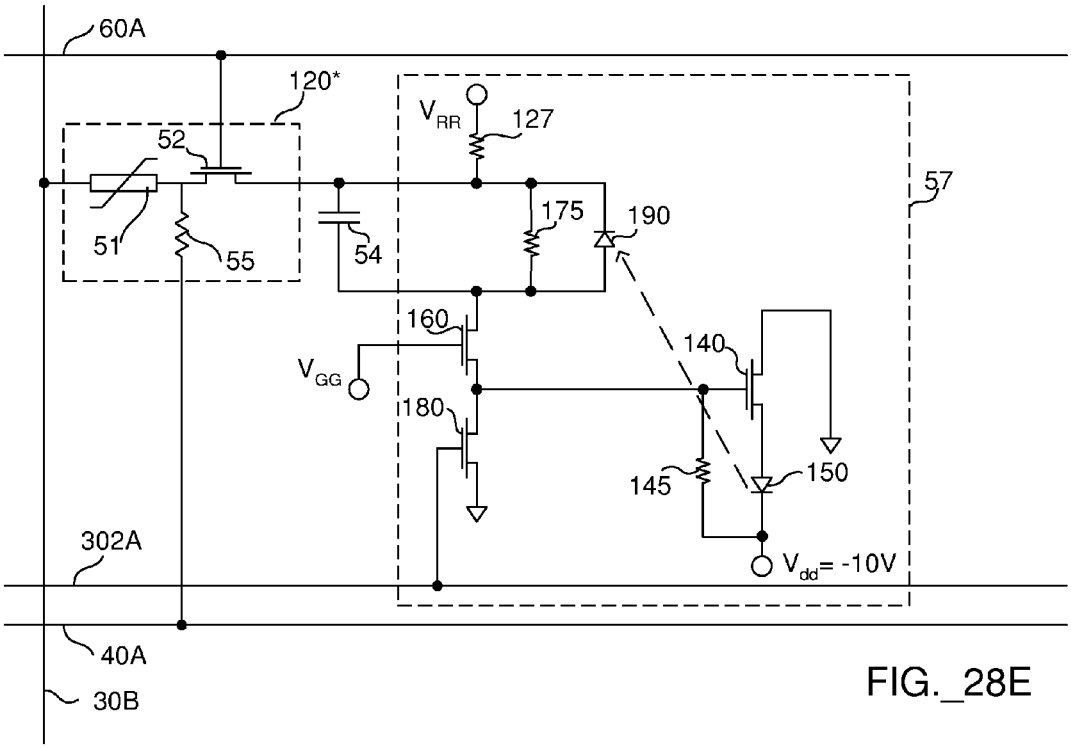
Figure 28F:
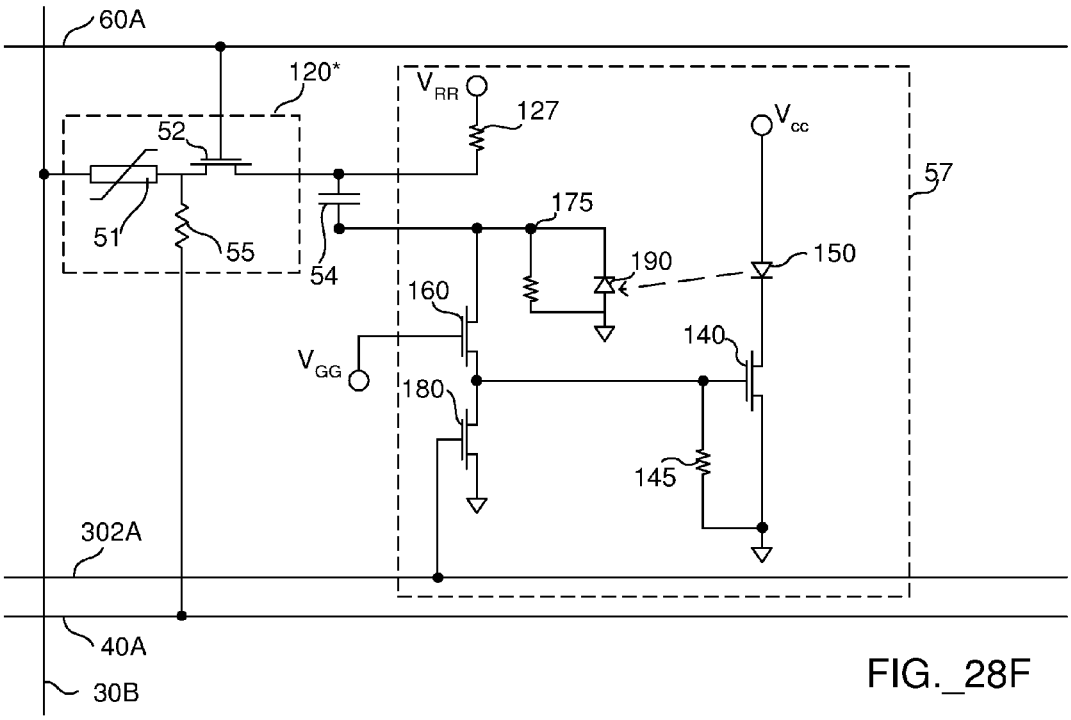
Figure 28G:
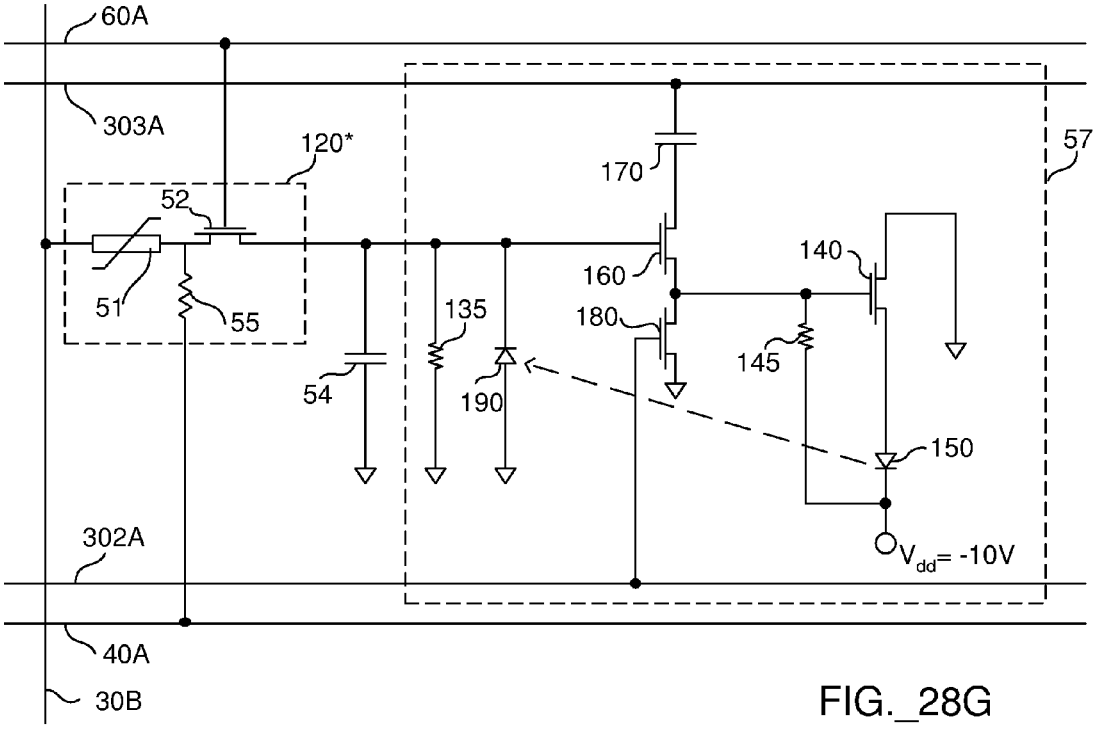
Figure 28H:
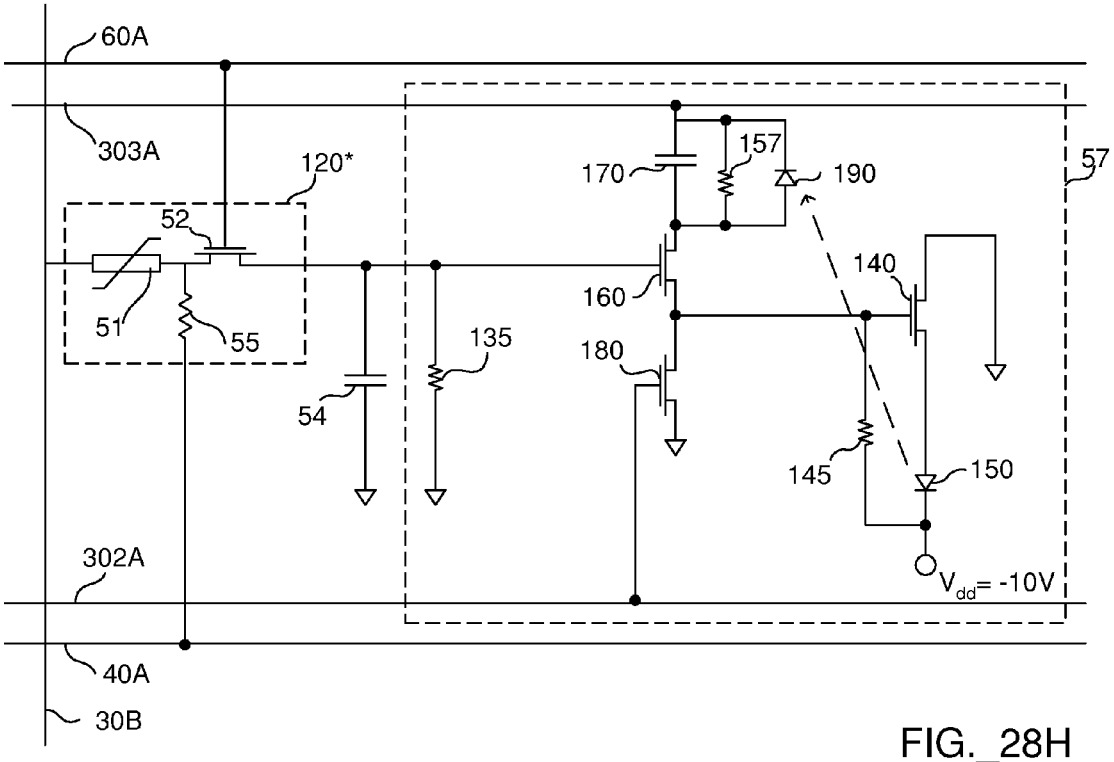

In some implementations of the method 700, as shown in FIG. 27D, the method 700 can have a step 715 that includes maintaining the voltage across the first capacitive element 54 and have a step 730 that includes causing the light-emitting element 150 to emit light. In the specific implementation as shown in FIG. 27D, the step 715 is implemented between the step 710 and 720, and the 730 is implemented after the step 720.

The modified pixel element in FIG. 27A is just one specific example for applying the method 700 to a pixel element in an active matrix display. The method 700 can be applied to many other different designs or implementations of pixel elements. For example, the method 700 can be applied to the pixel elements in FIGS. 28A-28H and FIG. 29. Each of the pixel elements in FIGS. 28A-28H and FIG. 29 includes a compound-switch 120* that includes a nonlinear element 51 and a switching transistor 52. In these pixel elements, the compound-switch 120* is controlled by row conducting lines 40A and 60A.

Figure 29:
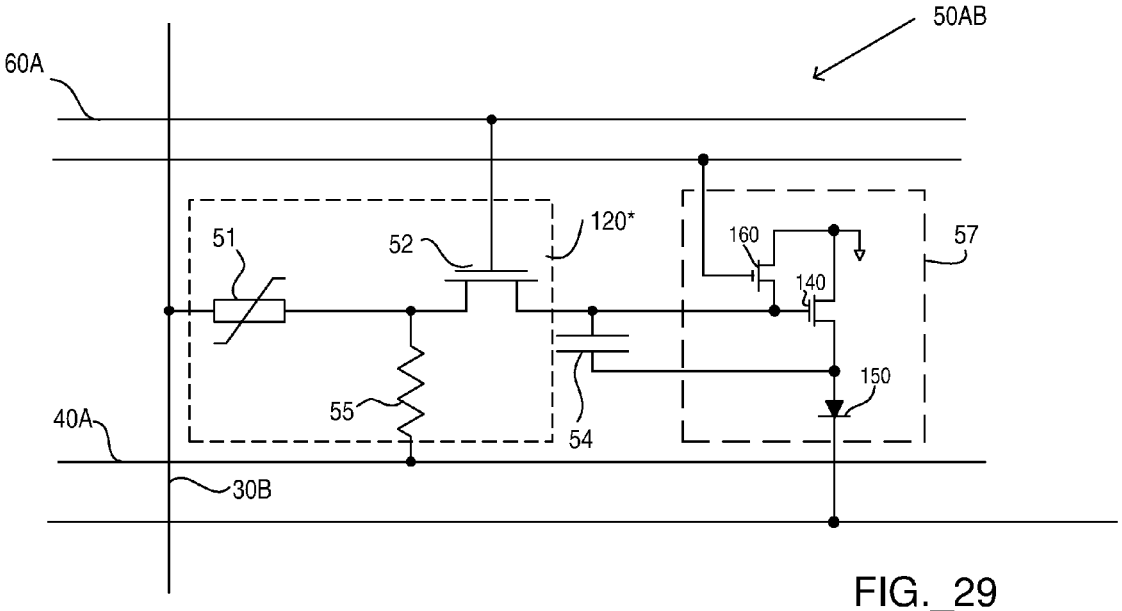

The pixel elements in FIGS. 28A-28H are modified from some existing pixel elements as described in U.S. patent application Ser. Nos. 12/404,326, 12/404,327, 12/404,328, and 12/404,329 by using the compound-switch 120* to a substitute for a FET switch in these existing pixel elements. Similarly, the pixel elements in FIG. 29 is modified from an existing pixel element by using the compound-switch 120* to a substitute for a FET switch in such existing pixel elements. The FET switch in each of these existing pixel elements is used for selectively turning on and off the coupling between such existing pixel element and a column conducting line. When this FET switch is in conducting state, data signals can be written into such existing pixel element. When this FET switch is in non-conducting state, such existing pixel element is practically isolated from the data signals on the column conducting line. The detailed operation principles of the pixel elements in FIGS. 28A-28H can be understood based on the teachings in U.S. patent application Ser. Nos. 12/404,326, 12/404,327, 12/404,328, and 12/404,329, and based on the disclosures in the instant application.

In addition to the examples as shown in FIGS. 28A-28H and FIG. 29, there are large numbers of existing pixel elements which can be modified to become a modified pixel element that can be driven with the method 700 as shown in FIG. 27C. Examples of these existing pixel elements also include the pixel elements as shown in FIG. 31A and FIG. 32A. Many of these existing pixel elements can be driven with the method as shown in FIG. 30, which includes steps 810, 820, 830, and 840.

Figure 30:
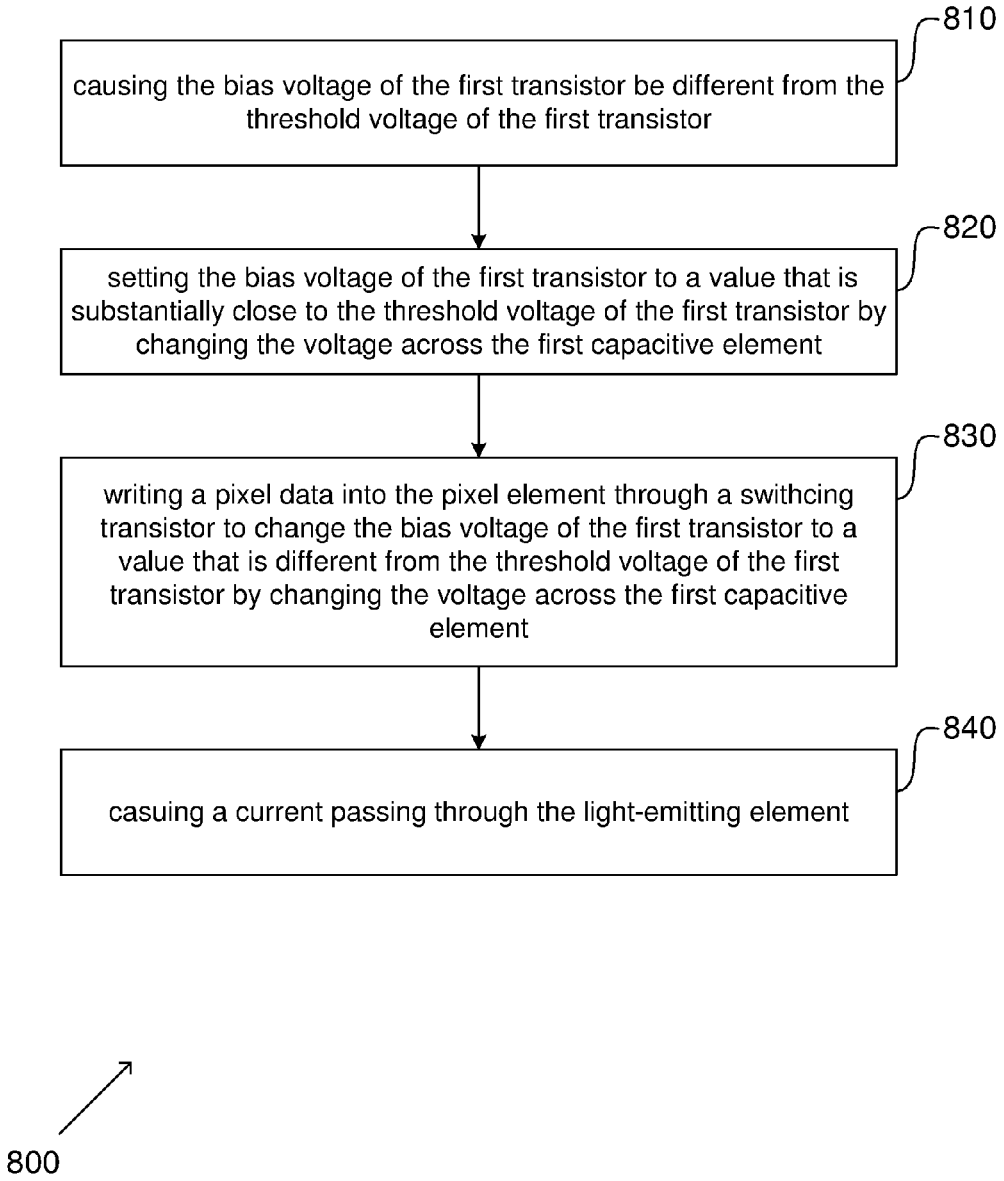
FIG. 30 is a flow chart in accordance with some embodiments to illustrate a method that can be used to drive some of the existing pixel elements.
Figure 31A:
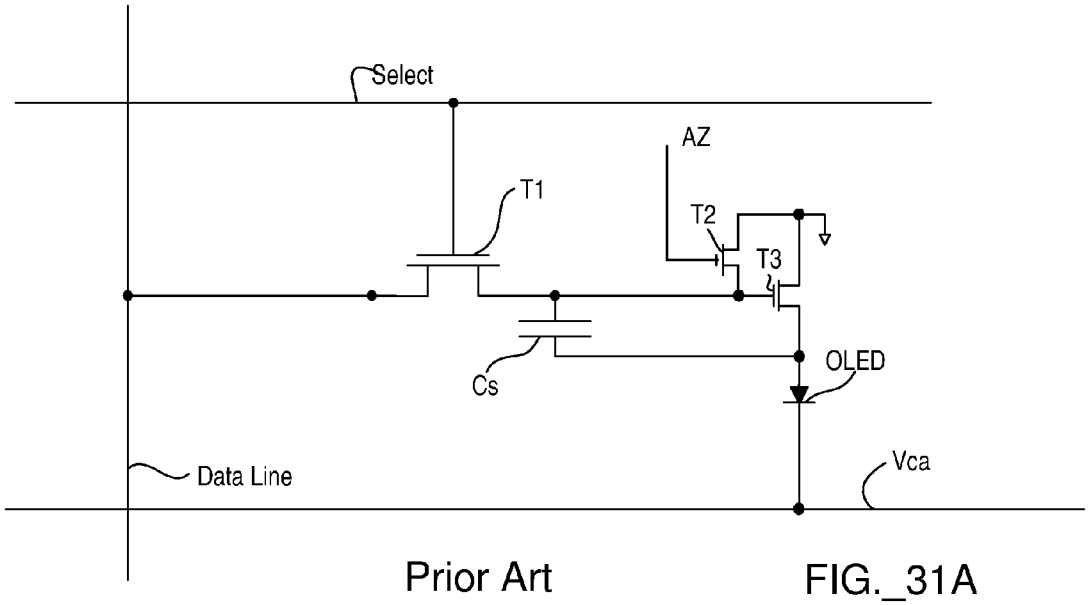
Prior Art FIG. 31A
FIG. 31A is an exemplary pixel elements in which a certain switching transistor can be replaced with a compound-switch.
Figure 32A:
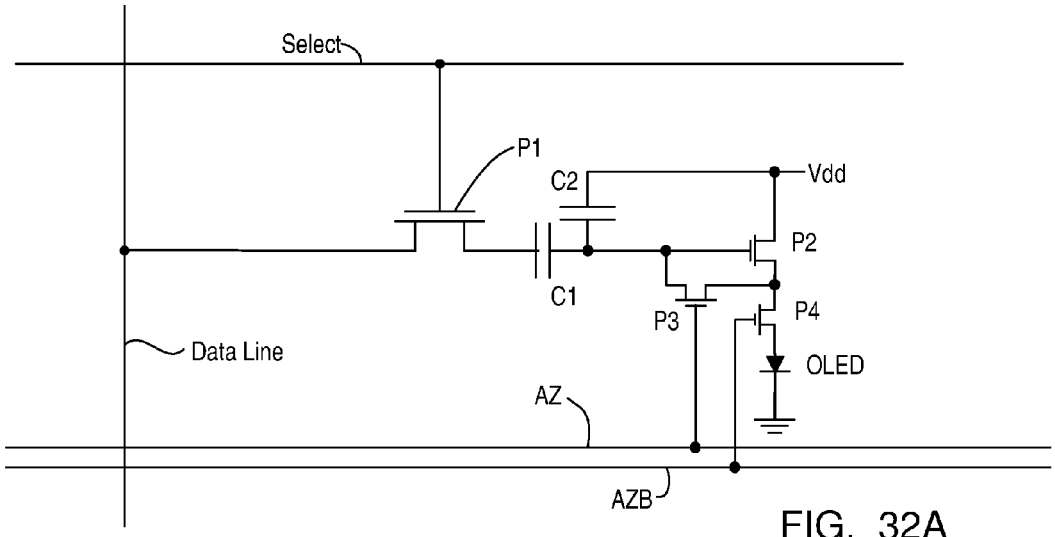
Prior Art FIG. 32A
FIG. 32A is an exemplary pixel elements in which a certain switching transistor can be replaced with a compound-switch.

As a first example, the method as shown in FIG. 30 is used for driving the pixel element in FIG. 31A. At step 810, when T2 is set to conducting state with a control on AZ and the OLED is set to conducting state with a negative voltage on $V_{ca}$, the first transistor T3 is driven into conducting state and the bias voltage of the first transistor T3 is caused to be different from the threshold voltage $V_{th}$ of the first transistor T3. At the end of step 810, when T2 is set to non-conducting state with a control on AZ and the OLED is set to non-conducting state (reverse bias state) with a positive voltage on $V_{ca}$, a voltage higher than the threshold voltage of the first transistor T3 is stored in the first capacitive element Cs.

At step 820, when T2 is set to conducting state while the OLED is kept at non-conducting state by setting $V_{ca}$ at the zero voltage, the first capacitive element $C_s$ is discharged through the first transistor T3 until the bias voltage of the first transistor T3 reaches to a value that is substantially close to the threshold voltage $V_{th}$ of the first transistor T3. At the end of step 820, after T2 is set to non-conducting state, the voltage across the first capacitive element $C_s$ essentially maintains at the threshold voltage $V_{th}$ of the first transistor T3. After step 820, T2 is kept at non-conducting state.

At the step 830, the OLED remains at non-conducting state by keeping $V_{ca}$ at the zero voltage, after the switching transistor T1 is set to conducting state with a selection line and during a data writing period, a data voltage $V_{data}$ on the Data Line is written into the pixel element through the switching transistor T1 to change the bias voltage of the first transistor T3 to a value that is different from the threshold voltage of the first transistor T3 by changing the voltage across the first capacitive element $C_s$. During the data writing period at step 830, when the data voltage $V_{data}$ is applied across the capacitive-voltage-divider that is formed by the first capacitive element $C_s$ and the capacitor associated with the the OLED, most of the data voltage $V_{data}$ is added to the first capacitive element $C_s$, for the reason that the first capacitive element $C_s$ is much smaller than the capacitor associated with the OLED; consequently, the voltage across the first capacitive element $C_s$ is changed to $V_{data}+V_{th}$. At the end of the step 830, the switching transistor T1 is set to non-conducting state. After the step 830, the switching transistor T1 remains at non-conducting state.

At the step 840, after the OLED is set to conducting state with a negative voltage on $V_{ca}$, a current is caused to pass through both the semiconductor channel of the first transistor T3 and the light-emitting element OLED, and the value of such current depends upon the value of the data voltage $V_{data}$.

Figure 31B:
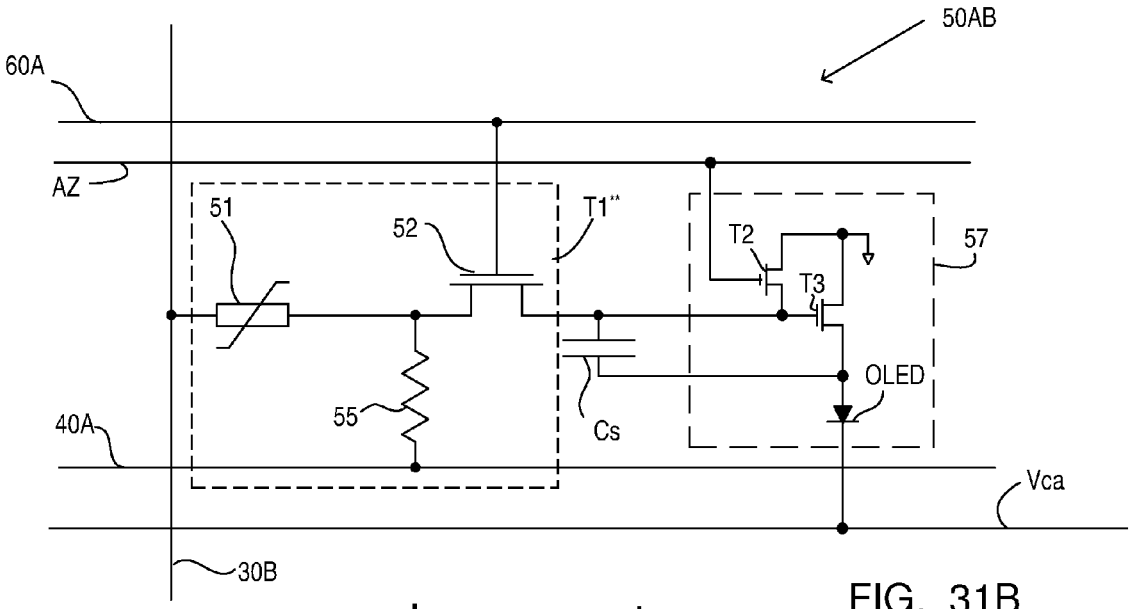
FIG. 31B is a modified pixel element in which a compound-switch is used to substitute certain switching transistor in the pixel element of FIG. 31A in accordance with some embodiments.

When the pixel element in FIG. 31A is modified by replacing the switching transistor T1 with a compound-switch T1* that includes a nonlinear element 51 and a switching transistor 52, it becomes the modified pixel element as shown in FIG. 31B. This modified pixel element in FIG. 31B can be driven with the method 700 as shown in FIG. 27C when the data voltage $V_{data}$ on the Data Line needs to be written into the pixel element (for example, at the step 830 of the method as shown in FIG. 30).

As a second example, the method as shown in FIG. 30 is used for driving the pixel element in FIG. 32A. At step 810, P3 is at non-conducting state, when P1 is set to conducting state with a selection signal and a certain reference voltage is applied on the Data Line, the first transistor P2 is caused to be biased at a value different from the threshold voltage $V_{th}$ of the first transistor P2. At the end of step 810, P1 is changed to non-conducting state, and a voltage higher than the threshold voltage of the first transistor P2 is stored in the first capacitive element $C_2$.

At step 820, P3 is set to conducting state and P4 is set to non-conducting state, the first capacitive element $C_2$ is discharged through the first transistor P2 until the bias voltage of the first transistor P2 reaches to a value that is substantially close to the threshold voltage $V_{th}$ of the first transistor P2. After step 820, P3 is kept at non-conducting state.

At the step 830, P4 remains at non-conducting, and a data voltage $V_{data}$ on the Data Line is written into the pixel element through the switching transistor P1 to change the bias voltage of the first transistor P2 to a value that is different from the threshold voltage of the first transistor P2 by changing the voltage across the first capacitive element $C_2$. During the data writing period at step 830, when the data voltage $V_{data}$ is applied across the capacitive-voltage-divider that is formed by the coupling capacitor $C_1$ and the first capacitive element $C_2$, the voltage across the first capacitive element $C_2$ is changed to $V_{th}+V_{data}\,C_1/(C_1+C_2)$. At the end of the step 830, the switching transistor P1 is set to non-conducting state. After the step 830, the switching transistor P1 remains at non-conducting state.

At the step 840, P4 is set to conducting state, and a current is caused to pass through both the semiconductor channel of the first transistor P2 and the light-emitting element OLED, and the value of such current depends upon the value of $V_{data}\,C_1/(C_1+C_2)$.

Figure 32B:
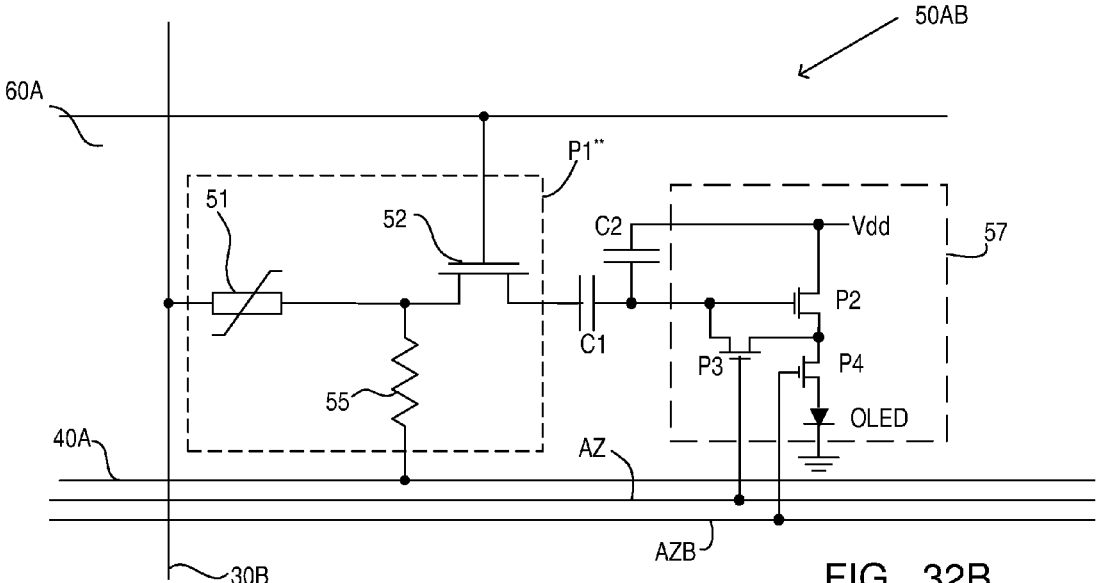
FIG. 32B is a modified pixel element in which a compound-switch is used to substitute certain switching transistor in the pixel element of FIG. 32A in accordance with some embodiments.

When the pixel element in FIG. 32A is modified by replacing the switching transistor P1 with a compound-switch P1* that includes a nonlinear element 51 and a switching transistor 52, it becomes the modified pixel element as shown in FIG. 32B. This modified pixel element in FIG. 32B can be driven with the method 700 as shown in FIG. 27C.

Figure 33:
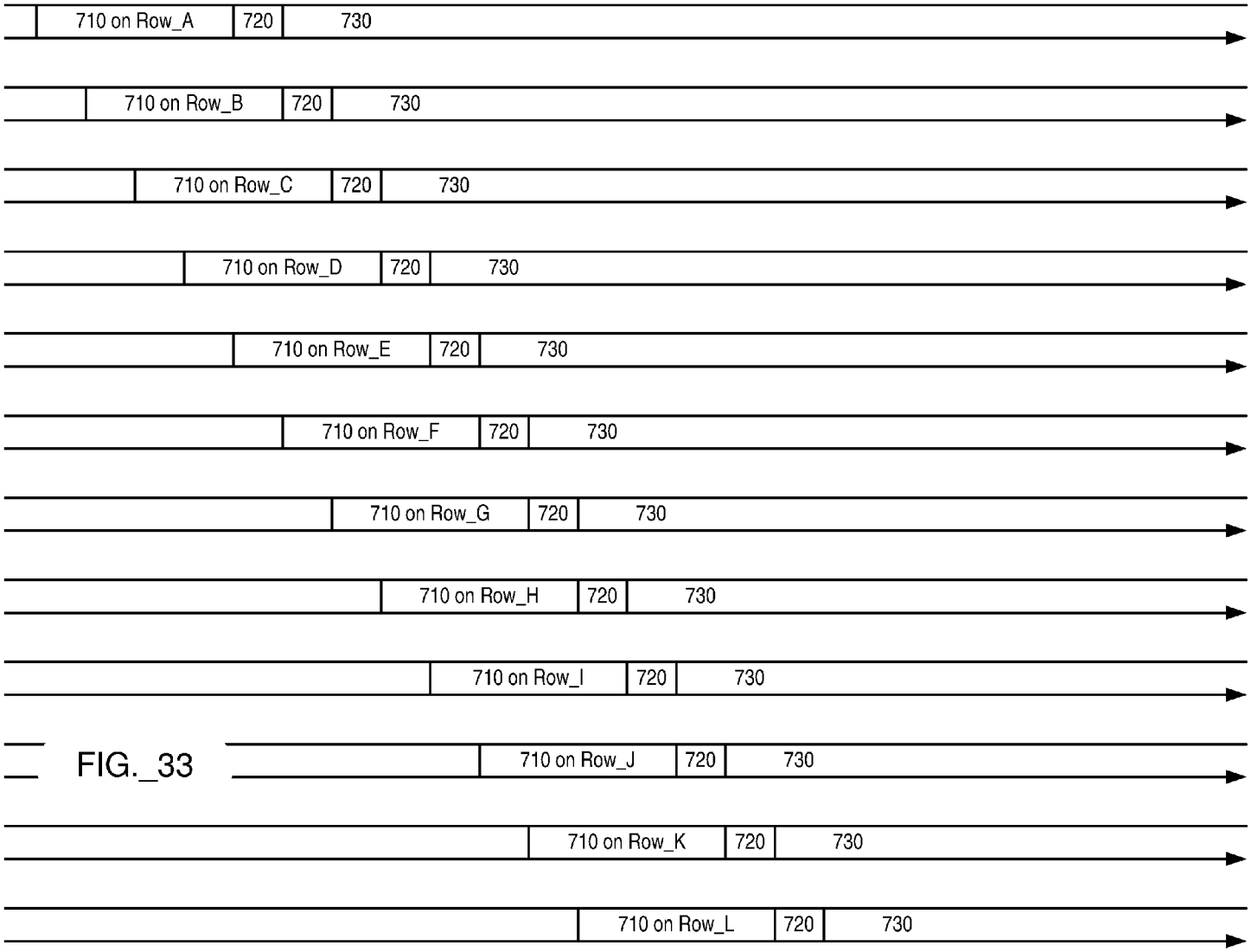
FIG. 33, FIG. 34, and FIGS. 35A-35B are exemplary timing diagrams when some steps in FIG. 27C or FIG. 27D are used to drive a column of the pixel elements in accordance with some embodiments.
Figure 34:
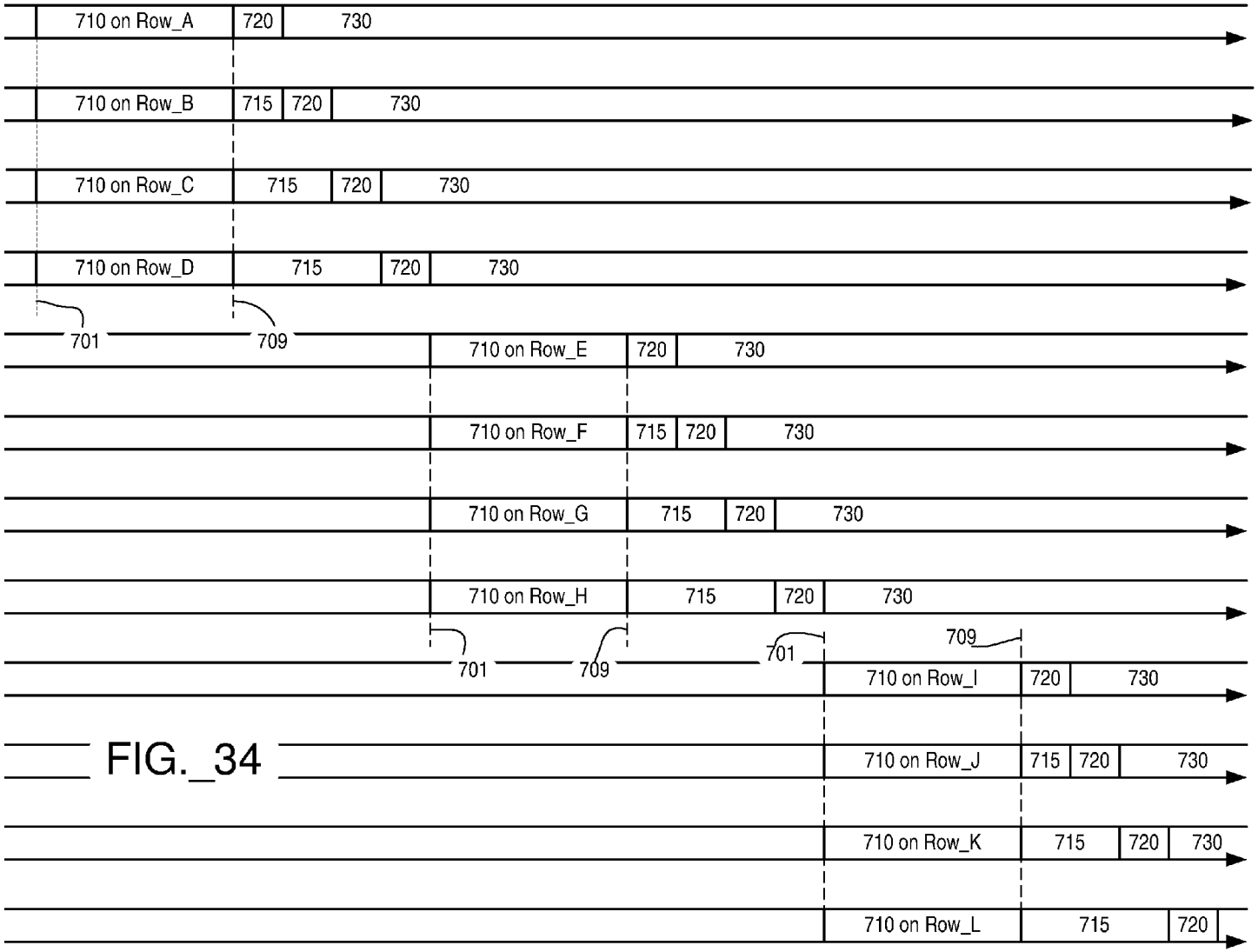

FIG. 33 and FIG. 34 are exemplary timing diagrams when some steps in FIG. 27C or FIG. 27D are used to drive a column of the pixel elements in accordance with some embodiments. In FIG. 33 and FIG. 34, some steps of the method 700 in FIG. 27C or FIG. 27D are applied to certain pixel element that includes (1) a first capacitive element, (2) a first transistor, (3) a light-emitting element, and (4) a compound-switch including at least one switching transistor and at least one secondary switching element. In this pixel element, the first transistor has a semiconductor channel that is electrically connected to the first capacitive element, and the light-emitting element is operationally coupled to the first transistor such that light emitted from the light-emitting element depends upon a bias voltage of the first transistor at least during one operation mode—here, the bias voltage is a voltage difference between the gate of the first transistor and a terminal of the semiconductor channel of the first transistor.

In the implementations as shown in FIG. 33, each pixel element chosen from the rows A to L in a column of the pixel elements is driven with at least steps 710, 720, and 730. Each of the steps 710, 720, and 730 may have specific implementations and variations. The variation of the step 710 in FIG. 33 includes setting the bias voltage of the first transistor to a value that is substantially close to a threshold voltage of the first transistor at the end of a first time period after starting changing a voltage across the first capacitive element at the beginning of the first time period. The variation of the step 720 in FIG. 33 includes writing a pixel data into the pixel element to change the bias voltage of the first transistor to a target value that is different from the threshold voltage of the first transistor during a second time period while keeping the compound-switch at conducting state—here, the compound-switch is in conducting state when both the at least one switching transistor and the at least one secondary switching element of the compound-switch are in conducting state. The implementation of the step 730 in FIG. 33 includes causing the light-emitting element to emit light. In the embodiment as shown in FIG. 33, the first time period for applying the step 710 is at least three times as long as the second time period for applying the step 720. In other embodiments, the first time period for applying the step 710 can be at least four times, at least six times, at least eight times, at least twelve times, or at least sixteen times as long as the second time period for applying the step 720. In some implementations, after a pixel element is driven with the step 710, a step 715 can also be applied to this pixel element before it is driven with the step 720 (for these implementations, the timing diagram is not explicitly shown in FIG. 33), where the step 715 includes maintaining a voltage across the first capacitive element in this pixel element.

In the implementations as shown in FIG. 33, the step 720 is applied to each pixel element from the row A to the row L in a given column of the pixel elements consecutively. Correspondingly, the pixel data for each pixel element from the row A to the row L is consecutively applied on a column conducting line connecting to each of the pixel elements in this given column. In many implementations, at the end of the second time period for applying the step 720 on a given pixel element, the pixel data on this column is generally still valid for such given pixel element. In many implementations, the pixel data for the next pixel element is generally applied to this given column somewhat after the end of the second time period for applying the step 720 on the previous pixel element—even through such delay from the end of the second time period can be somewhat small in some specific implementations.

In the implementations as shown in FIG. 33, the first time period for applying the step 710 on a given pixel element overlaps the first time period for applying the step 710 on the next pixel element. For example, the first time period for applying the step 710 on the pixel element in Row A overlaps the first time period for applying the step 710 on the pixel element in Row B. In the example in FIG. 33, the first time period for applying the step 710 on the pixel element in Row A also overlaps the first time period for applying the step 710 on the pixel element in Row C or the first time period for applying the step 710 on the pixel element in Row D.

In the implementations as shown in FIG. 34, each pixel element chosen from the rows A to L in a column of the pixel elements is driven with at least steps 710, 720, and 730. Each of the steps 710, 720, and 730 may have specific implementations and variations. In the implementations as shown in FIG. 34, during a common time period between time instant 701 and time instant 709, multiple pixel elements are applied with the step 710, where the step 710 includes setting the bias voltage of the first transistor in the given pixel element to a value that is substantially close to a threshold voltage of the first transistor in the given pixel element by changing a voltage across the first capacitive element in the given pixel element. For example, in FIG. 34, multiple pixel elements from the rows A, B, C, and D are applied with the step 710 during a first common time period, multiple pixel elements from the rows E, F, G, and H are applied with the step 710 during a second common time period, multiple pixel elements from the rows I, J, K, and L are applied with the step 710 during a third common time period.

In the implementations as shown in FIG. 34, after multiple pixel elements from the rows A, B, C, and D are applied with the step 710, pixel data for each given pixel element the rows A, B, C, or D is written into this given pixel element at the step 720 during the corresponding allocated time period for this given pixel element to change the bias voltage of the first transistor in this given pixel element to a value that is different from the threshold voltage of the first transistor in this given pixel element. In FIG. 34, the end of the allocated time period for the pixel element at Row B is after the end of the allocated time period for the Row A; the end of the allocated time period for the pixel element at Row C is after the end of the allocated time period for the Row B; and the end of the allocated time period for the pixel element at Row D is after the end of the allocated time period for the Row C. In FIG. 34, after the step 710 but before the step 720, a step 715 can be applied to a given pixel element so that the beginning of the step 720 can be delayed properly, where the step 715 includes maintaining a voltage across the first capacitive element in this given pixel element.

Figure 35A:
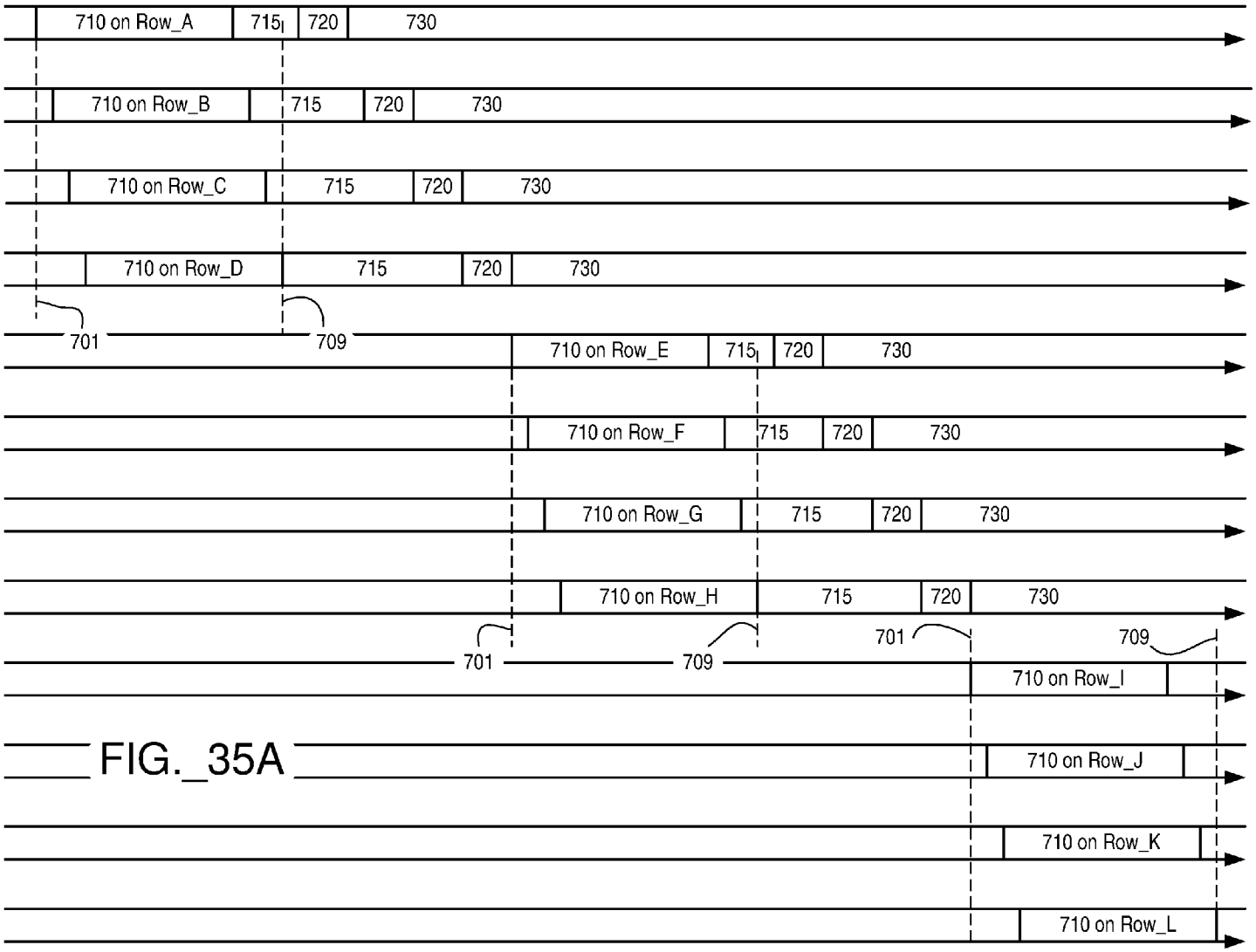
Figure 35B:
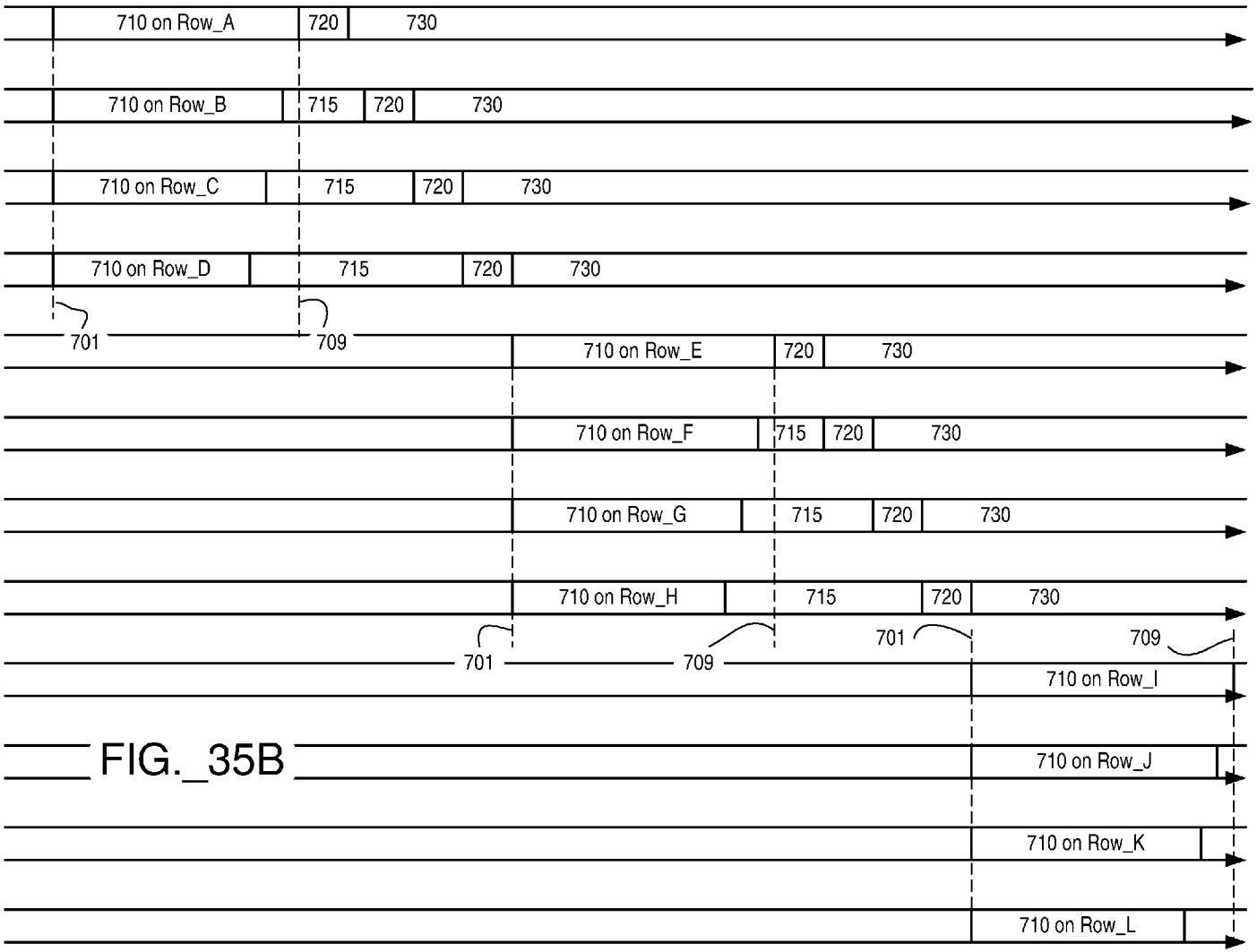

In the implementations as shown in FIG. 34, multiple pixel elements from the rows A, B, C, and D are applied with the step 710 during a first common time period between time instant 701 and time instant 709. For these multiple pixel elements from the rows A, B, C, and D, the beginning time to start applying the step 710 to each pixel element is approximately identical, and the ending time to stop applying the step 710 to each pixel element at the rows A, B, C, or D is approximately identical. In some other implementations, the beginning time to start applying the step 710 to each pixel element does not need to be identical, the ending time to stop applying the step 710 to each pixel element at the rows A, B, C, or D does not need to identical, or both the beginning time and the ending time do not need to be identical. For example, in the implementations as shown in FIG. 35A and FIG. 35B, while multiple pixel elements from the rows A, B, C, and D are applied with the step 710 during a first common time period between time instant 701 and time instant 709, the beginning time to start applying the step 710 to each pixel element can be delayed from each other, and the ending time to stop applying the step 710 to each pixel element at the rows A, B, C, or D can also be delayed from each other. Additionally, in some implementations, the time duration between the beginning time and the ending time for applying the step 710 to each pixel element does not need to identical.

In the implementations as shown in FIG. 34 and FIGS. 35A-35B, when multiple pixel elements from the rows A, B, C, and D are applied with the step 710 during a first common time period, a reference voltage signal can be applied to a column conducting line connecting to each of these multiple pixel elements during this first common time period. Because this reference voltage signal does not need to be identical to the pixel data signal for any of these pixel elements, this reference voltage signal can be used to facilitate the process of setting the bias voltage of the first transistor in each these pixel elements to a value that is substantially close to the corresponding threshold voltage of this first transistor.

In the implementations as shown in FIG. 34 and FIGS. 35A-35B, each pixel element in a column of the pixel elements is driven with at least steps 710 and 720, and during a common time period between time instant 701 and time instant 709, four pixel elements are applied with the step 710. In other implementations, more than four pixel elements can be applied with the step 710 during a common time period. For example, the number of the multiple pixel elements in a column that are applied with the step 710 during a common time period can be at least four, at least five, at least six, at least eight, at least ten, at least sixteen, or at least twenty.

In the implementations as shown in FIG. 33, FIG. 34 and FIGS. 35A-35B, the time period allocated for applying the step 710 to each pixel element can be much longer than the time period allocated for applying the step 720 to this pixel element. In an exemplary embodiment, an active matrix display includes a matrix of the pixel elements in which a column of pixel elements includes 600 pixel elements, and each of the 600 pixel elements in this column is configured to receive its corresponding pixel data from a column conducting line (which can involve an implementation somewhat similar to the circuit as shown in FIG. 27B where each of the 12 pixel elements in column B is configured to receive its corresponding pixel data from the column conducting line 30B). In this exemplary embodiment, the displayed image on the active matrix display is refreshed at 60 Hz, which corresponds to a frame time period $T_f$ that is about 1/60 of a second (i.e., $T_f \approx 16.7$ ms). In this exemplary embodiment, all of the 600 pixel elements need to refresh their pixel data within the frame time period $T_f$. In a very specific implementation, if the pixel data for each of the 600 pixel elements is applied sequentially on the column conducting line and if the time periods allocated for applying the pixel data to each pixel element are all equal, then, the time period allocated for applying the pixel data to each pixel element is generally less than $T_f/600$. In this very specific implementation, if these pixel elements are driven with the method 700 in FIG. 27C or FIG. 27D using the timing diagrams as shown in FIG. 33, FIG. 34, FIG. 35A, or FIG. 35B, the time period allocated for applying the step 720 to each pixel element is generally not smaller than then the time period allocated for applying the pixel data to each pixel element, and the time period allocated for applying the step 710 to each pixel element can be at least four time longer than the time period allocated for applying the step 720 to this pixel element. Consequently, in this very specific implementation, the time period allocated for applying the step 710 to each pixel element can be longer than $4T_f/600$. In general, in accordance some embodiments, when the column of pixel elements includes M pixel elements, the time period allocated for applying the step 710 to each pixel element can be longer than $4T_f/M$, $5T_f/M$, $6T_f/M$, $8T_f/M$, $10T_f/M$, $12T_f/M$, $16T_f/M$, $20T_f/M$, or $24T_f/M$. In addition, the frame time period $T_f$ can be less than 1/60, 1/120, 1/180, or 1/240; the number of pixel elements in a column can be larger than 600 (i.e., $M \geq 600$).

In the timing diagrams as shown in FIG. 33, FIG. 34 and FIGS. 35A-35B, each row is identified with one of the labels, such as, Row A, Row B, Row C, Row D, . . . , Row K, and Row L. These labels are merely identifiers that us used to identify the rows of an active matrix display. Consequently, in a real physical device, Row B does not have to be physically located between Row A and Row C or physically neighboring Row A and Row C; similarly, Row C does not have to be physically located between Row B and Row D or physically neighboring Row B and Row D. Only in a very specific implementation, the order of rows in a real physical device as identified by the Row A, Row B, Row C, Row D, . . . , Row K, and Row L is coincidence with the order of rows as they appear in one of the timing diagrams from FIG. 33, FIG. 34 and FIGS. 35A-35B. The order of rows in a real physical device can be generally different from the order of rows in the timing diagrams from FIG. 33, FIG. 34 and FIGS. 35A-35B. The order of rows in a real physical device can also be generally different from the order of rows in many of other timing diagrams in this disclosure.

In the present disclosure, the compound-switch generally includes a nonlinear element functioning as the secondary switching element and a switching transistor functioning as the main switching element. The nonlinear element can be a diode or other kind of devices. The secondary switching element often is selected to have faster switching speed than the main switching element in the compound-switch. There are many implementations of the secondary switching element that includes a nonlinear element. There are also many known method for driving a nonlinear element into conducting state or into non-conducting state, and some of these methods involving the assistance of a resistive element. In some of the exemplary implantation in the present disclosure, the nonlinear element is driven into conducting state or into non-conducting state with the assistance of a resistive element connecting to a row concluding line. For the purpose of driven the nonlinear element into conducting state or into non-conducting state, and for some of the implementations disclosed in the present disclosure, this resistive element does not have to be a linear resistor. For example, sometimes, this resistive element can be a revise-biased diode.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A method of writing a pixel data into a pixel element in an active matrix display, the active matrix display including a matrix of pixel elements wherein a pixel element includes (a) at least one switching transistor having a semiconductor channel, (b) at least one nonlinear element, and (c) at least one capacitive element, the method comprising the steps of:

setting both the semiconductor channel of the at least one switching transistor and the at least one nonlinear element into conducting states;

causing a voltage applied across the at least one capacitive element while the semiconductor channel of the at least one switching transistor maintains at conducting state and the at least one nonlinear element maintains at conducting state; and after the step of causing, (a) driving the at least one nonlinear element into non-conducting state from conducting state, and (b) driving the semiconductor channel of the at least one switching transistor into non-conducting state from conducting state for settling the semiconductor channel into non-conducting state after the at least one nonlinear element is settled into non-conducting state.

2. The method of claim 1, wherein said causing step comprises steps of:

creating a current that passes through both the semiconductor channel of the at least one switching transistor and the at least one nonlinear element to transmit electrical charges to the at least one capacitive element while the semiconductor channel of the at least one switching transistor maintains at conducting state and the at least one nonlinear element maintains at conducting state.

3. The method of claim 2, wherein said creating step comprises:

applying a predetermined current to a column conducting line connecting to the pixel element.

4. The method of claim 2, wherein said creating step comprises:

applying a predetermined voltage to a column conducting line connecting to the pixel element.

5. An active matrix display including a matrix of pixel elements, wherein a pixel element comprises (a) at least one switching transistor having a semiconductor channel, (b) at least one nonlinear element, and (c) at least one capacitive element, the pixel element further comprising:

means for setting both the semiconductor channel of the at least one switching transistor and the at least one nonlinear element into conducting states;

means for causing a voltage applied across the at least one capacitive element while the semiconductor channel of the at least one switching transistor maintains at conducting state and the at least one nonlinear element maintains at conducting state; and means for driving the at least one nonlinear element into non-conducting state from conducting state to cause a pixel data be captured into the pixel element and for driving the semiconductor channel of the at least one switching transistor into non-conducting state from conducting state for settling the semiconductor channel into non-conducting state after the at least one nonlinear element is settled into non-conducting state.

6. The active matrix display of claim 5, wherein the pixel element further comprises:

means for creating a current that passes through both the semiconductor channel of the at least one switching transistor and the at least one nonlinear element to transmit electrical charges to the at least one capacitive element while the semiconductor channel of the at least one switching transistor maintains at conducting state and the at least one nonlinear element maintains at conducting state.

7. A method applied on an active matrix display having a matrix of the pixel elements, wherein a column of pixel elements includes at least M pixel elements, the integer M being larger than or equal to three ($M \geq 3$), wherein each of the at least M pixel elements includes (a) at least one switching transistor having a semiconductor channel, (b) at least one nonlinear element, and (c) at least one capacitive element, and the method comprising:

for each positive integer k that is smaller than or equal to the integer M ($1 \leq k \leq M$), writing a pixel data into the k'th pixel element in the M pixel elements during an allocated time period for the k'th pixel element;

wherein, for each positive integer k that is smaller than the integer M ($k<M$), the end of the allocated time period for the (k+1)'th pixel element is after the end of the allocated time period for the k'th pixel element; and wherein said writing a pixel data into the k'th pixel element further comprises, setting both the semiconductor channel of the at least one switching transistor and the at least one nonlinear element into conducting states, causing a voltage applied across the at least one capacitive element while the semiconductor channel of the at least one switching transistor maintains at conducting state and the at least one nonlinear element maintains at conducting state, and after the step of causing, (a) driving the at least one nonlinear element into non-conducting state from conducting state at the end of the allocated time period for the k'th pixel element, and (b) driving the semiconductor channel of the at least one switching transistor into non-conducting state from conducting state for settling the semiconductor channel into non-conducting state after the at least one nonlinear element is settled into non-conducting state.

8. The method of claim 7, wherein said writing a pixel data into the k'th pixel element further comprises:

setting the semiconductor channel of the at least one switching transistor into conducting state before setting the at least one nonlinear element into conducting state.

9. The method of claim 7, wherein said writing a pixel data into the k'th pixel element further comprises:

setting the at least one nonlinear element into conducting state before setting the semiconductor channel of the at least one switching transistor into conducting state.

10. The method of claim 7, wherein, for each k that is smaller than the integer M ($k<M$), the beginning of the allocated time period for the (k+1)'th pixel element is after the end of the allocated time period for the k'th pixel element.

11. The method of claim 7, wherein, for each k that is smaller than the integer M ($k<M$), the end of the allocated time period for the (k+1)'th pixel element is delayed from the end of the allocated time period for the k'th pixel element.

12. The method of claim 7, wherein, for each k that is smaller than the integer M ($k<M$), the end of the allocated time period for the (k+1)'th pixel element is delayed from the end of the allocated time period for the k'th pixel element with a substantially same delay.

13. The method of claim 7, wherein said writing a pixel data into the k'th pixel element further comprises:

driving the semiconductor channel of the at least one switching transistor in the k'th pixel element into conducting state from non-conducting state, and maintaining the semiconductor channel of the at least one switching transistor in the k'th pixel element at conducting state for duration of an associated time period for the k'th pixel element.

14. The method of claim 13, wherein said writing a pixel data into the k'th pixel element further comprises:

driving the at least one nonlinear element in the k'th pixel element into conducting state from non-conducting state, and maintaining the at least one nonlinear element in the k'th pixel element at conducting state for a duration of the allocated time period for the k'th pixel element that is within the associated time period for the k'th pixel element.

15. The method of claim 13, wherein, for at least one integer value of k, the associated time period for the k'th pixel element is more than three times longer than the allocated time period for the k'th pixel element.

16. The method of claim 13, wherein for at least one integer value of k, the associated time period for the k'th pixel element overlaps with at least two other associated time periods.

17. The method of claim 13, wherein, for each k that is smaller than M+1, the associated time period for the k'th pixel element is at least M times as long as the allocated time period for the k'th pixel element.

18. The method of claim 13, wherein the associated time period for the first pixel element in the M pixel elements overlaps with the associated time periods of the remaining M−1 pixel element.

19. The method of claim 13, wherein the associated time periods for the M pixel elements are all beginning substantially at the same time.

20. The method of claim 13, wherein the associated time periods for the M pixel elements are all beginning substantially at the same time and all ending substantially at the same time.

21. The method of claim 13, wherein, for each k that is smaller than the integer M (k<M), the beginning of the associated time period for the (k+1)'th pixel element is delayed from the beginning of the associated time period for the k'th pixel element, with the associated time period for the (k+1)'th pixel element overlapping with the associated time period for the k'th pixel element.

22. The method of claim 13, wherein, for each k that is smaller than the integer (k<M), the beginning of the associated time period for the (k+1)'th pixel element is delayed from the beginning of the associated time period for the k'th pixel element with a substantially same delay constant.

23. The method of claim 7, each of the at least M pixel elements further includes a light-emitting element operationally coupled to a first transistor such that light emitted from the light-emitting element depends upon a bias voltage of the first transistor at least during one operation mode, with the bias voltage being a voltage difference between the gate of the first transistor and a terminal of the semiconductor channel of the first transistor, and the method further comprising the step of:

for each given pixel element from the M pixel elements, setting the bias voltage of the first transistor in the given pixel element to a value that is substantially close to a threshold voltage of the first transistor in the given pixel element by changing a voltage across the at least one capacitive element in the given pixel element during a shared time period.

24. A method applied on an active matrix display having a matrix of the pixel elements, wherein a column of pixel elements includes at least M pixel elements, the integer M being larger than or equal to three (M≥3), wherein each of the at least M pixel elements includes (a) at least one capacitive element and (b) a compound-switch including at least one switching transistor and at least one secondary switching element, and the method comprising:

for each positive integer k that is smaller than or equal to the integer M (1≤k≤M), writing a pixel data into the k'th pixel element in the M pixel elements during an allocated time period for the k'th pixel element;

wherein, for each k that is smaller than the integer M (k<M), the end of the allocated time period for the (k+1)'th pixel element is after the end of the allocated time period for the k'th pixel element; and wherein said writing a pixel data into the k'th pixel element further comprises, setting both the semiconductor channel of the at least one switching transistor and the at least one secondary switching element into conducting states;

causing a voltage applied across the at least one capacitive element while the semiconductor channel of the at least one switching transistor maintains at conducting state and the at least one secondary switching element maintains at conducting state; and after the step of causing, (a) driving the at least one secondary switching element into non-conducting state from conducting state at the end of the allocated time period for the k'th pixel element, and (b) driving the semiconductor channel of the at least one switching transistor into non-conducting state from conducting state for settling the semiconductor channel into non-conducting state after the at least one secondary switching element is settled into non-conducting state.

25. The method of claim 24, wherein the at least one secondary switching element includes a non-linear diode.

26. The method of claim 24, wherein the at least one secondary switching element includes a transistor that has faster switching speed than the at least one switching transistor.

* * * * *